US009981464B2

(12) United States Patent
Karita et al.

(10) Patent No.: US 9,981,464 B2
(45) Date of Patent: May 29, 2018

(54) PRINTING APPARATUS, PRINTING METHOD, AND MEDIUM

(71) Applicant: CANON KABUSHIKI KAISHA, Tokyo (JP)

(72) Inventors: Seiichiro Karita, Saitama (JP); Shuzo Iwanaga, Kawasaki (JP); Kazuhiro Yamada, Yokohama (JP); Takatsuna Aoki, Yokohama (JP); Shingo Okushima, Kawasaki (JP); Zentaro Tamenaga, Sagamihara (JP); Yumi Komamiya, Kawasaki (JP); Noriyasu Nagai, Tokyo (JP); Tatsurou Mori, Yokohama (JP); Yoshiyuki Nakagawa, Kawasaki (JP); Akira Yamamoto, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/382,027

(22) Filed: Dec. 16, 2016

(65) Prior Publication Data

US 2017/0197407 A1 Jul. 13, 2017

(30) Foreign Application Priority Data

Jan. 8, 2016 (JP) ..... 2016-002882

(51) Int. Cl.
*B41J 2/045* (2006.01)
*B41J 2/175* (2006.01)
(Continued)

(52) U.S. Cl.
CPC ..... *B41J 2/04535* (2013.01); *B41J 2/04586* (2013.01)

(58) Field of Classification Search
CPC ..... B41J 2/195; B41J 2/175; B41J 2/18; B41J 2/1195; B41J 2/04535; B41J 2/04586
See application file for complete search history.

(56) References Cited

U.S. PATENT DOCUMENTS 4,737,801 A 4/1988 Ichihashi et al. ..... 347/85
4,748,459 A 5/1988 Ichihashi et al. ..... 347/31
(Continued)

FOREIGN PATENT DOCUMENTS

JP 2005-271337 10/2005
JP 2014-141032 8/2014

OTHER PUBLICATIONS

U.S. Appl. No. 15/387,340, filed Dec. 21, 2016.
(Continued)

*Primary Examiner* — Jason Uhlenhake
(74) *Attorney, Agent, or Firm* — Fitzpatrick, Cella, Harper & Scinto

(57) ABSTRACT

In a printing apparatus including a circulation system circulating a liquid, a volatile component included in the liquid evaporates from an ejection opening and thus characteristics of the liquid involving with concentration or viscosity change. The invention provides a printing apparatus that uses a liquid ejection head including an ejection opening ejecting a liquid, a print element generating energy for ejecting a liquid, and a pressure chamber having the print element provided therein, the printing apparatus including: a circulator configured to circulate the liquid so that the liquid passes through the pressure chamber; and a concentration adjustment unit configured to adjust a concentration of a liquid inside a liquid circulation system by discharging the liquid from the inside of the liquid circulation system and replenishing the liquid into the liquid circulation system
(Continued)

from the outside of the liquid circulation system in response to the amount of the discharged liquid.

19 Claims, 34 Drawing Sheets

(51) Int. Cl.
*B41J 2/18* (2006.01)
*B41J 2/195* (2006.01)

(56) References Cited

U.S. PATENT DOCUMENTS

| | | | | |
|---|---|---|---|---|
| 4,896,172 | A | 1/1990 | Nozawa et al. | 347/17 |
| 4,908,636 | A | 3/1990 | Saito et al. | 347/25 |
| 5,051,759 | A | 9/1991 | Karita et al. | 347/87 |
| 5,155,502 | A | 10/1992 | Kimura et al. | 347/87 |
| 5,166,707 | A | 11/1992 | Watanabe et al. | 347/3 |
| 5,189,443 | A | 2/1993 | Arashima et al. | 347/63 |
| 5,216,446 | A | 6/1993 | Satoi et al. | 347/65 |
| 5,237,342 | A | 8/1993 | Saikawa et al. | 347/87 |
| 5,251,040 | A | 10/1993 | Saito | 358/296 |
| 5,280,299 | A | 1/1994 | Saikawa et al. | 347/87 |
| 5,291,215 | A | 3/1994 | Nozawa et al. | 347/18 |
| 5,329,304 | A | 7/1994 | Koizumi et al. | 347/7 |
| 5,471,230 | A | 11/1995 | Saito et al. | 347/29 |
| 5,481,283 | A | 1/1996 | Watanabe et al. | 347/33 |
| 5,481,290 | A | 1/1996 | Watanabe et al. | 347/104 |
| 5,483,267 | A | 1/1996 | Nemura et al. | 347/32 |
| 5,488,395 | A | 1/1996 | Takayanagi et al. | 347/7 |
| 5,500,666 | A | 3/1996 | Hattori et al. | 347/87 |
| 5,502,479 | A | 3/1996 | Ishinaga et al. | 347/93 |
| 5,515,091 | A | 5/1996 | Kimura et al. | 347/86 |
| 5,548,309 | A | 8/1996 | Okubo et al. | 347/33 |
| 5,559,536 | A | 9/1996 | Saito et al. | 347/25 |
| 5,619,238 | A | 4/1997 | Higuma et al. | 347/86 |
| 5,623,287 | A | 4/1997 | Saikawa et al. | 347/47 |
| 5,629,728 | A | 5/1997 | Karita et al. | 347/87 |
| 5,689,290 | A | 11/1997 | Saito et al. | 347/7 |
| 5,703,632 | A | 12/1997 | Arashima et al. | 347/47 |
| 5,757,399 | A | 5/1998 | Murayama et al. | 347/32 |
| 5,864,352 | A | 1/1999 | Aoki et al. | 347/102 |
| 5,917,514 | A | 6/1999 | Higuma et al. | 347/29 |
| 5,917,524 | A | 6/1999 | Kimura et al. | 347/86 |
| 6,012,795 | A | 1/2000 | Saito et al. | 347/7 |
| 6,048,045 | A | 4/2000 | Nohata et al. | 347/7 |
| 6,056,386 | A | 5/2000 | Nohata et al. | 347/19 |
| 6,123,420 | A | 9/2000 | Higuma et al. | 347/86 |
| 6,247,784 | B1 | 6/2001 | Obana et al. | 347/37 |
| 6,250,752 | B1 | 6/2001 | Tajima et al. | 347/92 |
| 6,286,945 | B1 | 9/2001 | Higuma et al. | 347/86 |
| 6,290,344 | B1 | 9/2001 | Saikawa et al. | 347/86 |
| 6,332,673 | B1 | 12/2001 | Higuma et al. | 347/86 |
| 6,382,786 | B2 | 5/2002 | Iwanaga et al. | 347/86 |
| 6,406,118 | B1 | 6/2002 | Aoki et al. | 347/16 |
| 6,419,341 | B1 | 7/2002 | Nohata et al. | 347/19 |
| 6,419,349 | B1 | 7/2002 | Iwanaga et al. | 347/86 |
| 6,474,801 | B2 | 11/2002 | Higuma et al. | 347/86 |
| 6,527,381 | B1 | 3/2003 | Udagawa et al. | 347/86 |
| 6,652,949 | B2 | 11/2003 | Iwanaga et al. | 428/65.9 |
| 6,688,735 | B2 | 2/2004 | Higuma et al. | 347/86 |
| 6,742,881 | B2 | 6/2004 | Kotaki et al. | 347/86 |
| 6,796,643 | B2 | 9/2004 | Higuma et al. | 347/85 |
| 9,315,041 | B2 | 4/2016 | Moriguchi et al. | B41J 2/18 |
| 9,327,513 | B2 | 5/2016 | Moriguchi et al. | B41J 2/175 |
| 9,358,803 | B2 | 6/2016 | Moriguchi et al. | B41J 2/175 |
| 2002/0113853 | A1 | 8/2002 | Hattori et al. | 347/86 |
| 2003/0043241 | A1 | 3/2003 | Hattori et al. | 347/86 |
| 2005/0116982 | A1* | 6/2005 | Nakazawa | B41J 2/195 347/19 |
| 2008/0238980 | A1* | 10/2008 | Nagashima | B41J 2/14233 347/17 |

OTHER PUBLICATIONS

U.S. Appl. No. 15/387,334, filed Dec. 21, 2016.
U.S. Appl. No. 15/382,039, filed Dec. 16, 2016.
U.S. Appl. No. 15/382,048, filed Dec. 16, 2016.
U.S. Appl. No. 15/380,584, filed Dec. 15, 2016.

* cited by examiner

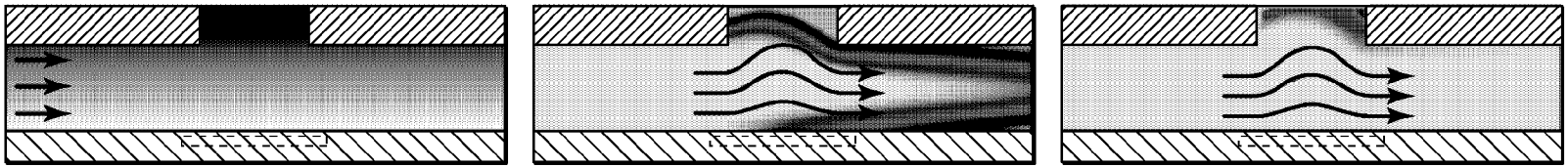
FIG.33A
FIG.33B
FIG.33C
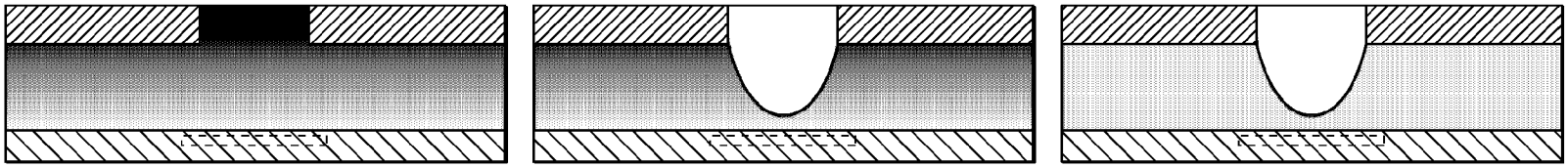
FIG.33D
FIG.33E
FIG.33F

PRINTING APPARATUS, PRINTING METHOD, AND MEDIUM

BACKGROUND OF THE INVENTION

Field of the Invention

The present invention relates to a printing apparatus, a printing method, and a medium.

Description of the Related Art

In the field of an inkjet printing head, since a volatile component of ink evaporates from an ejection opening, characteristics of the ink in the vicinity of the ejection opening change. Accordingly, some problems arise in that unevenness in color is caused by a change in color concentration and deterioration in landing accuracy is caused by a change in ejection speed in accordance with an increase in viscosity. As a countermeasure for such problems, there is known a method of circulating ink supplied to an inkjet printing head through a circulation path. However, in this method, since the ink is circulated so that fresh ink is supplied to a front end of a nozzle at all times, moisture normally evaporates from the front end of the nozzle. As a result, a problem arises in that a concentration of ink gradually increases in an entire circulation system.

In order to handle the above-described problem, Japanese Patent Laid-Open No. 2005-271337 discloses a technique of adjusting a concentration of ink of a circulation system to be uniform by predicting an ink consumption amount or an ink evaporation amount and replenishing thick ink or dilute solution prepared in advance on the basis of the prediction.

SUMMARY OF THE INVENTION

However, in the technique disclosed in Japanese Patent Laid-Open No. 2005-271337, since the thick ink or the dilute solution is needed and a concentration sensor for at least one color is needed, the system becomes complex. As a result, problems arise in that a configuration becomes complex and a cost increases.

The present invention is made in view of the above-described circumstances and an object of the present invention is to suppress an increase in concentration of a liquid flowing through a circulation system caused by an evaporation of a volatile component from an ejection opening without causing an increase in cost in terms of a simple configuration compared with the related art.

The present invention provides a printing apparatus that uses a liquid ejection head including an ejection opening ejecting a liquid, a print element generating energy for ejecting a liquid, and a pressure chamber having the print element provided therein, the printing apparatus comprising: a circulator configured to circulate the liquid so that the liquid passes through the pressure chamber; and a concentration adjustment unit configured to adjust a concentration of a liquid inside a liquid circulation system by discharging the liquid from the inside of the liquid circulation system and replenishing the liquid into the liquid circulation system from the outside of the liquid circulation system in response to the amount of the discharged liquid.

Further features of the present invention will become apparent from the following description of exemplary embodiments (with reference to the attached drawings).

BRIEF DESCRIPTION OF THE DRAWINGS

FIGS. 33A to 33F are schematic diagrams illustrating a state where the concentration of the ink at the nozzle portion is solved.

DESCRIPTION OF THE EMBODIMENTS

Hereinafter, a liquid ejection head and a liquid ejection apparatus according to application examples and embodiments of the present invention will be described with reference to the drawings. In the application examples and the embodiments below, detailed configurations of an inkjet printing head and an inkjet printing apparatus ejecting ink will be described, but the present invention is not limited thereto. The liquid ejection head, the liquid ejection apparatus, and the liquid supply method of the present invention can be applied to a printer, a copying machine, a facsimile having a communication system, a word processor having a printer, and an industrial printing apparatus combined with various processing devices. For example, the liquid ejection head, the liquid ejection apparatus, and the liquid supply method can be used to manufacture a biochip, print an electronic circuit, or manufacture a semiconductor substrate. Further, since the application examples and the embodiments to be described below are detailed examples of the present invention, various technical limitations thereof can be made. However, the application examples and the embodiments are not limited to the application examples, the embodiments, or the other detailed methods of the specification and can be modified within the spirit of the present invention.

Hereinafter, appropriate application examples of the present invention will be described.

First Application Example (Description of Inkjet Printing Apparatus)

Figure 1:
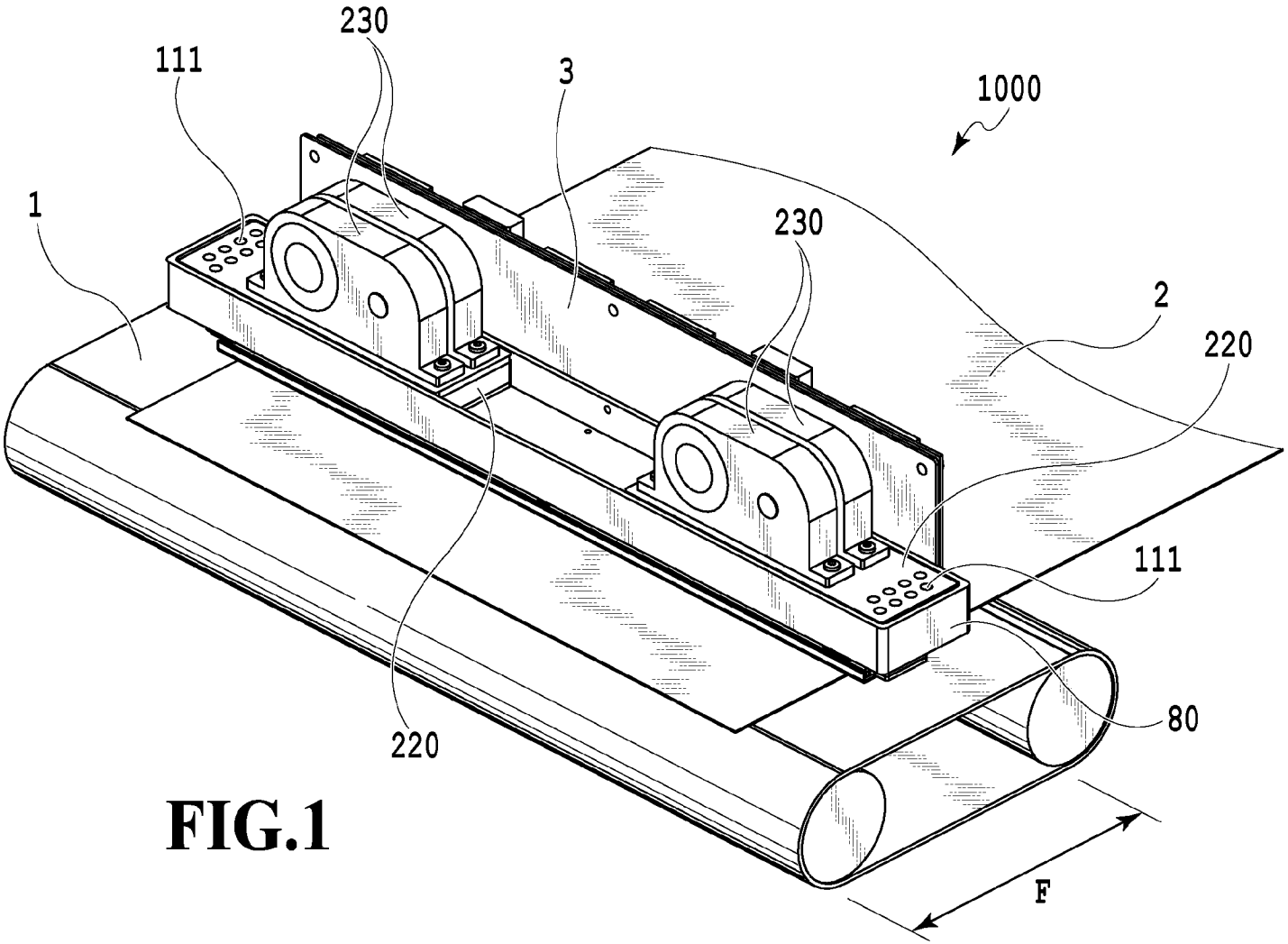
FIG. 1 is a diagram illustrating a schematic configuration of a liquid ejection apparatus that ejects a liquid.

FIG. 1 is a diagram illustrating a schematic configuration of a liquid ejection apparatus that ejects a liquid in the present invention and particularly an inkjet printing apparatus (hereinafter, also referred to as a printing apparatus) 1000 that prints an image by ejecting ink. The printing apparatus 1000 includes a conveying unit 1 which conveys a print medium 2 and a line type (page wide type) liquid ejection head 3 which is disposed to be substantially orthogonal to the conveying direction of the print medium 2. Then, the printing apparatus 1000 is a line type printing apparatus which continuously prints an image at one pass by ejecting ink onto the relative moving print mediums 2 while continuously or intermittently conveying the print mediums 2. The liquid ejection head 3 includes a negative pressure control unit 230 which controls a pressure (a negative pressure) inside a circulation path, a liquid supply unit 220 which communicates with the negative pressure control unit 230 so that a fluid can flow therebetween, a liquid connection portion 111 which serves as an ink supply opening and an ink discharge opening of the liquid supply unit 220, and a casing 80. The print medium 2 is not limited to a cut sheet and may be also a continuous roll medium. The liquid ejection head 3 can print a full color image by inks of cyan C, magenta M, yellow Y, and black K and is fluid-connected to a liquid supply member which serve as a supply path supplying a liquid to the liquid ejection head 3, a main tank, and a buffer tank (see FIG. 2 to be described later). Further, the control unit which supplies power and transmits an ejection control signal to the liquid ejection head 3 is electrically connected to the liquid ejection head 3. The liquid path and the electric signal path in the liquid ejection head 3 will be described later.

The printing apparatus 1000 is an inkjet printing apparatus that circulates a liquid such as ink between a tank to be described later and the liquid ejection head 3. The circulation configuration includes a first circulation configuration in which the liquid is circulated by the activation of two circulation pumps (for high and low pressures) at the downstream side of the liquid ejection head 3 and a second circulation configuration in which the liquid is circulated by the activation of two circulation pumps (for high and low pressures) at the upstream side of the liquid ejection head 3. Hereinafter, the first circulation configuration and the second circulation configuration of the circulation will be described.

(Description of First Circulation Configuration)

Figure 2:
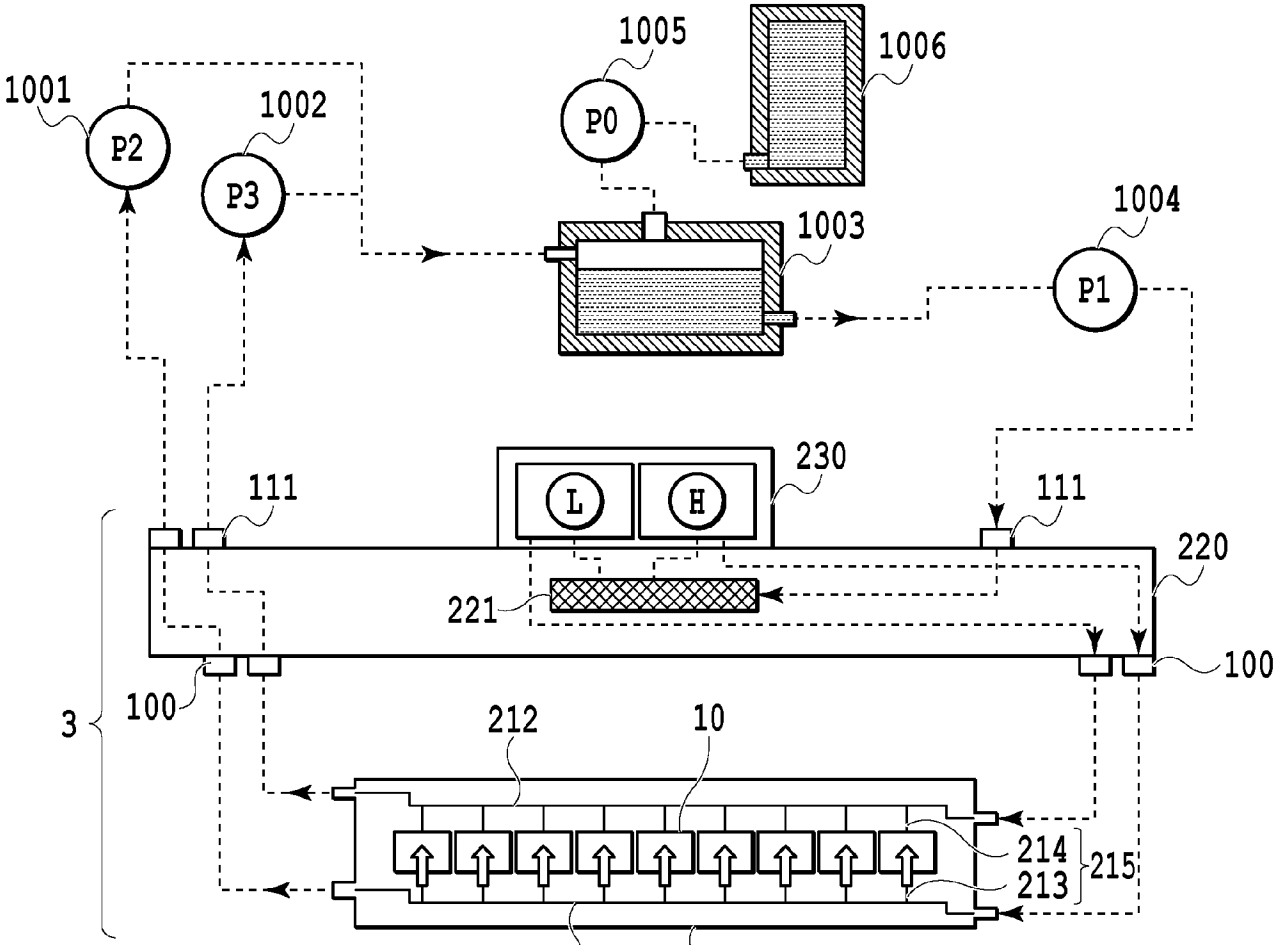
FIG. 2 is a schematic diagram illustrating a first circulation configuration in a circulation path applied to a printing apparatus.

FIG. 2 is a schematic diagram illustrating the first circulation configuration in the circulation path applied to the printing apparatus 1000 according to the embodiment. The liquid ejection head 3 is fluid-connected to a first circulation pump (the high pressure side) 1001, a first circulation pump (the low pressure side) 1002, and a buffer tank 1003. Further, in FIG. 2, in order to simplify a description, a path through which ink of one color of cyan C, magenta M, yellow Y, and black K flows is illustrated. However, in fact, four colors of circulation paths are provided in the liquid ejection head 3 and the printing apparatus body.

In the first circulation configuration, ink inside a main tank 1006 is supplied into the buffer tank 1003 by a replenishing pump 1005 and then is supplied to the liquid supply unit 220 of the liquid ejection head 3 through the liquid connection portion 111 by a second circulation pump 1004. Subsequently, the ink which is adjusted to two different negative pressures (high and low pressures) by the negative pressure control unit 230 connected to the liquid supply unit 220 is circulated while being divided into two passages having the high and low pressures. The ink inside the liquid ejection head 3 is circulated in the liquid ejection head by the action of the first circulation pump (the high pressure side) 1001 and the first circulation pump (the low pressure side) 1002 at the downstream side of the liquid ejection head 3, is discharged from the liquid ejection head 3 through the liquid connection portion 111, and is returned to the buffer tank 1003.

The buffer tank 1003 which is a sub-tank includes an atmosphere communication opening (not illustrated) which is connected to the main tank 1006 to communicate the inside of the tank with the outside and thus can discharge bubbles inside the ink to the outside. The replenishing pump 1005 is provided between the buffer tank 1003 and the main tank 1006. The replenishing pump 1005 delivers the ink from the main tank 1006 to the buffer tank 1003 after the ink is consumed by the ejection (the discharge) of the ink from the ejection opening of the liquid ejection head 3 in the printing operation and the suction recovery operation.

Two first circulation pumps 1001 and 1002 draw the liquid from the liquid connection portion 111 of the liquid ejection head 3 so that the liquid flows to the buffer tank 1003. As the first circulation pump, a displacement pump having quantitative liquid delivery ability is desirable. Specifically, a tube pump, a gear pump, a diaphragm pump, and a syringe pump can be exemplified. However, for example, a general constant flow valve or a general relief valve may be disposed at an outlet of a pump to ensure a predetermined flow rate. When the liquid ejection head 3 is driven, the first circulation pump (the high pressure side) 1001 and the first circulation pump (the low pressure side) 1002 are operated so that the ink flows at a predetermined flow rate through a common supply passage 211 and a common collection passage 212. Since the ink flows in this way, the temperature of the liquid ejection head 3 during a printing operation is kept at an optimal temperature. The predetermined flow rate when the liquid ejection head 3 is driven is desirably set to be equal to or higher than a flow rate at which a difference in temperature among the print element boards 10 inside the liquid ejection head 3 does not influence printing quality. Above all, in a case where a too high flow rate is set, a difference in negative pressure among the print element boards 10 increases due to the influence of pressure loss of the passage inside a liquid ejection unit 300 and thus unevenness in density is caused. For that reason, it is desirable to set the flow rate in consideration of a difference in temperature and a difference in negative pressure among the print element boards 10.

The negative pressure control unit 230 is provided in a path between the second circulation pump 1004 and the liquid ejection unit 300. The negative pressure control unit 230 is operated to keep a pressure at the downstream side (that is, a pressure near the liquid ejection unit 300) of the negative pressure control unit 230 at a predetermined pressure even in a case where the flow rate of the ink changes in the circulation system due to a difference in ejection amount per unit area. As two negative pressure control mechanisms constituting the negative pressure control unit 230, any mechanism may be used as long as a pressure at the downstream side of the negative pressure control unit 230 can be controlled within a predetermined range or less from a desired set pressure. As an example, a mechanism such as a so-called "pressure reduction regulator" can be employed. In the circulation passage of the application example, the upstream side of the negative pressure control unit 230 is pressurized by the second circulation pump 1004 through the liquid supply unit 220. With such a configuration, since an influence of a water head pressure of the buffer tank 1003 with respect to the liquid ejection head 3 can be suppressed, a degree of freedom in layout of the buffer tank 1003 of the printing apparatus 1000 can be widened.

As the second circulation pump 1004, a turbo pump or a displacement pump can be used as long as a predetermined head pressure or more can be exhibited in the range of the ink circulation flow rate used when the liquid ejection head 3 is driven. Specifically, a diaphragm pump can be used. Further, for example, a water head tank disposed to have a certain water head difference with respect to the negative pressure control unit 230 can be also used instead of the second circulation pump 1004. As illustrated in FIG. 2, the negative pressure control unit 230 includes two negative pressure adjustment mechanisms respectively having different control pressures. Among two negative pressure adjustment mechanisms, a relatively high pressure side (indicated by "H" in FIG. 2) and a relatively low pressure side (indicated by "L" in FIG. 2) are respectively connected to the common supply passage 211 and the common collection passage 212 inside the liquid ejection unit 300 through the liquid supply unit 220. The liquid ejection unit 300 is provided with the common supply passage 211, the common collection passage 212, and an individual passage 215 (an individual supply passage 213 and an individual collection passage 214) communicating with the print element board. The negative pressure control mechanism H is connected to the common supply passage 211, the negative pressure control mechanism L is connected to the common collection passage 212, and a differential pressure is formed between two common passages. Then, since the individual passage 215 communicates with the common supply passage 211 and the common collection passage 212, a flow (a flow indicated by an arrow direction of FIG. 2) is generated in which a part of the liquid flows from the common supply passage 211 to the common collection passage 212 through the passage formed inside the print element board 10.

In this way, the liquid ejection unit 300 has a flow in which a part of the liquid passes through the print element boards 10 while the liquid flows to pass through the common supply passage 211 and the common collection passage 212. For this reason, heat generated by the print element boards 10 can be discharged to the outside of the print element board 10 by the ink flowing through the common supply passage 211 and the common collection passage 212. With such a configuration, the flow of the ink can be generated even in the pressure chamber or the ejection opening not ejecting the liquid when an image is printed by the liquid ejection head 3. Accordingly, the thickening of the ink can be suppressed in such a manner that the viscosity of the ink thickened inside the ejection opening is decreased. Further, the thickened ink or the foreign material in the ink can be discharged toward the common collection passage 212. For this reason, the liquid ejection head 3 of the application example can print a high-quality image at a high speed.

(Description of Second Circulation Configuration)

Figure 3:
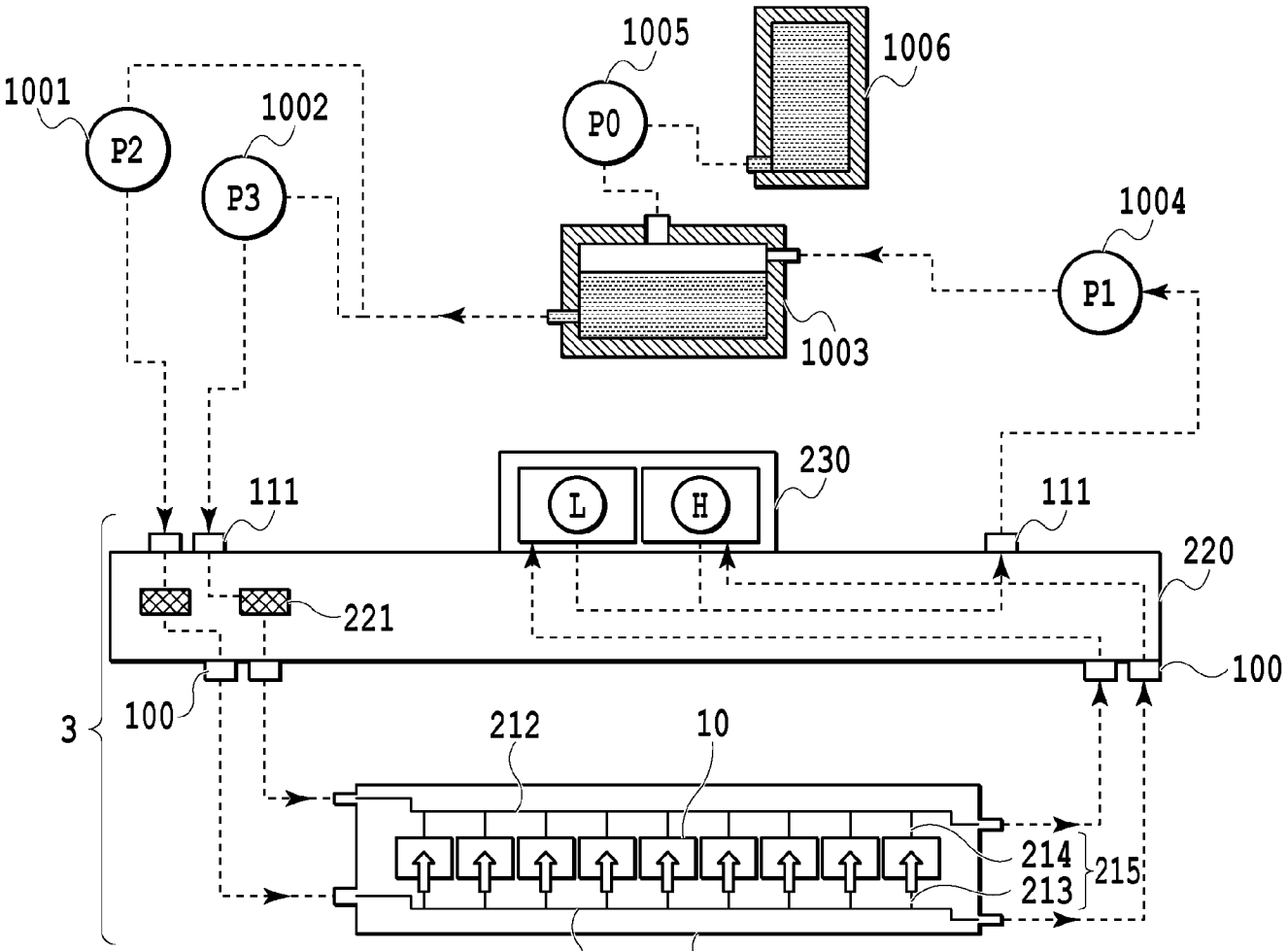
FIG. 3 is a schematic diagram illustrating a second circulation configuration in the circulation path applied to the printing apparatus.

FIG. 3 is a schematic diagram illustrating the second circulation configuration which is a circulation configuration different from the first circulation configuration in the circulation path applied to the printing apparatus of the application example. A main difference from the first circulation configuration is that two negative pressure control mechanisms constituting the negative pressure control unit 230 both control a pressure at the upstream side of the negative pressure control unit 230 within a predetermined range from a desired set pressure. Further, another difference from the first circulation configuration is that the second circulation pump 1004 serves as a negative pressure source which reduces a pressure at the downstream side of the negative pressure control unit 230. Further, still another difference is that the first circulation pump (the high pressure side) 1001 and the first circulation pump (the low pressure side) 1002 are disposed at the upstream side of the liquid ejection head 3 and the negative pressure control unit 230 is disposed at the downstream side of the liquid ejection head 3.

In the second circulation configuration, the ink inside the main tank 1006 is supplied to the buffer tank 1003 by the replenishing pump 1005. Subsequently, the ink is divided into two passages and is circulated in two passages at the high pressure side and the low pressure side by the action of the negative pressure control unit 230 provided in the liquid ejection head 3. The ink which is divided into two passages at the high pressure side and the low pressure side is supplied to the liquid ejection head 3 through the liquid connection portion 111 by the action of the first circulation pump (the high pressure side) 1001 and the first circulation pump (the low pressure side) 1002. Subsequently, the ink circulated inside the liquid ejection head by the action of the first circulation pump (the high pressure side) 1001 and the first circulation pump (the low pressure side) 1002 is discharged from the liquid ejection head 3 through the liquid connection portion 111 by the negative pressure control unit 230. The discharged ink is returned to the buffer tank 1003 by the second circulation pump 1004.

In the second circulation configuration, the negative pressure control unit 230 stabilizes a change in pressure at the upstream side (that is, the liquid ejection unit 300) of the negative pressure control unit 230 within a predetermined range from a predetermined pressure even in a case where a change in flow rate is caused by a change in ejection amount per unit area. In the circulation passage of the application example, the downstream side of the negative pressure control unit 230 is pressurized by the second circulation pump 1004 through the liquid supply unit 220. With such a configuration, since an influence of a water head pressure of the buffer tank 1003 with respect to the liquid ejection head 3 can be suppressed, the layout of the buffer tank 1003 in the printing apparatus 1000 can have many options. Instead of the second circulation pump 1004, for example, a water head tank disposed to have a predetermined water head difference with respect to the negative pressure control unit 230 can be also used. Similarly to the first circulation configuration, in the second circulation configuration, the negative pressure control unit 230 includes two negative pressure control mechanisms respectively having different control pressures. Among two negative pressure adjustment mechanisms, a high pressure side (indicated by "H" in FIG. 3) and a low pressure side (indicated by "L" in FIG. 3) are respectively connected to the common supply passage 211 or the common collection passage 212 inside the liquid ejection unit 300 through the liquid supply unit 220. In a case where the pressure of the common supply passage 211 is set to be higher than the pressure of the common collection passage 212 by two negative pressure adjustment mechanisms, a flow of the liquid is generated from the common supply passage 211 to the common collection passage 212 through the individual passage 215 and the passages formed inside the print element boards 10.

In such a second circulation configuration, the same liquid flow as that of the first circulation configuration can be obtained inside the liquid ejection unit 300, but has two advantages different from those of the first circulation configuration. As a first advantage, in the second circulation configuration, since the negative pressure control unit 230 is disposed at the downstream side of the liquid ejection head 3, there is low concern that a foreign material or a trash produced from the negative pressure control unit 230 flows into the liquid ejection head 3. As a second advantage, in the second circulation configuration, a maximal value of the flow rate necessary for the liquid from the buffer tank 1003 to the liquid ejection head 3 is smaller than that of the first circulation configuration. The reason is as below.

In the case of the circulation in the print standby state, the sum of the flow rates of the common supply passage 211 and the common collection passage 212 is set to a flow rate A. The value of the flow rate A is defined as a minimal flow rate necessary to adjust the temperature of the liquid ejection head 3 in the print standby state so that a difference in temperature inside the liquid ejection unit 300 falls within a desired range. Further, the ejection flow rate obtained in a case where the ink is ejected from all ejection openings of the liquid ejection unit 300 (the full ejection state) is defined as a flow rate F (the ejection amount per each ejection opening×the ejection frequency per unit time×the number of the ejection openings).

Figure 4:
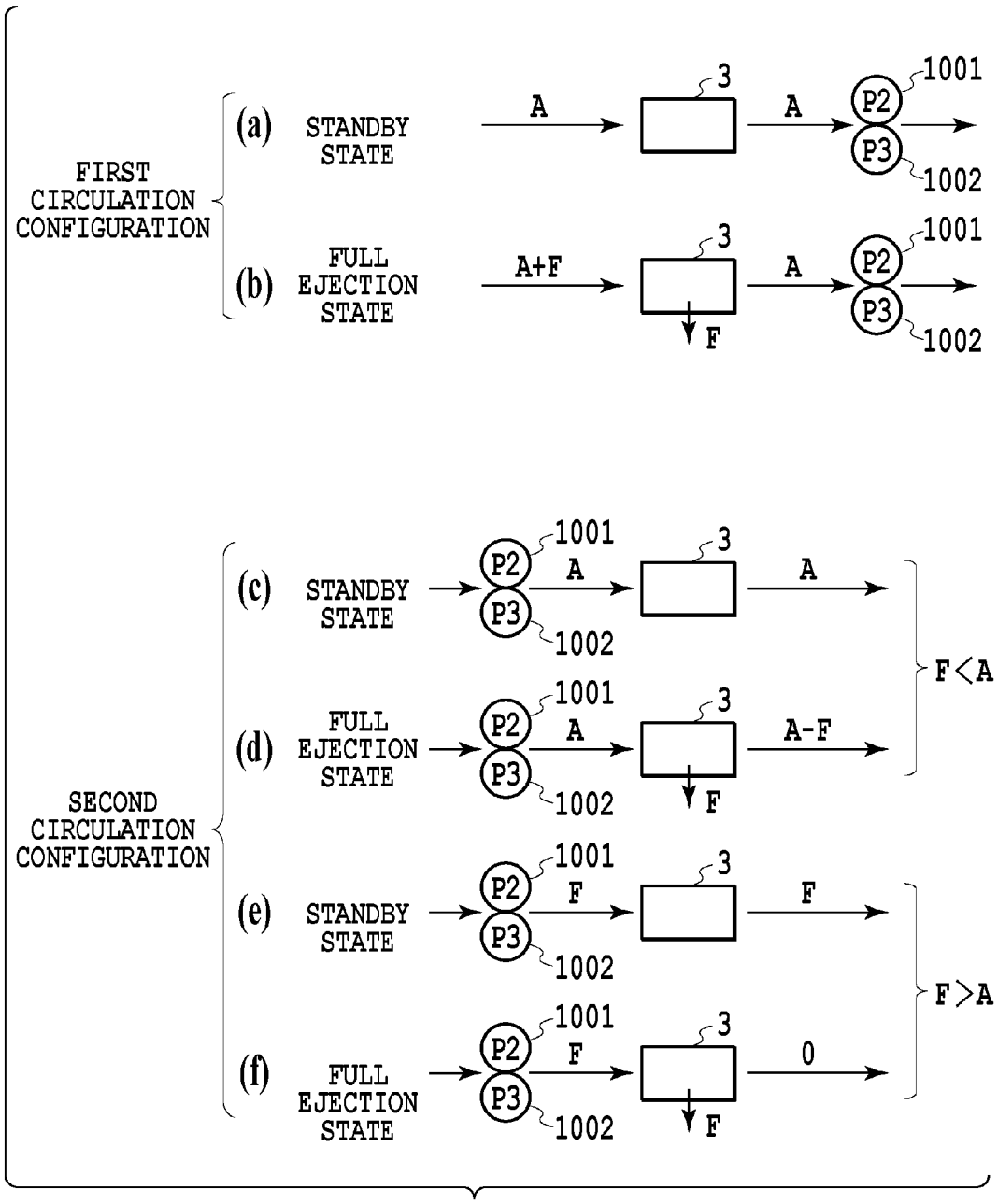
FIG. 4 is a schematic diagram illustrating a difference in ink inflow amount to a liquid ejection head.

FIG. 4 is a schematic diagram illustrating a difference in ink inflow amount to the liquid ejection head between the first circulation configuration and the second circulation configuration. Reference character (a) of FIG. 4 illustrates the standby state in the first circulation configuration and reference character (b) of FIG. 4 illustrates the full ejection state in the first circulation configuration. Reference characters (c) to (f) of FIG. 4 illustrate the second circulation passage. Here, reference characters (c) and (d) of FIG. 4 illustrate a case where the flow rate F is lower than the flow rate A and reference characters (e) and (f) of FIG. 4 illustrate a case where the flow rate F is higher than the flow rate A. In this way, the flow rates in the standby state and the full ejection state are illustrated.

In the case of the first circulation configuration (Reference characters (a) and (b) of FIG. 4) in which the first circulation pump 1001 and the first circulation pump 1002 each having a quantitative liquid delivery ability are disposed at the downstream side of the liquid ejection head 3, the total flow rate of the first circulation pump 1001 and the first circulation pump 1002 becomes the flow rate A. By the flow rate A, the temperature inside the liquid ejection unit 300 in the standby state can be managed. Then, in the case of the full ejection state of the liquid ejection head 3, the total flow rate of the first circulation pump 1001 and the first circulation pump 1002 becomes the flow rate A. However, a maximal flow rate of the liquid supplied to the liquid ejection head 3 is obtained such that the flow rate F consumed by the full ejection is added to the flow rate A of the total flow rate by the action of the negative pressure generated by the ejection of the liquid ejection head 3. Thus, a maximal value of the supply amount to the liquid ejection head 3 satisfies a relation of the flow rate A+the flow rate F since the flow rate F is added to the flow rate A (Reference character (b) of FIG. 4).

Meanwhile, in the case of the second circulation configuration (Reference characters (c) to (f) of FIG. 4) in which the first circulation pump 1001 and the first circulation pump 1002 are disposed at the upstream side of the liquid ejection head 3, the supply amount to the liquid ejection head 3 necessary for the print standby state becomes the flow rate A similarly to the first circulation configuration. Thus, in a case where the flow rate A is higher than the flow rate F (Reference characters (c) and (d) of FIG. 4) in the second circulation configuration in which the first circulation pump 1001 and the first circulation pump 1002 are disposed at the upstream side of the liquid ejection head 3, the supply amount to the liquid ejection head 3 sufficiently becomes the flow rate A even in the full ejection state. At that time, the discharge flow rate of the liquid ejection head 3 satisfies a relation of the flow rate A−the flow rate F (Reference character (d) of FIG. 4). However, in a case where the flow rate F is higher than the flow rate A (Reference characters (e) and (f) of FIG. 4), the flow rate becomes insufficient in a case where the flow rate of the liquid supplied to the liquid ejection head 3 becomes the flow rate A in the full ejection state. For that reason, in a case where the flow rate F is higher than the flow rate A, the supply amount to the liquid ejection head 3 needs to be set to the flow rate F. At that time, since the flow rate F is consumed by the liquid ejection head 3 in the full ejection state, the flow rate of the liquid discharged from the liquid ejection head 3 becomes almost zero (Reference character (f) of FIG. 4). In addition, if the liquid is not ejected in the full ejection state in a case where the flow rate F is higher than the flow rate A, the liquid which is attracted by the amount consumed by the ejection of the flow rate F is discharged from the liquid ejection head 3. Further, in a case where the flow rate A and the flow rate F are equal to each other, the flow rate A (or the flow rate F) is supplied to the liquid ejection head 3 and the flow rate F is consumed by the liquid ejection head 3. For this reason, the flow rate discharged from the liquid ejection head 3 becomes almost zero.

In this way, in the case of the second circulation configuration, the total value of the flow rates set for the first circulation pump 1001 and the first circulation pump 1002, that is, the maximal value of the necessary supply flow rate becomes a large value among the flow rate A and the flow rate F. For this reason, as long as the liquid ejection unit 300 having the same configuration is used, the maximal value (the flow rate A or the flow rate F) of the supply amount necessary for the second circulation configuration becomes smaller than the maximal value (the flow rate A+the flow rate F) of the supply flow rate necessary for the first circulation configuration.

For that reason, in the case of the second circulation configuration, the degree of freedom of the applicable circulation pump increases. For example, a circulation pump having a simple configuration and low cost can be used or a load of a cooler (not illustrated) provided in a main body side path can be reduced. Accordingly, there is an advantage that the cost of the printing apparatus can be decreased. This advantage is high in the line head having a relatively large value of the flow rate A or the flow rate F. Accordingly, a line head having a long longitudinal length among the line heads is beneficial.

Meanwhile, the first circulation configuration is more advantageous than the second circulation configuration. That is, in the second circulation configuration, since the flow rate of the liquid flowing through the liquid ejection unit 300 in the print standby state becomes maximal, a higher negative pressure is applied to the ejection openings as the ejection amount per unit area of the image (hereinafter, also referred to as a low-duty image) becomes smaller. For this reason, in a case where the passage width is narrow and the negative pressure is high, a high negative pressure is applied to the ejection opening in the low-duty image in which unevenness easily appears. Accordingly, there is concern that printing quality may be deteriorated in accordance with an increase in the number of so-called satellite droplets ejected along with main droplets of the ink.

Meanwhile, in the case of the first circulation configuration, since a high negative pressure is applied to the ejection opening when the image (hereinafter, also referred to as a high-duty image) having a large ejection amount per unit area is formed, there is an advantage that visibility of the satellite droplets is poor and an influence of the satellite droplets on the image is small even in a case where the satellite droplets are generated. Two circulation configurations can be desirably selected in consideration of the specifications (the ejection flow rate F, the minimal circulation flow rate A, and the passage resistance inside the head) of the liquid ejection head and the printing apparatus body.

(Description of Configuration of Liquid Ejection Head)

Figure 5A:
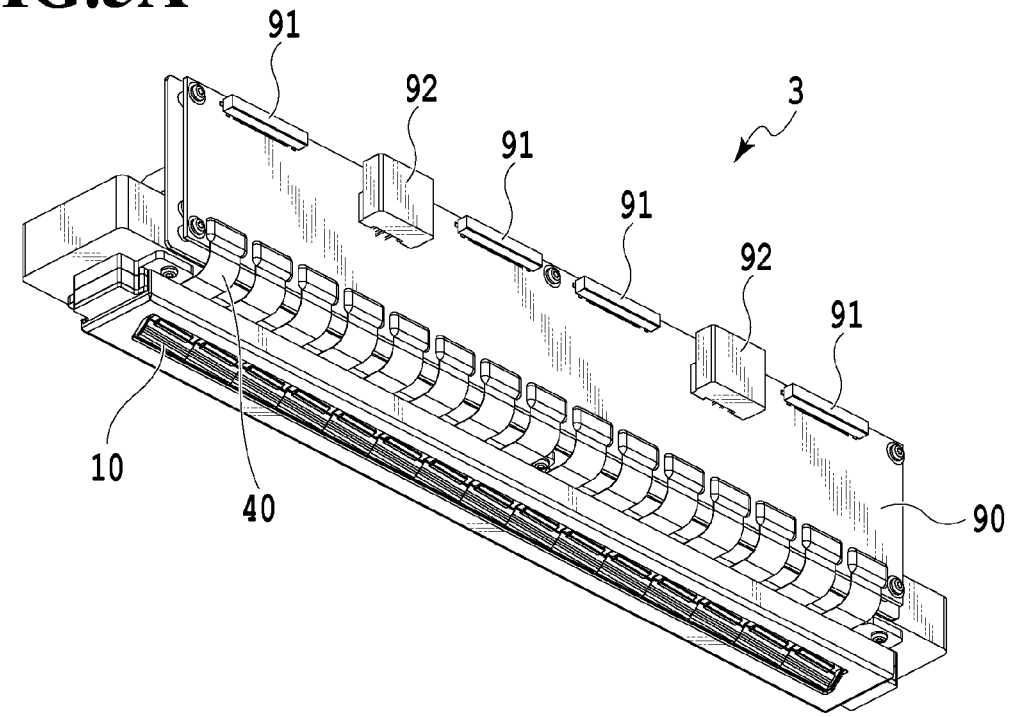
FIG. 5A is a perspective view illustrating the liquid ejection head.
Figure 5B:
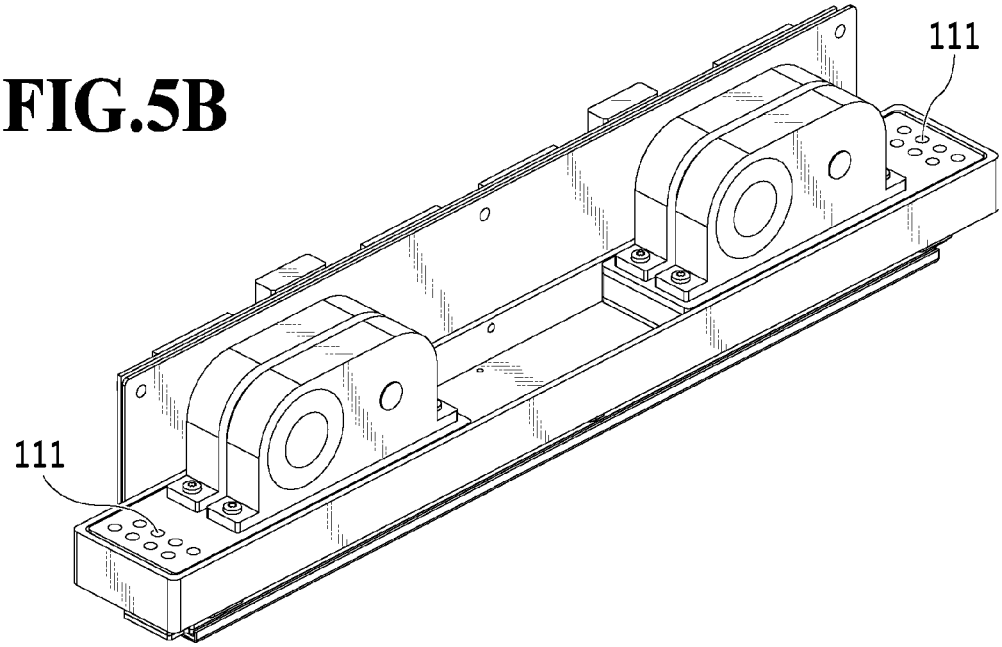
FIG. 5B is a perspective view illustrating the liquid ejection head.

A configuration of the liquid ejection head 3 according to the first application example will be described. FIGS. 5A and 5B are perspective views illustrating the liquid ejection head 3 according to the application example. The liquid ejection head 3 is a line type liquid ejection head in which fifteen print element boards 10 capable of ejecting inks of four colors of cyan C, magenta M, yellow Y, and black K are arranged in series on one print element board 10 (an in-line arrangement). As illustrated in FIG. 5A, the liquid ejection head 3 includes the print element boards 10 and a signal input terminal 91 and a power supply terminal 92 which are electrically connected to each other through a flexible circuit board 40 and an electric wiring board 90 capable of supplying electric energy to the print element board 10. The signal input terminal 91 and the power supply terminal 92 are electrically connected to the control unit of the printing apparatus 1000 so that an ejection drive signal and power necessary for the ejection are supplied to the print element board 10. In a case where the wirings are integrated by the electric circuit inside the electric wiring board 90, the number of the signal input terminals and the power supply terminals 92 can be decreased compared with the number of the print element boards 10. Accordingly, the number of electrical connection components to be separated when the liquid ejection head 3 is assembled to the printing apparatus 1000 or the liquid ejection head is replaced decreases. As illustrated in FIG. 5B, the liquid connection portions 111 which are provided at both ends of the liquid ejection head 3 are connected to the liquid supply system of the printing apparatus 1000. Accordingly, the inks of four colors including cyan C, magenta M, yellow Y, and black K4 are supplied from the supply system of the printing apparatus 1000 to the liquid ejection head 3 and the inks passing through the liquid ejection head 3 are collected by the supply system of the printing apparatus 1000. In this way, the inks of different colors can be circulated through the path of the printing apparatus 1000 and the path of the liquid ejection head 3.

Figure 6:
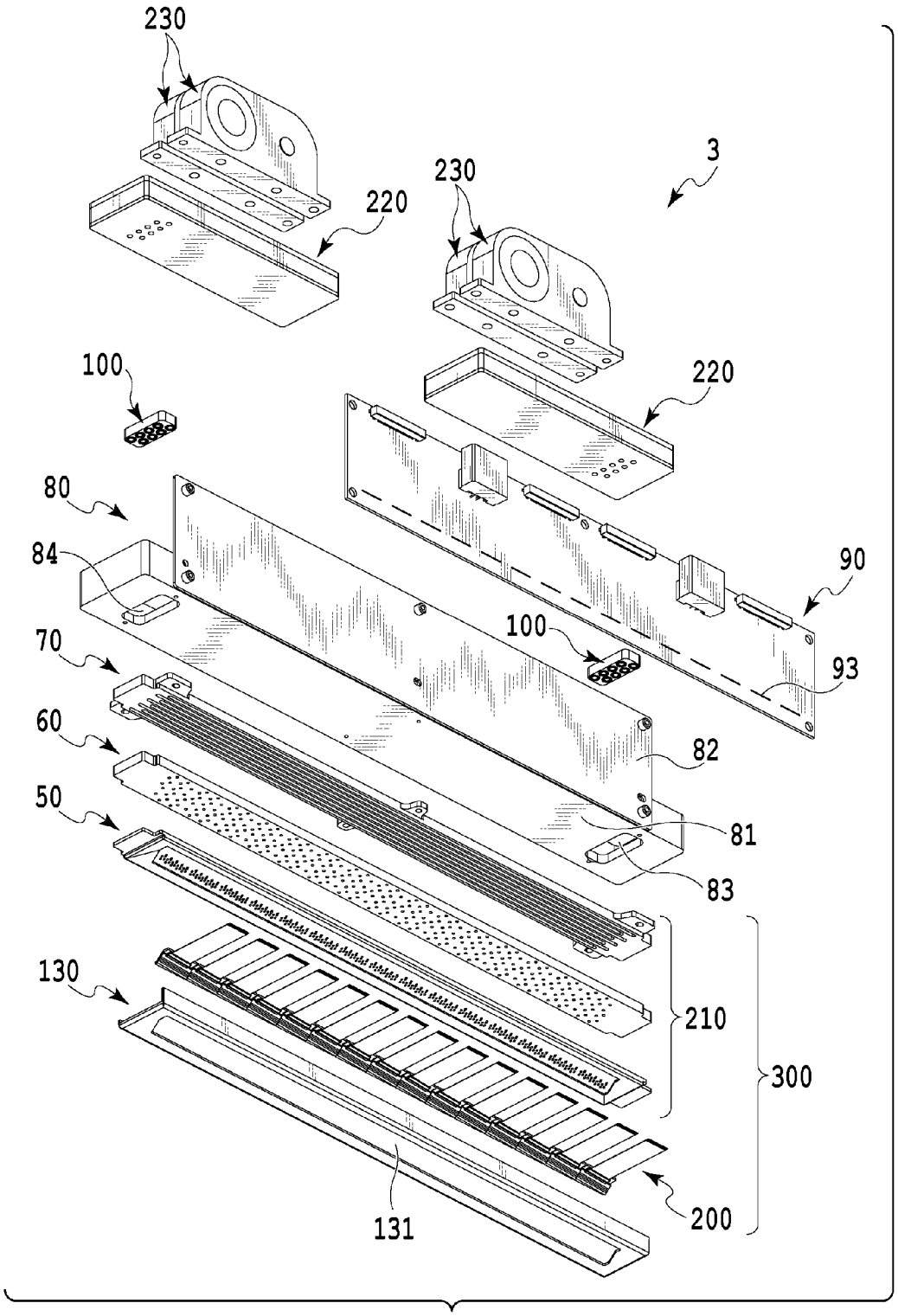
FIG. 6 is an exploded perspective view illustrating components or units constituting the liquid ejection head.

FIG. 6 is an exploded perspective view illustrating components or units constituting the liquid ejection head 3. The liquid ejection unit 300, the liquid supply unit 220, and the electric wiring board 90 are attached to the casing 80. The liquid connection portions 111 (see FIG. 3) are provided in the liquid supply unit 220. Also, in order to remove a foreign material in the supplied ink, filters 221 (see FIGS. 2 and 3) for different colors are provided inside the liquid supply unit 220 while communicating with the openings of the liquid connection portions 111. Two liquid supply units 220 respectively corresponding to two colors are provided with the filters 221. The liquid passing through the filter 221 is supplied to the negative pressure control unit 230 disposed on the liquid supply unit 220 disposed to correspond to each color. The negative pressure control unit 230 is a unit which includes different colors of negative pressure control valves. By the function of a spring member or a valve provided therein, a change in pressure loss inside the supply system (the supply system at the upstream side of the liquid ejection head 3) of the printing apparatus 1000 caused by a change in flow rate of the liquid is largely decreased. Accordingly, the negative pressure control unit 230 can stabilize a change negative pressure at the downstream side (the liquid ejection unit 300) of the negative pressure control unit within a predetermined range. As described in FIG. 2, two negative pressure control valves of different colors are built inside the negative pressure control unit 230. Two negative pressure control valves are respectively set to different control pressures. Here, the high pressure side communicates with the common supply passage 211 (see FIG. 2) inside the liquid ejection unit 300 and the low pressure side communicates with the common collection passage 212 (see FIG. 2) through the liquid supply unit 220.

The casing 80 includes a liquid ejection unit support portion 81 and an electric wiring board support portion 82 and ensures the rigidity of the liquid ejection head 3 while supporting the liquid ejection unit 300 and the electric wiring board 90. The electric wiring board support portion 82 is used to support the electric wiring board 90 and is fixed to the liquid ejection unit support portion 81 by a screw. The liquid ejection unit support portion 81 is used to correct the warpage or deformation of the liquid ejection unit 300 to ensure the relative position accuracy among the print element boards 10. Accordingly, stripe and unevenness of a printed medium is suppressed. For that reason, it is desirable that the liquid ejection unit support portion 81 have sufficient rigidity. As a material, metal such as SUS or aluminum or ceramic such as alumina is desirable. The liquid ejection unit support portion 81 is provided with openings 83 and 84 into which a joint rubber 100 is inserted. The liquid supplied from the liquid supply unit 220 is led to a third passage member 70 constituting the liquid ejection unit 300 through the joint rubber.

The liquid ejection unit 300 includes a plurality of ejection modules 200 and a passage member 210 and a cover member 130 is attached to a face near the print medium in the liquid ejection unit 300. Here, the cover member 130 is a member having a picture frame shaped surface and provided with an elongated opening 131 as illustrated in FIG. 6 and the print element board 10 and a sealing member 110 (see FIG. 10A to be described later) included in the ejection module 200 are exposed from the opening 131. A peripheral frame of the opening 131 serves as a contact face of a cap member that caps the liquid ejection head 3 in the print standby state. For this reason, it is desirable to form a closed space in a capping state by applying an adhesive, a sealing material, and a filling material along the periphery of the opening 131 to fill unevenness or a gap on the ejection opening face of the liquid ejection unit 300.

Next, a configuration of the passage member 210 included in the liquid ejection unit 300 will be described. As illustrated in FIG. 6, the passage member 210 is obtained by laminating a first passage member 50, a second passage member 60, and a third passage member 70 and distributes the liquid supplied from the liquid supply unit 220 to the ejection modules 200. Further, the passage member 210 is a passage member that returns the liquid re-circulated from the ejection module 200 to the liquid supply unit 220. The passage member 210 is fixed to the liquid ejection unit support portion 81 by a screw and thus the warpage or deformation of the passage member 210 is suppressed.

Figure 7:
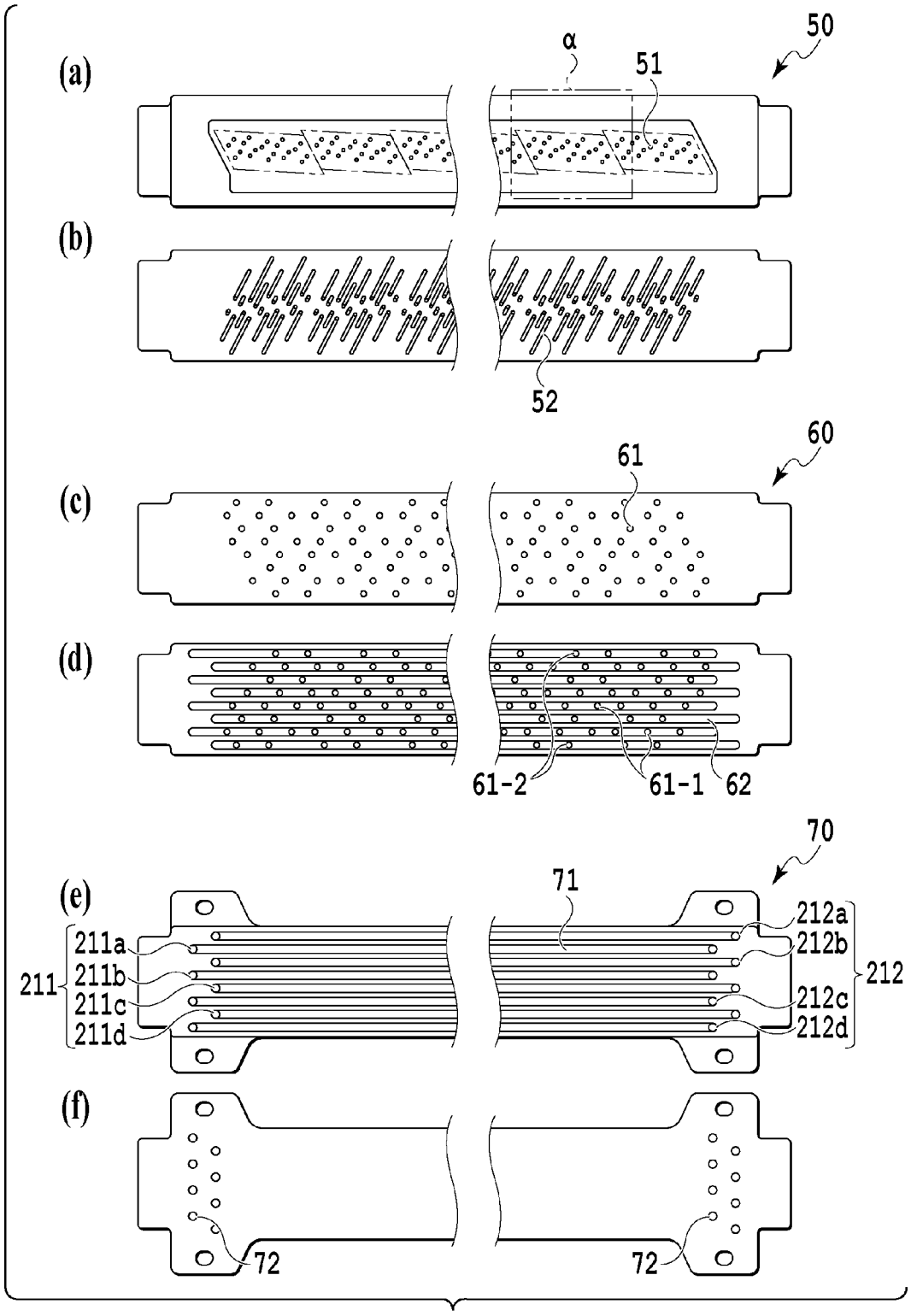
FIG. 7 is a diagram illustrating front and rear faces of first to third passage members.

FIG. 7 is a diagram illustrating front and rear faces of the first to third passage members. Reference character (a) of FIG. 7 illustrates a face onto which the ejection module 200 is mounted in the first passage member 50 and reference character (f) of FIG. 7 illustrates a face with which the liquid ejection unit support portion 81 comes into contact in the third passage member 70. The first passage member 50 and the second passage member 60 are bonded to each other so that the parts illustrated by reference characters (b) and (c) in FIG. 7 and corresponding to the contact faces of the passage members face each other and the second passage member and the third passage member are bonded to each other so that the parts illustrated by reference characters (d) and (e) of FIG. 7 and corresponding to the contact faces of the passage members face each other. In a case where the second passage member 60 and the third passage member 70 are bonded to each other, eight common passages (211*a*, 211*b*, 211*c*, 211*d*, 212*a*, 212*b*, 212*c*, 212*d*) extending in the longitudinal direction of the passage member are formed by common passage grooves 62 and 71 of the passage members. Accordingly, a set of the common supply passage 211 and the common collection passage 212 is formed inside the passage member 210 to correspond to each color. The ink is supplied from the common supply passage 211 to the liquid ejection head 3 and the ink supplied to the liquid ejection head 3 is collected by the common collection passage 212. A communication opening 72 (see reference character (f) of FIG. 7) of the third passage member 70 communicates with the holes of the joint rubber 100 and is fluid-connected to the liquid supply unit 220 (see FIG. 6). A bottom face of the common passage groove of the second passage member 60 is provided with a plurality of communication openings 61 (a communication opening 61-1 communicating with the common supply passage 211 and a communication opening 61-2 communicating with the common collection passage 212) and communicates with one end of an individual passage groove 52 of the first passage member 50. The other end of the individual passage groove of the first passage member 50 is provided with a communication opening 51 and is fluid-connected to the ejection modules 200 through the communication opening 51. By the individual passage groove 52, the passages can be densely provided at the center side of the passage member.

It is desirable that the first to third passage members be formed of a material having corrosion resistance with respect to a liquid and having a low linear expansion coefficient. As a material, for example, a composite material (resin) obtained by adding inorganic filler such as fiber or fine silica particles to a base material such as alumina, LCP (liquid crystal polymer), PPS (polyphenyl sulfide), or PSF (polysulfone) can be appropriately used. As a method of forming the passage member 210, three passage members may be laminated and adhered to one another. In a case where a resin composite material is selected as a material, a bonding method using welding may be used.

Figure 8:
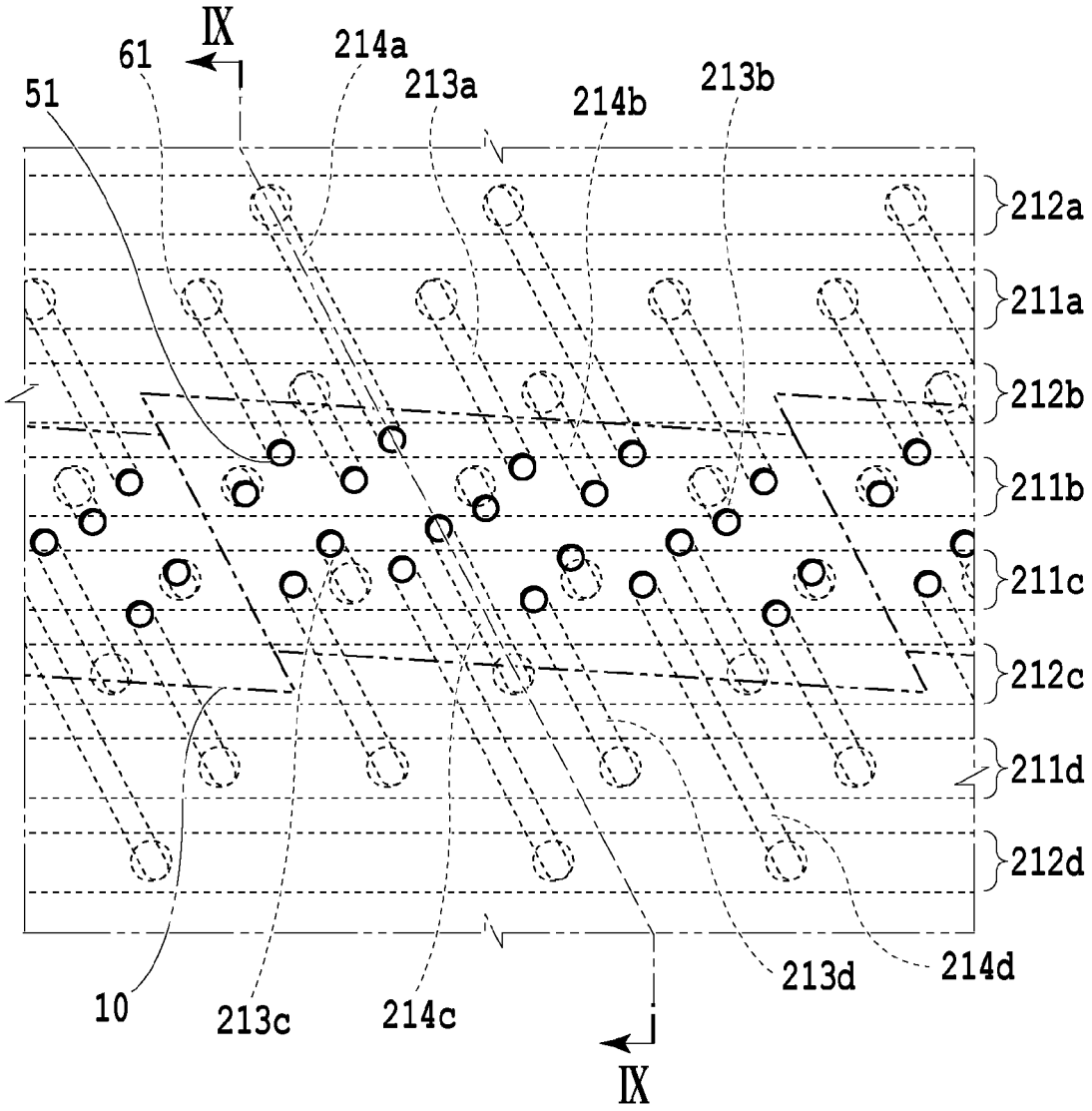
FIG. 8 is a perspective view illustrating a part a of FIG. 7 when viewed from an ejection module mounting face.

FIG. 8 is a partially enlarged perspective view illustrating a part a of FIG. 7 and illustrating the passages inside the passage member 210 formed by bonding the first to third passage members to one another when viewed from a face onto which the ejection module 200 is mounted in the first passage member 50. The common supply passage 211 and the common collection passage 212 are formed such that the common supply passage 211 and the common collection passage 212 are alternately disposed from the passages of both ends. Here, a connection relation among the passages inside the passage member 210 will be described.

The passage member 210 is provided with the common supply passage 211 (211*a*, 211*b*, 211*c*, 211*d*) and the common collection passage 212 (212*a*, 212*b*, 212*c*, 212*d*) extending in the longitudinal direction of the liquid ejection head 3 and provided for each color. The individual supply passages 213 (213*a*, 213*b*, 213*c*, 213*d*) which are formed by the individual passage grooves 52 are connected to the common supply passages 211 of different colors through the communication openings 61. Further, the individual collection passages 214 (214*a*, 214*b*, 214*c*, 214*d*) formed by the individual passage grooves 52 are connected to the common collection passages 212 of different colors through the communication openings 61. With such a passage configuration, the ink can be intensively supplied to the print element board 10 located at the center portion of the passage member from the common supply passages 211 through the individual supply passages 213. Further, the ink can be collected from the print element board 10 to the common collection passages 212 through the individual collection passages 214.

Figure 9:
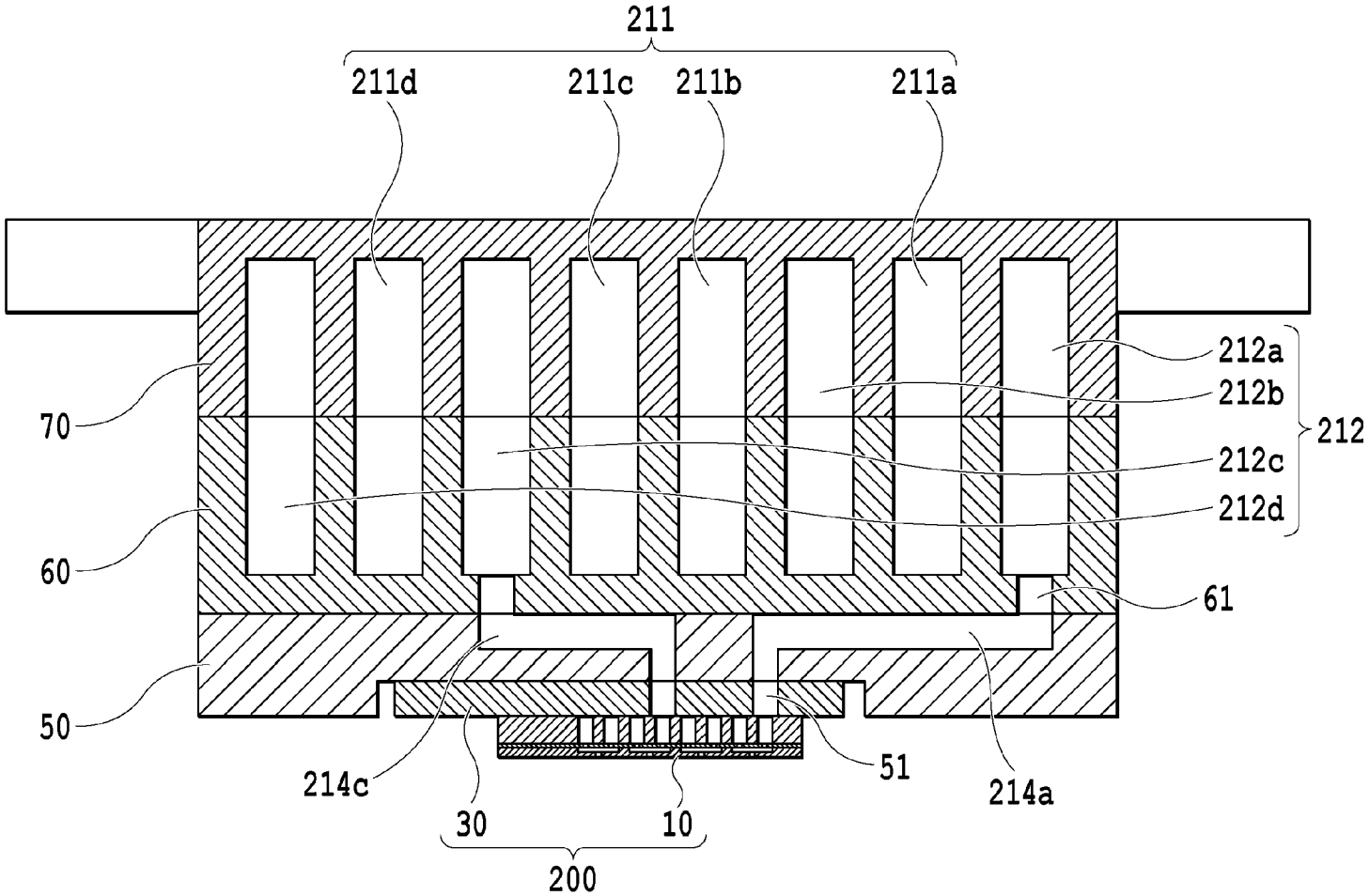
FIG. 9 is a cross-sectional view taken along a line IX-IX of FIG. 8.

FIG. 9 is a cross-sectional view taken along a line IX-IX of FIG. 8. The individual collection passage (214*a*, 214*c*)

communicates with the ejection module 200 through the communication opening 51. In FIG. 9, only the individual collection passage (214*a*, 214*c*) is illustrated, but in a different cross-section, the individual supply passage 213 and the ejection module 200 communicates with each other as illustrated in FIG. 8. A support member 30 and the print element board 10 which are included in each ejection module 200 are provided with passages which supply the ink from the first passage member 50 to a print element 15 provided in the print element board 10. Further, the support member 30 and the print element board 10 are provided with passages which collect (re-circulate) a part or the entirety of the liquid supplied to the print element 15 to the first passage member 50.

Here, the common supply passage 211 of each color is connected to the negative pressure control unit 230 (the high pressure side) of corresponding color through the liquid supply unit 220 and the common collection passage 212 is connected to the negative pressure control unit 230 (the low pressure side) through the liquid supply unit 220. By the negative pressure control unit 230, a differential pressure (a difference in pressure) is generated between the common supply passage 211 and the common collection passage 212. For this reason, as illustrated in FIGS. 8 and 9, a flow is generated in order of the common supply passage 211 of each color, the individual supply passage 213, the print element board 10, the individual collection passage 214, and the common collection passage 212 inside the liquid ejection head of the application example having the passages connected to one another.

(Description of Ejection Module)

Figure 10A:
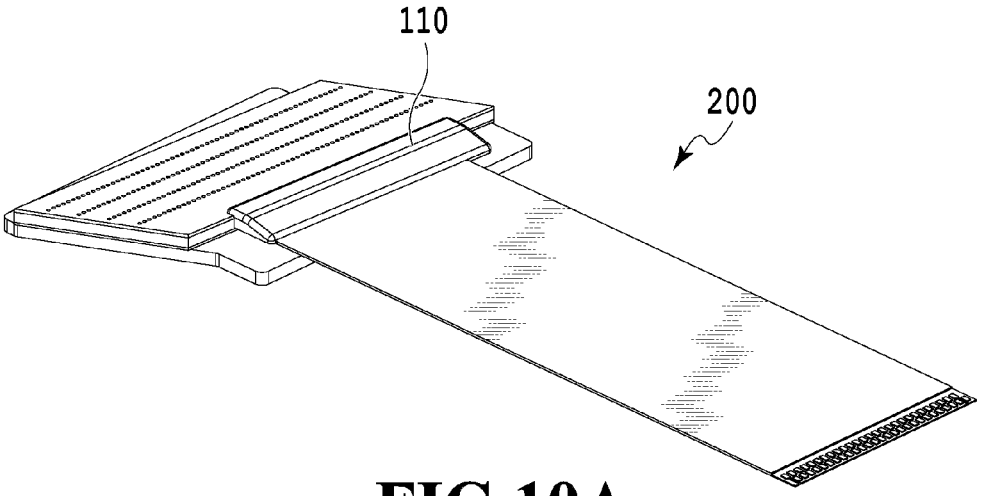
FIG. 10A is a perspective view illustrating one ejection module.
Figure 10B:
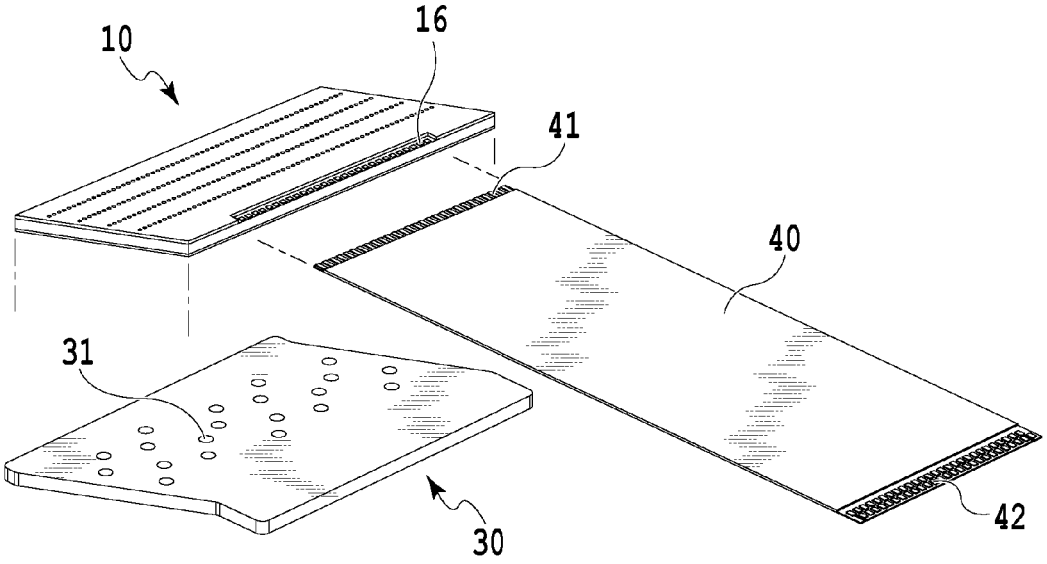
FIG. 10B is an exploded view illustrating one ejection module.

FIG. 10A is a perspective view illustrating one ejection module 200 and FIG. 10B is an exploded view thereof. As a method of manufacturing the ejection module 200, first, the print element board 10 and the flexible circuit board 40 are adhered onto the support member 30 provided with a liquid communication opening 31. Subsequently, a terminal 16 on the print element board 10 and a terminal 41 on the flexible circuit board 40 are electrically connected to each other by wire bonding and the wire bonded portion (the electrical connection portion) is sealed by the sealing member 110. A terminal 42 which is opposite to the print element board 10 of the flexible circuit board 40 is electrically connected to a connection terminal 93 (see FIG. 6) of the electric wiring board 90. Since the support member 30 serves as a support body that supports the print element board 10 and a passage member that fluid-communicates the print element board 10 and the passage member 210 to each other, it is desirable that the support member have high flatness and sufficiently high reliability while being bonded to the print element board. As a material, for example, alumina or resin is desirable.

(Description of Structure of Print Element Board)

Figure 11A:
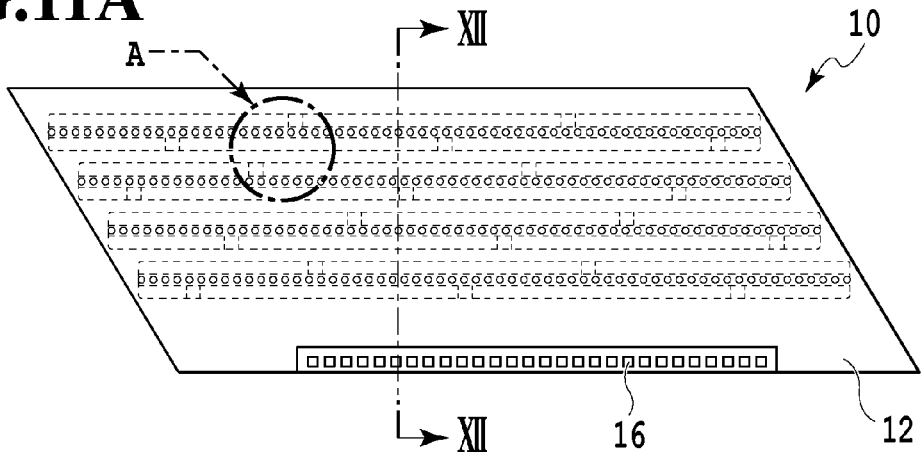
FIG. 11A is a diagram illustrating a print element board.
Figure 11B:
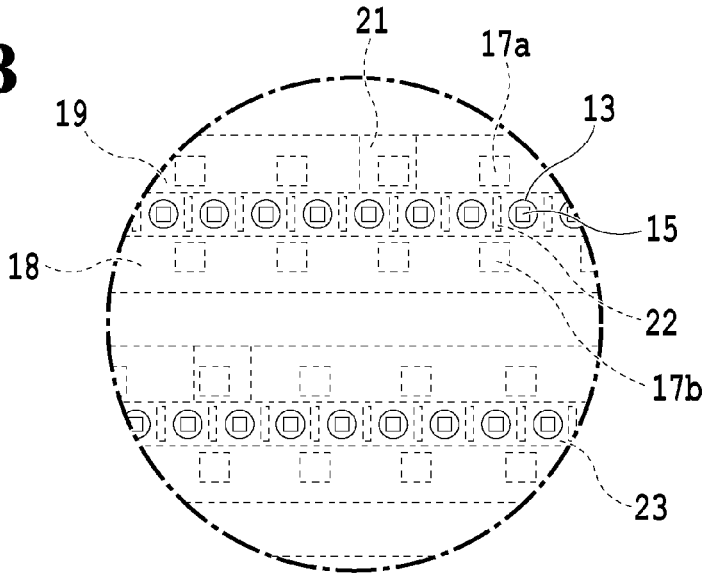
FIG. 11B is a diagram illustrating the print element board.
Figure 11C:
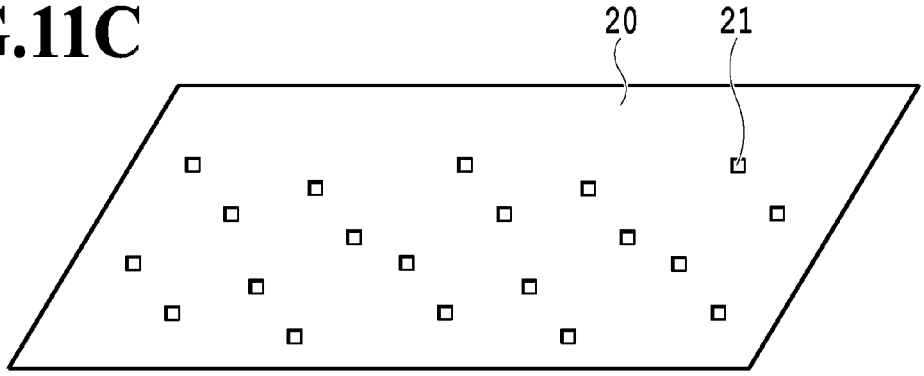
FIG. 11C is a diagram illustrating the print element board.

FIG. 11A is a top view illustrating a face provided with an ejection opening 13 in the print element board 10, FIG. 11B is an enlarged view of a part A of FIG. 11A, and FIG. 11C is a top view illustrating a rear face of FIG. 11A. Here, a configuration of the print element board of the application example will be described. As illustrated in FIG. 11A, an ejection opening forming member of the print element board 10 is provided with four ejection opening rows corresponding to different colors of inks. Further, the extension direction of the ejection opening rows of the ejection openings 13 will be referred to as an "ejection opening row direction". As illustrated in FIG. 11B, the print element 15 serving as a heater element for foaming the liquid by heat energy is disposed at a position corresponding to each ejection opening 13. A pressure chamber 23 provided inside the print element 15 is defined by a partition wall 22. The print element 15 is electrically connected to the terminal 16 by an electric wire (not illustrated) provided in the print element board 10. Then, the print element 15 boils the liquid while being heated on the basis of a pulse signal input from a control circuit of the printing apparatus 1000 via the electric wiring board 90 (see FIG. 6) and the flexible circuit board 40 (see FIG. 10B). The liquid is ejected from the ejection opening 13 by a foaming force caused by the boiling. As illustrated in FIG. 11B, a liquid supply path 18 extends at one side along each ejection opening row and a liquid collection path 19 extends at the other side along the ejection opening row. The liquid supply path 18 and the liquid collection path 19 are passages that extend in the ejection opening row direction provided in the print element board 10 and communicate with the ejection opening 13 through a supply opening 17*a* and a collection opening 17*b*.

As illustrated in FIG. 11C, a sheet-shaped lid member 20 is laminated on a rear face of a face provided with the ejection opening 13 in the print element board 10 and the lid member 20 is provided with a plurality of openings 21 communicating with the liquid supply path 18 and the liquid collection path 19. In the application example, the lid member 20 is provided with three openings 21 for each liquid supply path 18 and two openings 21 for each liquid collection path 19. As illustrated in FIG. 11B, openings 21 of the lid member 20 communicate with the communication openings 51 illustrated in FIG. 7(Reference character (a)). It is desirable that the lid member 20 have sufficient corrosion resistance for the liquid. From the viewpoint of preventing mixed color, the opening shape and the opening position of the opening 21 need to have high accuracy. For this reason, it is desirable to form the opening 21 by using a photosensitive resin material or a silicon plate as a material of the lid member 20 through photolithography. In this way, the lid member 20 changes the pitch of the passages by the opening 21. Here, it is desirable to form the lid member by a film-shaped member with a thin thickness in consideration of pressure loss.

Figure 12:
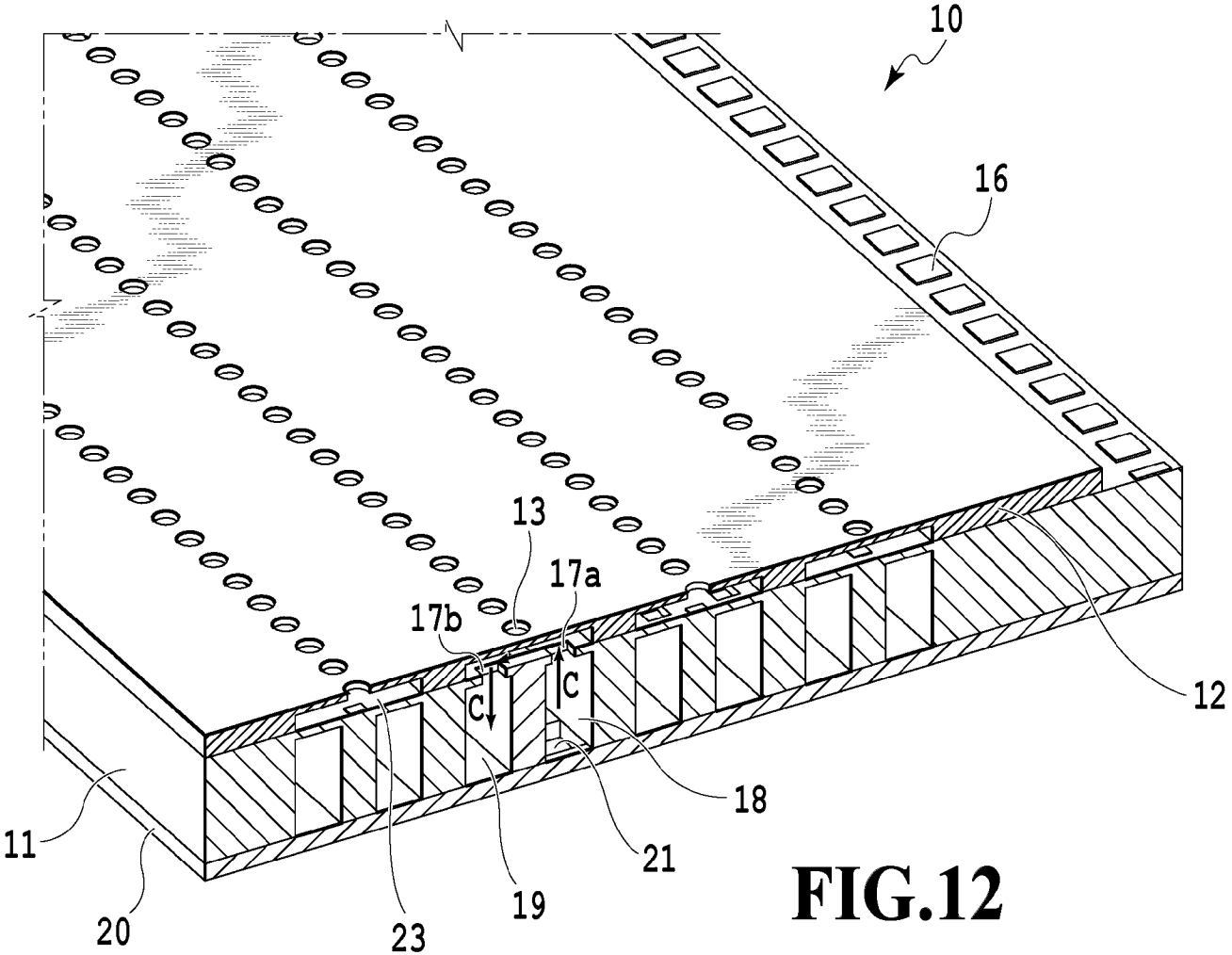
FIG. 12 is a perspective view illustrating cross-sections of the print element board and a lid member.

FIG. 12 is a perspective view illustrating cross-sections of the print element board 10 and the lid member 20 when taken along a line XII-XII of FIG. 11A. Here, a flow of the liquid inside the print element board 10 will be described. The lid member 20 serves as a lid that forms a part of walls of the liquid supply path 18 and the liquid collection path 19 formed in a substrate 11 of the print element board 10. The print element board 10 is formed by laminating the substrate 11 formed of Si and the ejection opening forming member 12 formed of photosensitive resin and the lid member 20 is bonded to a rear face of the substrate 11. One face of the substrate 11 is provided with the print element 15 (see FIG. 11B) and a rear face thereof is provided with grooves forming the liquid supply path 18 and the liquid collection path 19 extending along the ejection opening row. The liquid supply path 18 and the liquid collection path 19 which are formed by the substrate 11 and the lid member 20 are respectively connected to the common supply passage 211 and the common collection passage 212 inside each passage member 210 and a differential pressure is generated between the liquid supply path 18 and the liquid collection path 19. When the liquid is ejected from the ejection opening 13 to print an image, the liquid inside the liquid supply path 18 provided inside the substrate 11 at the ejection opening not ejecting the liquid flows toward the liquid collection path 19 through the supply opening 17*a*, the pressure chamber 23, and the collection opening 17*b* by the differential pressure (see an arrow C of FIG. 12). By the flow, foreign materials, bubbles, and thickened ink produced by the evaporation from the ejection opening 13 in the ejection opening 13 or the pressure chamber 23 not involved with a printing operation can be collected by the liquid collection path 19. Further, the thickening of the ink of the ejection opening 13 or the pressure chamber 23 can be suppressed. The liquid which is collected to the liquid collection path 19 is collected in order of the communication opening 51 (see FIG. 7) inside the passage member 210, the individual collection passage 214, and the common collection passage 212 through the opening 21 of the lid member 20 and the liquid communication opening 31 (see FIG. 10B) of the support member 30. Then, the liquid is collected by the collection path of the printing apparatus 1000. That is, the liquid supplied from the printing apparatus body to the liquid ejection head 3 flows in the following order to be supplied and collected.

First, the liquid flows from the liquid connection portion 111 of the liquid supply unit 220 into the liquid ejection head 3. Then, the liquid is sequentially supplied through the joint rubber 100, the communication opening 72 and the common passage groove 71 provided in the third passage member, the common passage groove 62 and the communication opening 61 provided in the second passage member, and the individual passage groove 52 and the communication opening 51 provided in the first passage member. Subsequently, the liquid is supplied to the pressure chamber 23 while sequentially passing through the liquid communication opening 31 provided in the support member 30, the opening 21 provided in the lid member 20, and the liquid supply path 18 and the supply opening 17*a* provided in the substrate 11. In the liquid supplied to the pressure chamber 23, the liquid which is not ejected from the ejection opening 13 sequentially flows through the collection opening 17*b* and the liquid collection path 19 provided in the substrate 11, the opening 21 provided in the lid member 20, and the liquid communication opening 31 provided in the support member 30. Subsequently, the liquid sequentially flows through the communication opening and the individual passage groove 52 provided in the first passage member, the communication opening 61 and the common passage groove 62 provided in the second passage member, the common passage groove 71 and the communication opening 72 provided in the third passage member 70, and the joint rubber 100. Then, the liquid flows from the liquid connection portion 111 provided in the liquid supply unit 220 to the outside of the liquid ejection head 3.

In the first circulation configuration illustrated in FIG. 2, the liquid which flows from the liquid connection portion 111 is supplied to the joint rubber 100 through the negative pressure control unit 230. Further, in the second circulation configuration illustrated in FIG. 3, the liquid which is collected from the pressure chamber 23 passes through the joint rubber 100 and flows from the liquid connection portion 111 to the outside of the liquid ejection head through the negative pressure control unit 230. The entire liquid which flows from one end of the common supply passage 211 of the liquid ejection unit 300 is not supplied to the pressure chamber 23 through the individual supply passage 213*a*. That is, the liquid may flow from the other end of the common supply passage 211 to the liquid supply unit 220 while not flowing into the individual supply passage 213*a* by the liquid which flows from one end of the common supply passage 211. In this way, since the path is provided so that the liquid flows therethrough without passing through the print element board 10, the reverse flow of the circulation flow of the liquid can be suppressed even in the print element board 10 including the small passage with a large flow resistance as in the application example. In this way, since the thickening of the liquid in the vicinity of the ejection opening or the pressure chamber 23 can be suppressed in the liquid ejection head 3 of the application example, a slippage or a non-ejection can be suppressed. As a result, a high-quality image can be printed.

(Description of Positional Relation Among Print Element Boards)

Figure 13:
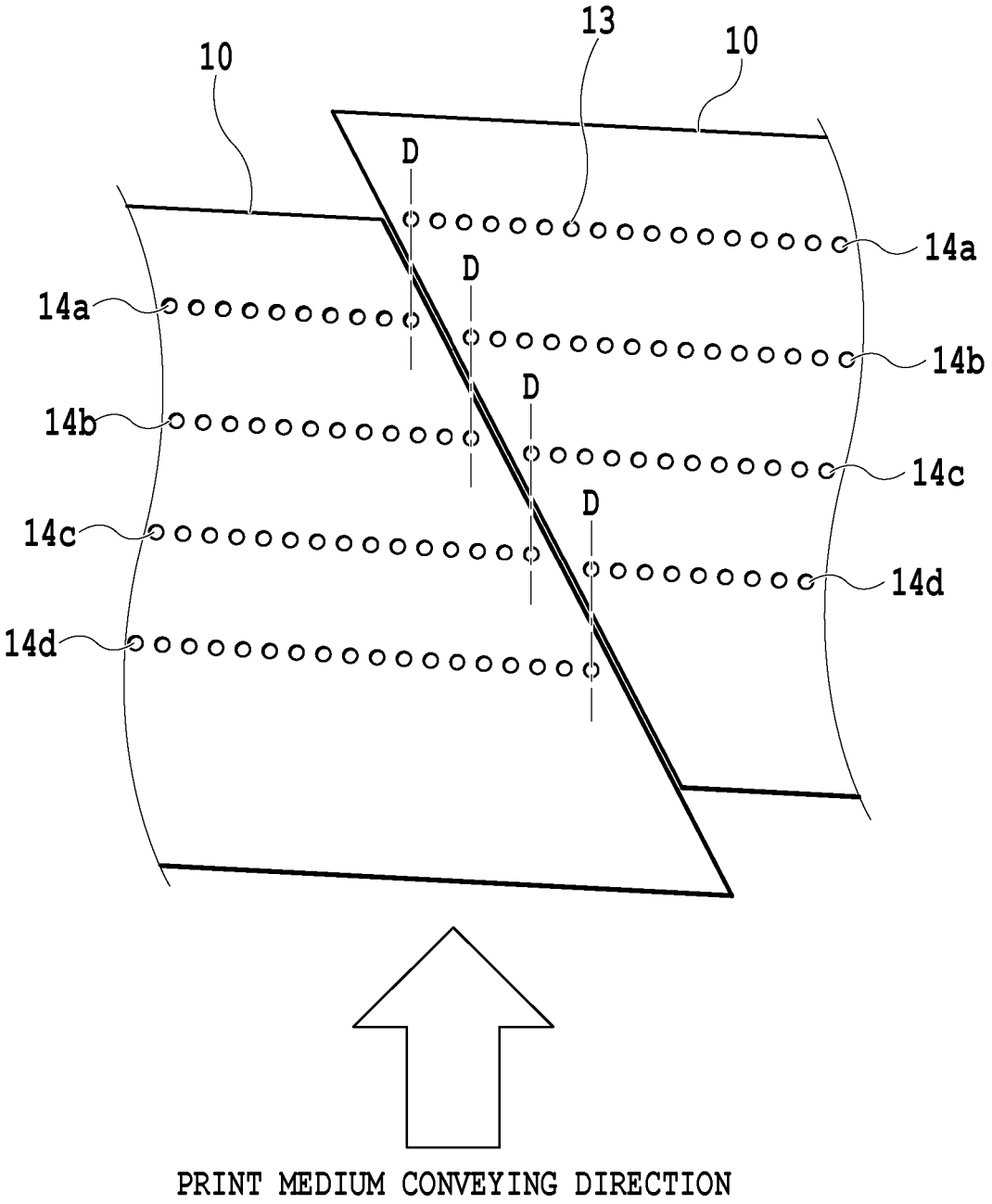
FIG. 13 is a partially enlarged top view of an adjacent portion of the print element board.

FIG. 13 is a partially enlarged top view illustrating an adjacent portion of the print element board in two adjacent ejection modules. In the application example, a substantially parallelogram print element board is used. Ejection opening rows (14*a* to 14*d*) having the ejection openings 13 arranged in each print element board 10 are disposed to be inclined while having a predetermined angle with respect to the longitudinal direction of the liquid ejection head 3. Then, the ejection opening row at the adjacent portion between the print element boards 10 is formed such that at least one ejection opening overlaps in the print medium conveying direction. In FIG. 13, two ejection openings on a line D overlap each other. With such an arrangement, even in a case where a position of the print element board 10 is slightly deviated from a predetermined position, black streaks or voids of a print image cannot be seen by a driving control of the overlapping ejection openings. Even in a case where the print element boards 10 are disposed in a straight linear shape (an in-line shape) instead of a zigzag shape, black streaks or voids at the connection portion between the print element boards 10 can be handled while an increase in the length of the liquid ejection head 3 in the print medium conveying direction is suppressed by the configuration illustrated in FIG. 13. Further, in the application example, a principal plane of the print element board has a parallelogram shape, but the invention is not limited thereto. For example, even in a case where the print element boards having a rectangular shape, a trapezoid shape, and the other shapes are used, the configuration of the invention can be desirably used.

Second Application Example

Hereinafter, configurations of an inkjet printing apparatus 2000 and a liquid ejection head 2003 according to a second application example of the invention will be described with reference to the drawings. In the description below, only a difference from the first application example will be described and a description of the same components as those of the first application example will be omitted.

(Description of Inkjet Printing Apparatus)

Figure 21:
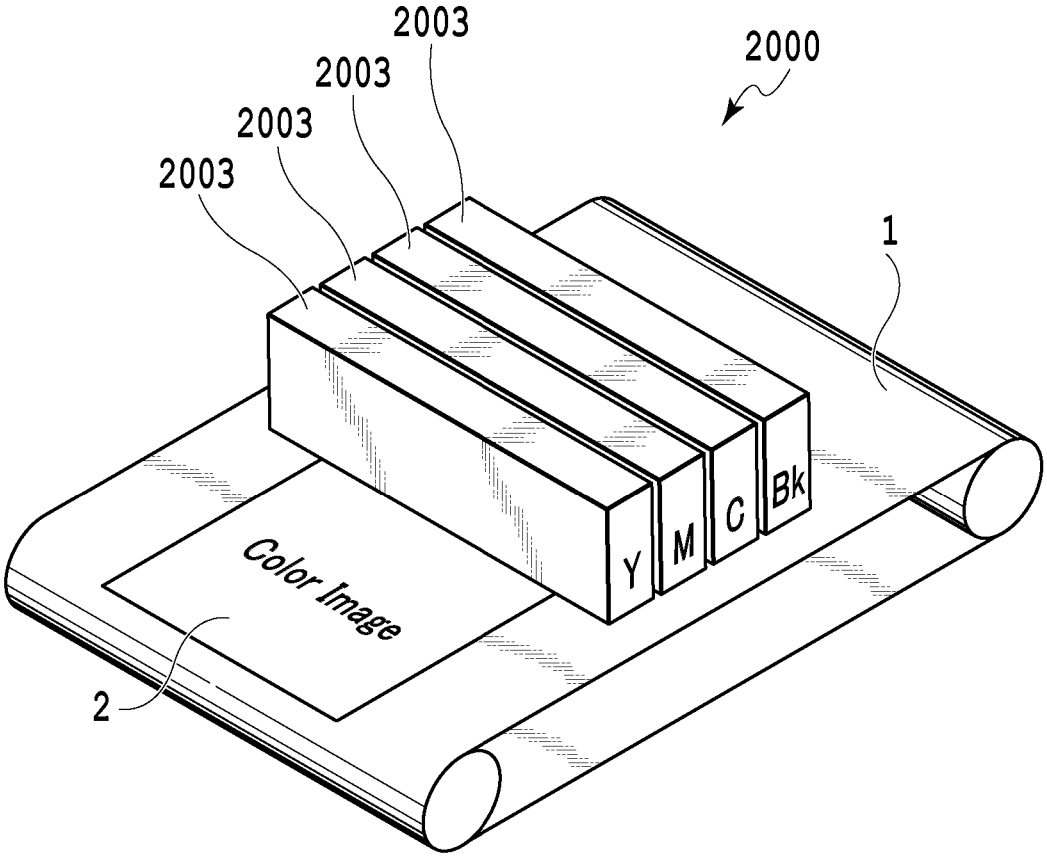
FIG. 21 is a diagram illustrating an inkjet printing apparatus that prints an image by ejecting a liquid.

FIG. 21 is a diagram illustrating the inkjet printing apparatus 2000 according to the application example used to eject the liquid. The printing apparatus 2000 of the application example is different from the first application example in that a full color image is printed on the print medium by a configuration in which four monochromic liquid ejection heads 2003 respectively corresponding to the inks of cyan C, magenta M, yellow Y, and black K are disposed in parallel. In the first application example, the number of the ejection opening rows which can be used for one color is one. However, in the application example, the number of the ejection opening rows which can be used for one color is twenty. For this reason, in a case where print data is appropriately distributed to a plurality of ejection opening rows to print an image, an image can be printed at a higher speed. Further, even in a case where there are the ejection openings that do not eject the liquid, the liquid is ejected complementarily from the ejection openings of the other rows located at positions corresponding to the non-ejection openings in the print medium conveying direction. The reliability is improved and thus a commercial image can be appropriately printed. Similarly to the first application example, the supply system, the buffer tank 1003 (see FIGS. 2 and 3), and the main tank 1006 (see FIGS. 2 and 3) of the printing apparatus 2000 are fluid-connected to the liquid ejection heads 2003. Further, an electrical control unit which transmits power and ejection control signals to the liquid ejection head 2003 is electrically connected to the liquid ejection heads 2003.

(Description of Circulation Path)

Similarly to the first application example, the first and second circulation configurations illustrated in FIG. 2 or 3 can be used as the liquid circulation configuration between the printing apparatus 2000 and the liquid ejection head 2003.

(Description of Structure of Liquid Ejection Head)

Figure 14A:
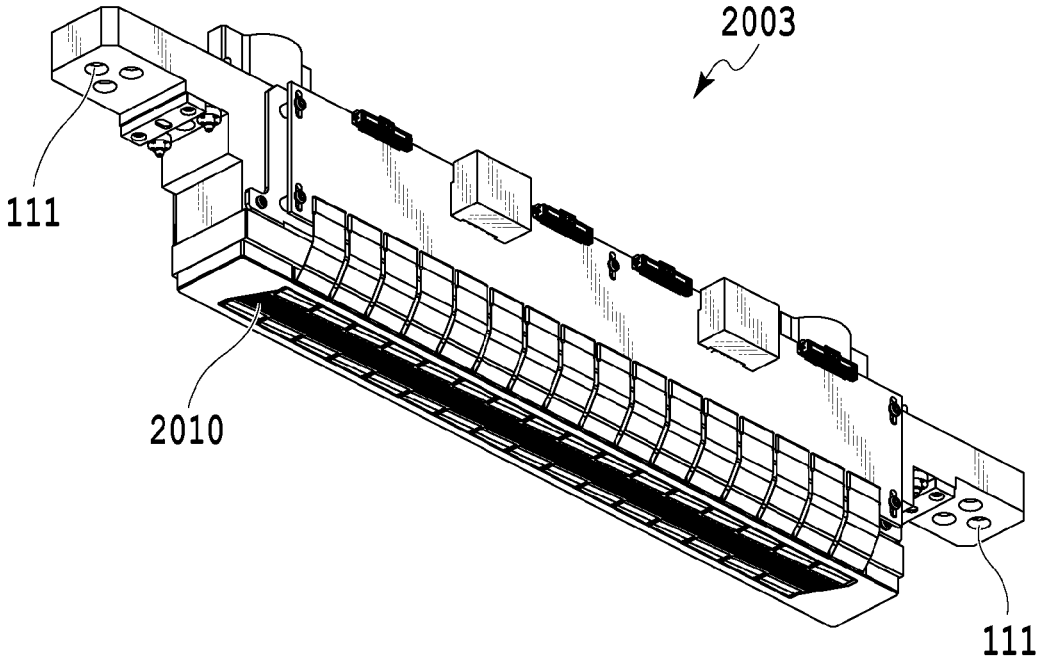
FIG. 14A is a perspective view illustrating the liquid ejection head.
Figure 14B:
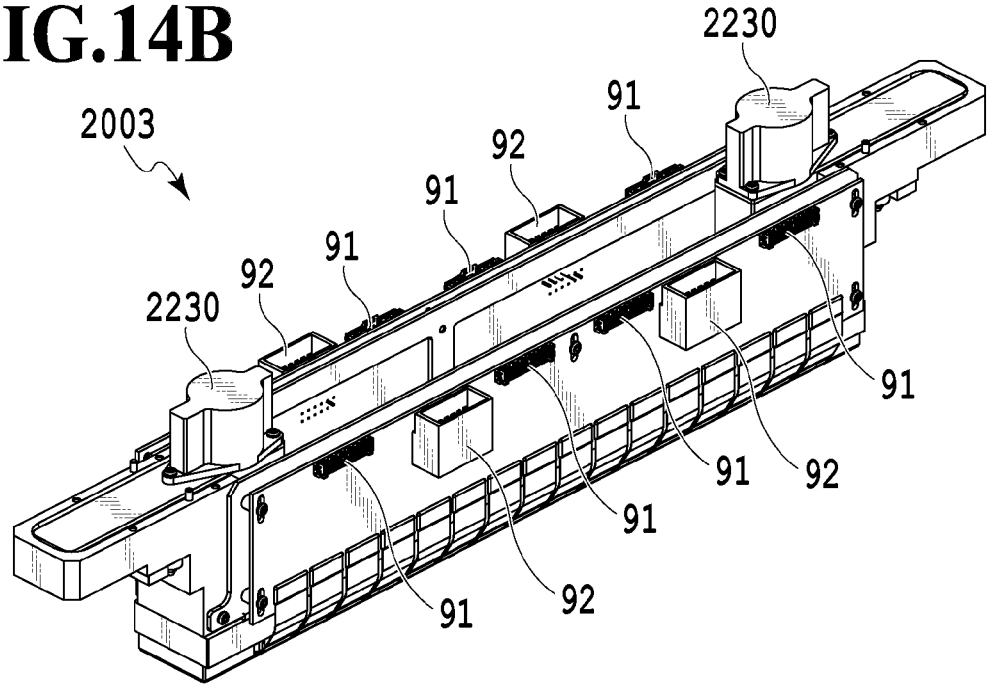
FIG. 14B is a perspective view illustrating the liquid ejection head.

FIGS. 14A and 14B are perspective views illustrating the liquid ejection head 2003 according to the application example. Here, a structure of the liquid ejection head 2003 according to the application example will be described. The liquid ejection head 2003 is an inkjet line type (page wide type) print head which includes sixteen print element boards 2010 arranged linearly in the longitudinal direction of the liquid ejection head 2003 and can print an image by one kind of liquid. Similarly to the first application example, the liquid ejection head 2003 includes the liquid connection portion 111, the signal input terminal 91, and the power supply terminal 92. However, since the liquid ejection head 2003 of the application example includes many ejection opening rows compared with the first application example, the signal input terminal 91 and the power supply terminal 92 are disposed at both sides of the liquid ejection head 2003. This is because a decrease in voltage or a delay in transmission of a signal caused by the wiring portion provided in the print element board 2010 needs to be reduced.

Figure 15:
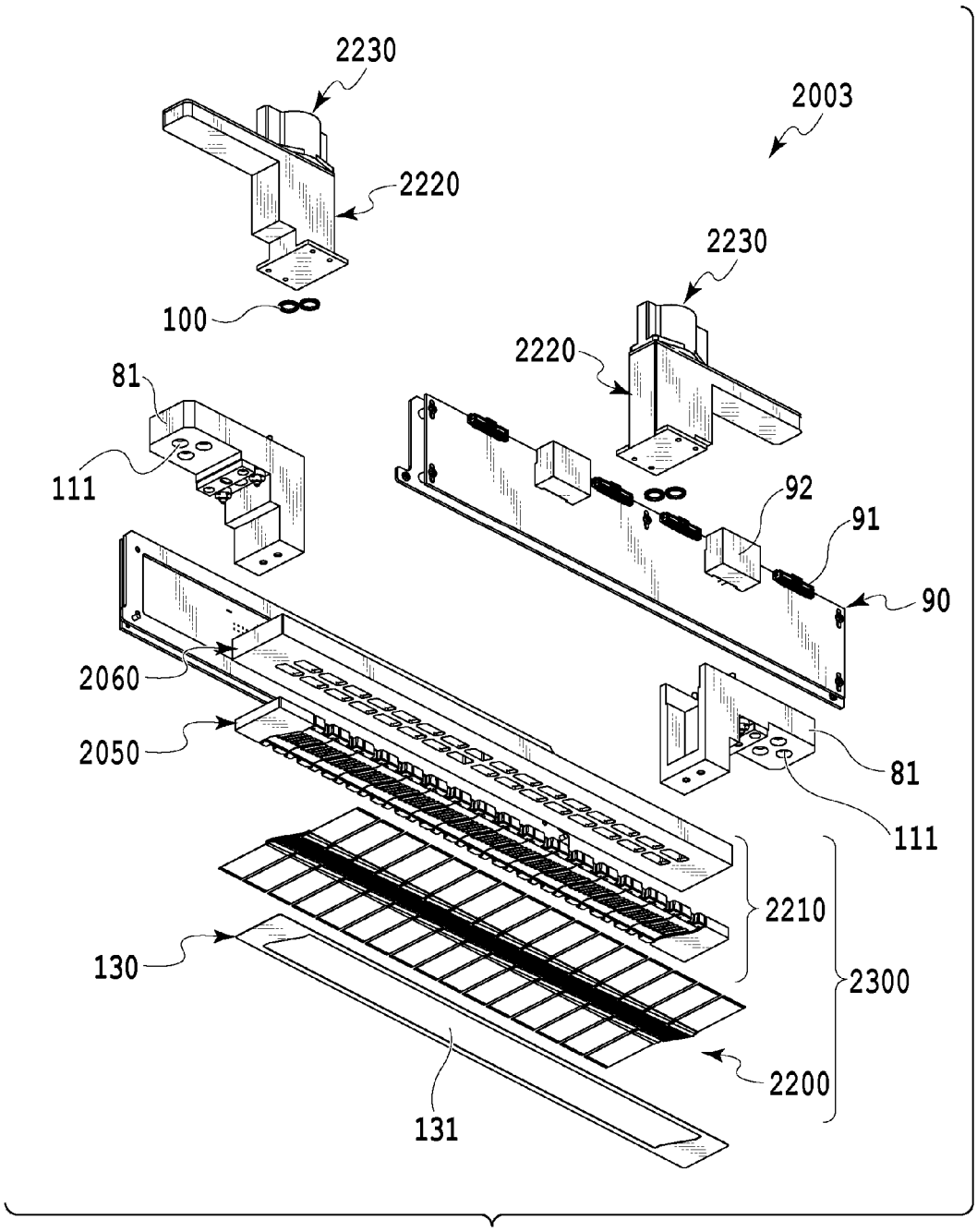
FIG. 15 is an exploded perspective view illustrating the liquid ejection head.

FIG. 15 is an exploded perspective view illustrating the liquid ejection head 2003 and components or units constituting the liquid ejection head 2003 according to the functions thereof. The function of each of units and members or the liquid flow sequence inside the liquid ejection head is basically similar to that of the first application example, but the function of guaranteeing the rigidity of the liquid ejection head is different. In the first application example, the rigidity of the liquid ejection head is mainly guaranteed by the liquid ejection unit support portion 81, but in the liquid ejection head 2003 of the second application example, the rigidity of the liquid ejection head is guaranteed by a second passage member 2060 included in a liquid ejection unit 2300. The liquid ejection unit support portion 81 of the application example is connected to both ends of the second passage member 2060 and the liquid ejection unit 2300 is mechanically connected to a carriage of the printing apparatus 2000 to position the liquid ejection head 2003. The electric wiring board 90 and a liquid supply unit 2220 including a negative pressure control unit 2230 are connected to the liquid ejection unit support portion 81. Each of two liquid supply units 2220 includes a filter (not illustrated) built therein.

Two negative pressure control units 2230 are set to control a pressure at different and relatively high and low negative pressures. Further, as in FIGS. 14B and 15, in a case where the negative pressure control units 2230 at the high pressure side and the low pressure side are provided at both ends of the liquid ejection head 2003, the flows of the liquid in the common supply passage and the common collection passage extending in the longitudinal direction of the liquid ejection head 2003 face each other. In such a configuration, a heat exchange between the common supply passage and the common collection passage is promoted and thus a difference in temperature inside two common passages is reduced. Accordingly, a difference in temperature of the print element boards 2010 provided along the common passage is reduced. As a result, there is an advantage that unevenness in printing is not easily caused by a difference in temperature.

Next, a detailed configuration of a passage member 2210 of the liquid ejection unit 2300 will be described. As illustrated in FIG. 15, the passage member 2210 is obtained by laminating a first passage member 2050 and a second passage member 2060 and distributes the liquid supplied from the liquid supply unit 2220 to ejection modules 2200. The passage member 2210 serves as a passage member that returns the liquid re-circulated from the ejection module 2200 to the liquid supply unit 2220. The second passage member 2060 of the passage member 2210 is a passage member having a common supply passage and a common collection passage formed therein and improving the rigidity of the liquid ejection head 2003. For this reason, it is desirable that a material of the second passage member 2060 have sufficient corrosion resistance for the liquid and high mechanical strength. Specifically, SUS, Ti, or alumina can be used.

Figure 16:
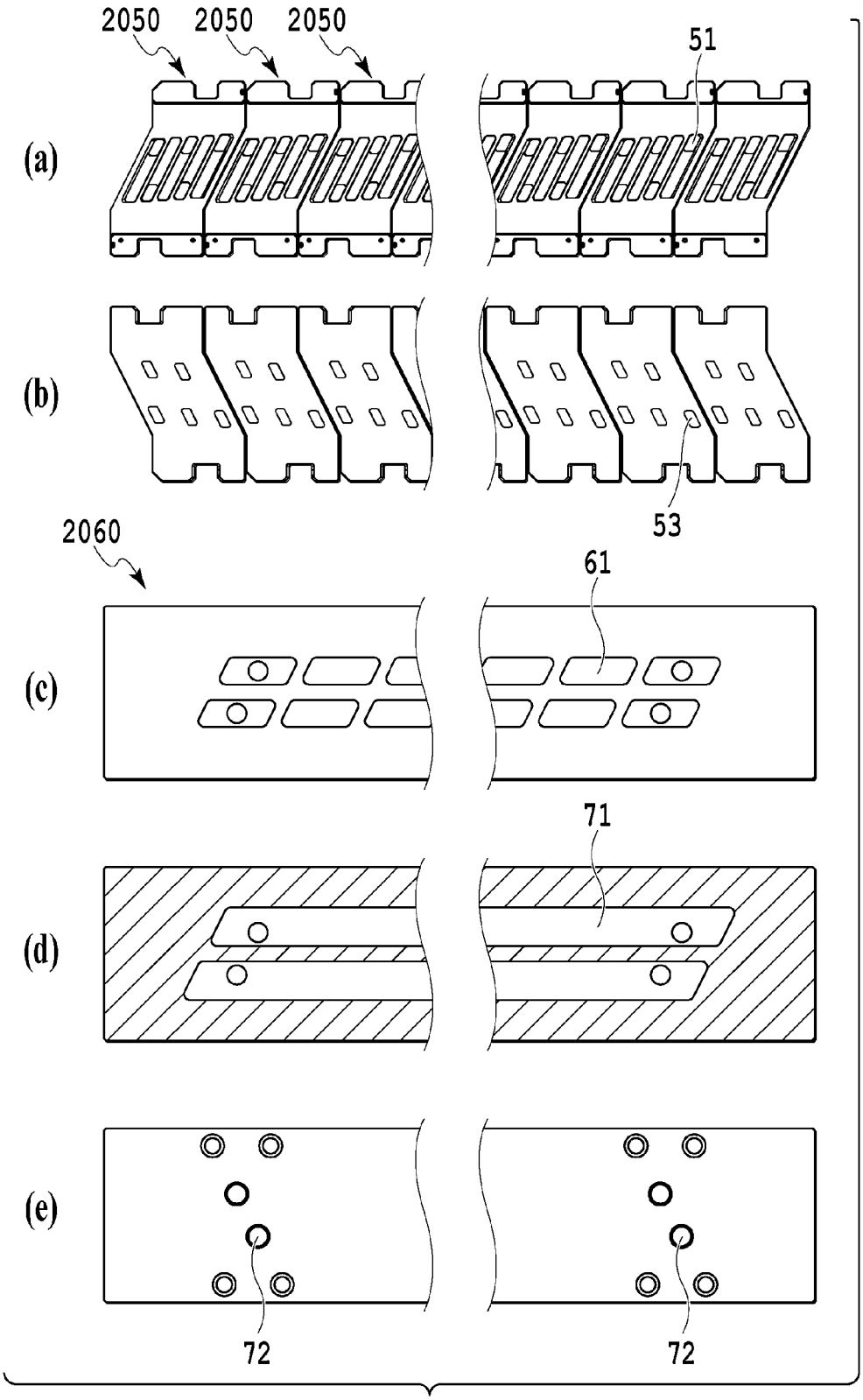
FIG. 16 is a diagram illustrating the first passage member.

Reference character (a) of FIG. 16 illustrates a face onto which the ejection module 2200 is mounted in the first passage member 2050 and reference character (b) of FIG. 16 illustrates a rear face thereof and a face contacting the second passage member 2060. Differently from the first application example, the first passage member 2050 of the application example has a configuration in which a plurality of members are disposed adjacently to respectively correspond to the ejection modules 2200. By employing such a split structure, a plurality of modules can be arranged to correspond to a length of the liquid ejection head 2003. Accordingly, this structure can be appropriately used particularly in a relatively long liquid ejection head corresponding to, for example, a sheet having a size of B2 or more. As illustrated in FIG. 16 (Reference character (a)), the communication opening 51 of the first passage member 2050 fluid-communicates with the ejection module 2200. As illustrated in FIG. 16 (Reference character (b)), the individual communication opening 53 of the first passage member 2050 fluid-communicates with the communication opening 61 of the second passage member 2060. Reference character (c) of FIG. 16 illustrates a contact face of the second passage member 2060 with respect to the first passage member 2050, reference character (d) of FIG. 16 illustrates a cross-section of a center portion of the second passage member 2060 in the thickness direction, and reference character (e) of FIG. 16 illustrates a contact face of the second passage member 2060 with respect to the liquid supply unit 2220. The function of the communication opening or the passage of the second passage member 2060 is similar to each color of the first application example. The common passage groove 71 of the second passage member 2060 is formed such that one side thereof is a common supply passage 2211 illustrated in FIG. 17 and the other side thereof is a common collection passage 2212. These passages are respectively provided along the longitudinal direction of the liquid ejection head 2003 so that the liquid is supplied from one end thereof to the other end thereof. The application example is different from the first application example in that the liquid flow directions in the common supply passage 2211 and the common collection passage 2212 are opposite to each other.

Figure 17:
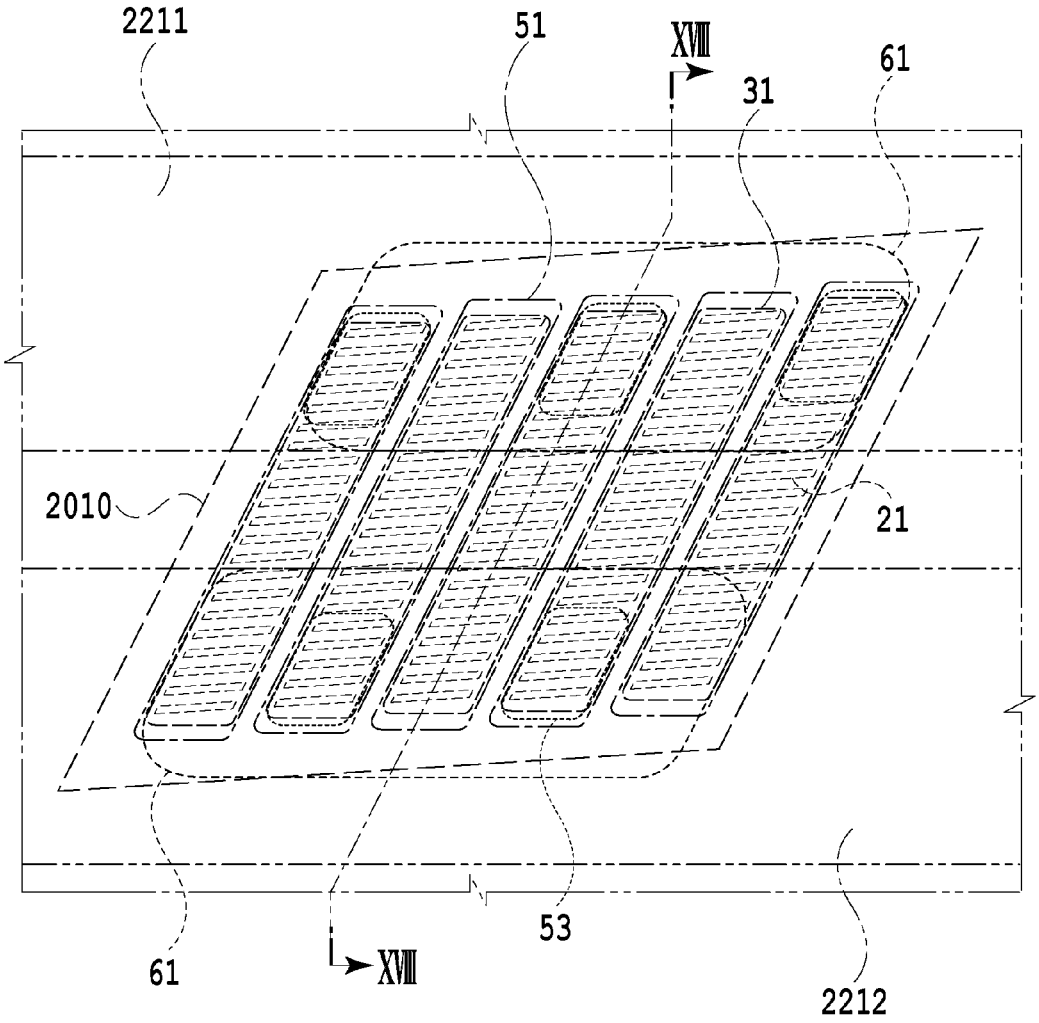
FIG. 17 is a perspective view illustrating a liquid connection relation between the print element board and the passage member.

FIG. 17 is a perspective view illustrating a liquid connection relation between the print element board 2010 and the passage member 2210. A pair of the common supply passage 2211 and the common collection passage 2212 extending in the longitudinal direction of the liquid ejection head 2003 is provided inside the passage member 2210. The communication opening 61 of the second passage member 2060 is connected to the individual communication opening 53 of the first passage member 2050 so that both positions match each other and the liquid supply passage communicating with the communication opening 51 of the first passage member 2050 through the communication opening from the common supply passage 2211 of the second passage member 2060 is formed. Similarly, the liquid the supply path communicating with the communication opening 51 of the first passage member 2050 through the common collection passage 2212 from the communication opening 72 of the second passage member 2060 is also formed.

Figure 18:
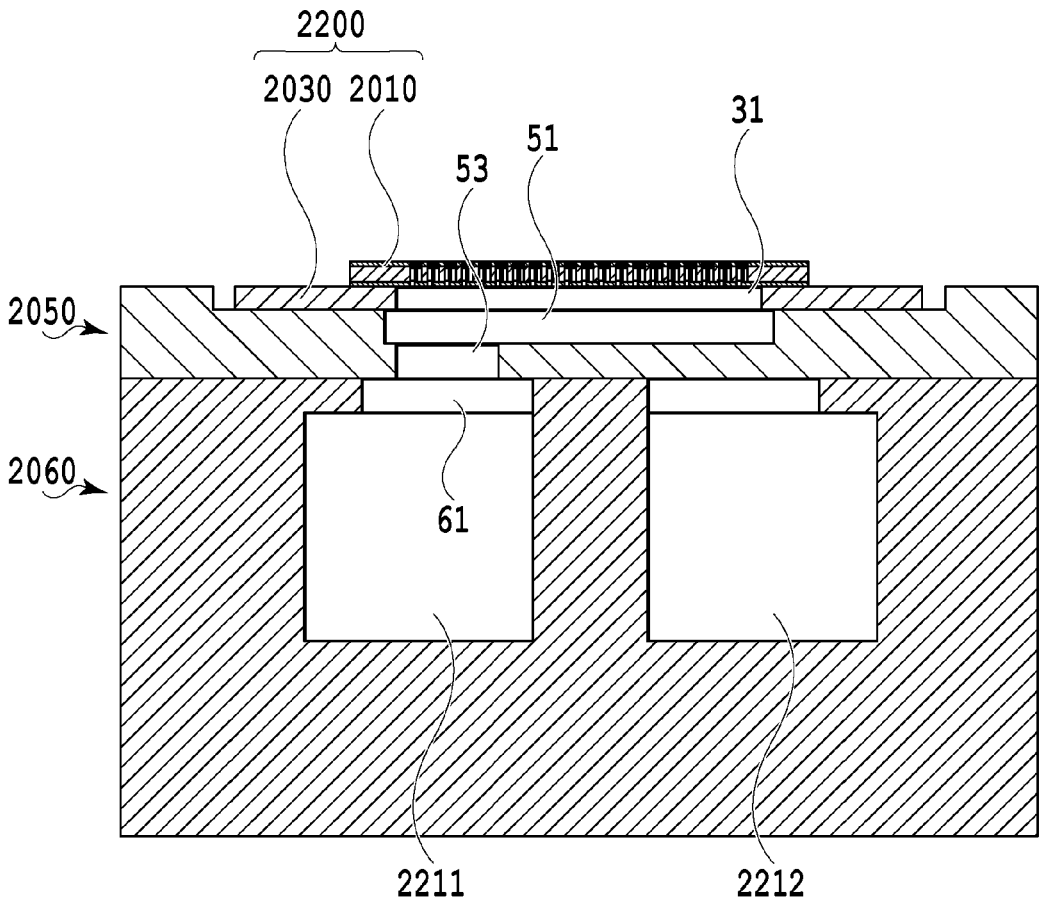
FIG. 18 is a cross-sectional view taken along a line XVIII-XVIII of FIG. 17.

FIG. 18 is a cross-sectional view taken along a line XVIII-XVIII of FIG. 17. The common supply passage 2211 is connected to the ejection module 2200 through the communication opening 61, the individual communication opening 53, and the communication opening 51. Although not illustrated in FIG. 18, it is obvious that the common collection passage 2212 is connected to the ejection module 2200 by the same path in a different cross-section in FIG. 17. Similarly to the first application example, each of the ejection module 2200 and the print element board 2010 is provided with a passage communicating with each ejection opening and thus a part or the entirety of the supplied liquid can be re-circulated while passing through the ejection opening that does not perform the ejection operation. Further, similarly to the first application example, the common supply passage 2211 is connected to the negative pressure control unit 2230 (the high pressure side) and the common collection passage 2212 is connected to the negative pressure control unit 2230 (the low pressure side) through the liquid supply unit 2220. Thus, a flow is generated so that the liquid flows from the common supply passage 2211 to the common collection passage 2212 through the pressure chamber of the print element board 2010 by the differential pressure.

(Description of Ejection Module)

Figure 19A:
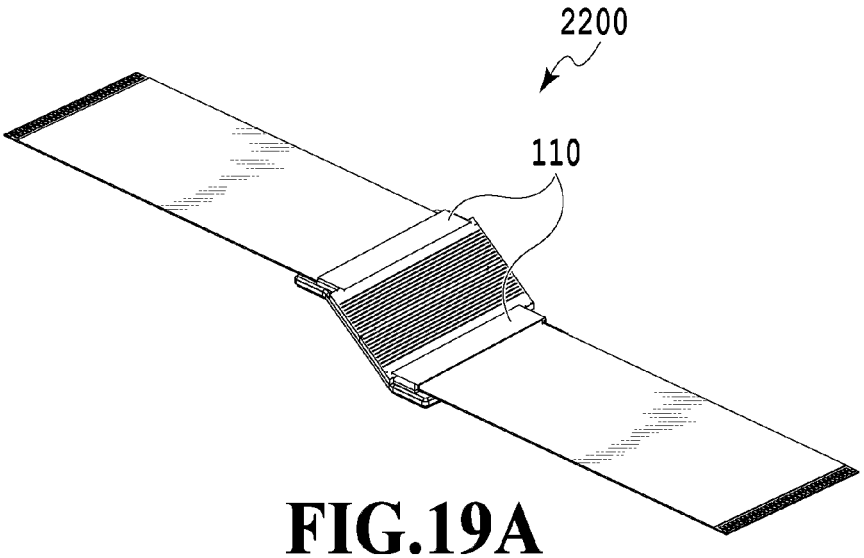
FIG. 19A is a perspective view illustrating one ejection module.
Figure 19B:
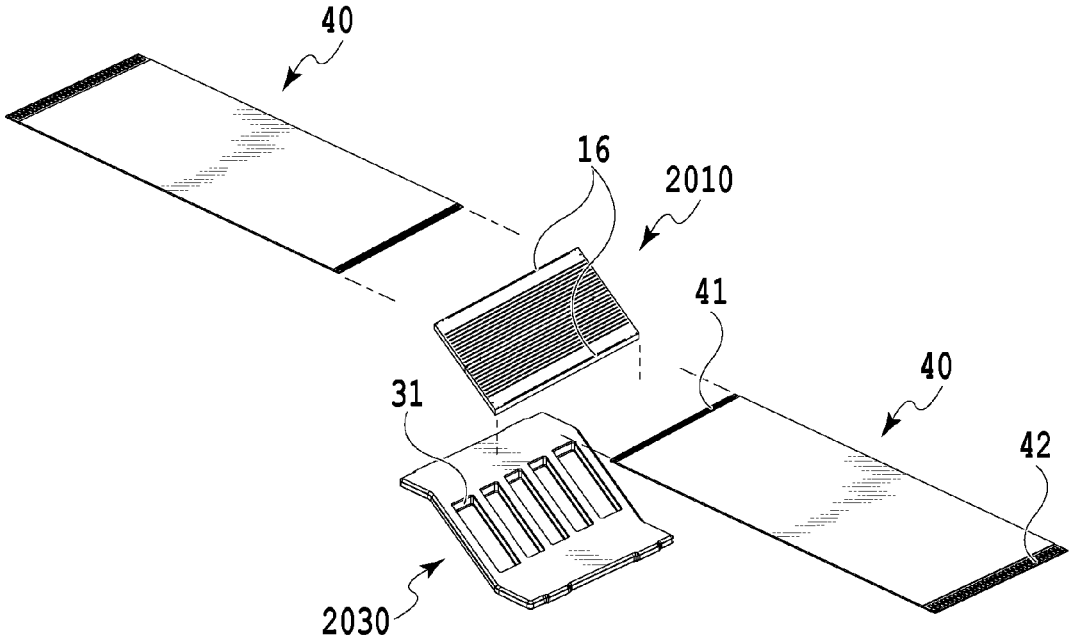
FIG. 19B is an exploded perspective view illustrating one ejection module.

FIG. 19A is a perspective view illustrating one ejection module 2200 and FIG. 19B is an exploded view thereof. A difference from the first application example is that the terminals 16 are respectively disposed at both sides (the long side portions of the print element board 2010) in the ejection opening row directions of the print element board 2010. Accordingly, two flexible circuit boards 40 electrically connected to the print element board 2010 are disposed for each print element board 2010. Since the number of the ejection opening rows provided in the print element board 2010 is twenty, the ejection opening rows are more than eight ejection opening rows of the first application example. Here, since a maximal distance from the terminal 16 to the print element is shortened, a decrease in voltage or a delay of a signal generated in the wiring portion inside the print element board 2010 is reduced. Further, the liquid communication opening 31 of the support member 2030 is opened along the entire ejection opening row provided in the print element board 2010. The other configurations are similar to those of the first application example.

(Description of Structure of Print Element Board)

Figure 20:
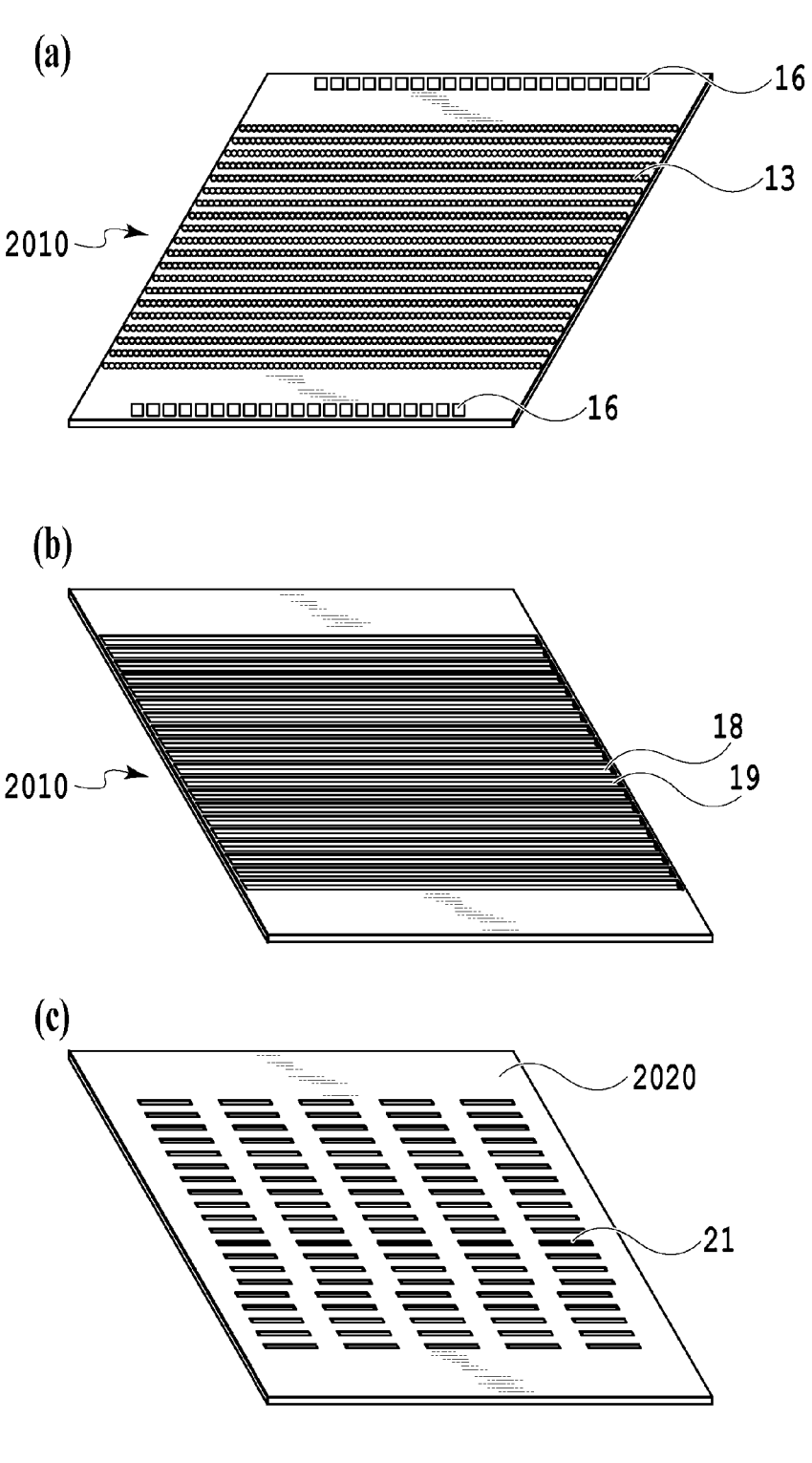
FIG. 20 is a schematic diagram illustrating the print element board.

Reference character (a) of FIG. 20 is a schematic diagram illustrating a face on which the ejection opening 13 is disposed in the print element board 2010 and reference character (c) of FIG. 20 is a schematic diagram illustrating a rear face of the face of reference character (a) of FIG. 20. Reference character (b) of FIG. 20 is a schematic diagram illustrating a face of the print element board 2010 in a case where a lid member 2020 provided in the rear face of the print element board 2010 in reference character (c) of FIG. 20 is removed. As illustrated in reference character (b) of FIG. 20, the liquid supply path and the liquid collection path 19 are alternately provided along the ejection opening row direction at the rear face of the print element board 2010. The number of the ejection opening rows is larger than that of the first application example. However, a basic difference from the first application example is that the terminal 16 is disposed at both sides of the print element board in the ejection opening row direction as described above. A basic configuration is similar to the first application example in that a pair of the liquid supply path 18 and the liquid collection path 19 is provided in each ejection opening row and the lid member 2020 is provided with the opening 21 communicating with the liquid communication opening 31 of the support member 2030.

In addition, the description of the above-described application example does not limit the scope of the invention. As an example, in the application example, a thermal type has been described in which bubbles are generated by a heating element to eject the liquid. However, the invention can be also applied to the liquid ejection head which employs a piezo type and the other various liquid ejection types.

In the application example, the inkjet printing apparatus (the printing apparatus) has been described in which the liquid such as ink is circulated between the tank and the liquid ejection head, but the other application examples may be also used. In the other application examples, for example, a configuration may be employed in which the ink is not circulated and two tanks are provided at the upstream side and the downstream side of the liquid ejection head so that the ink flows from one tank to the other tank. In this way, the ink inside the pressure chamber may flow.

In the application example, an example of using a so-called line type head having a length corresponding to the width of the print medium has been described, but the invention can be also applied to a so-called serial type liquid ejection head which prints an image on the print medium while scanning the print medium. As the serial type liquid ejection head, for example, the liquid ejection head may be equipped with a print element board ejecting black ink and a print element board ejecting color ink, but the invention is not limited thereto. That is, a liquid ejection head which is shorter than the width of the print medium and includes a plurality of print element boards disposed so that the ejection openings overlap each other in the ejection opening row direction may be provided and the print medium may be scanned by the liquid ejection head.

Third Application Example (Embodiment)

(Description of Configuration of Liquid Ejection Head)

Figure 22:
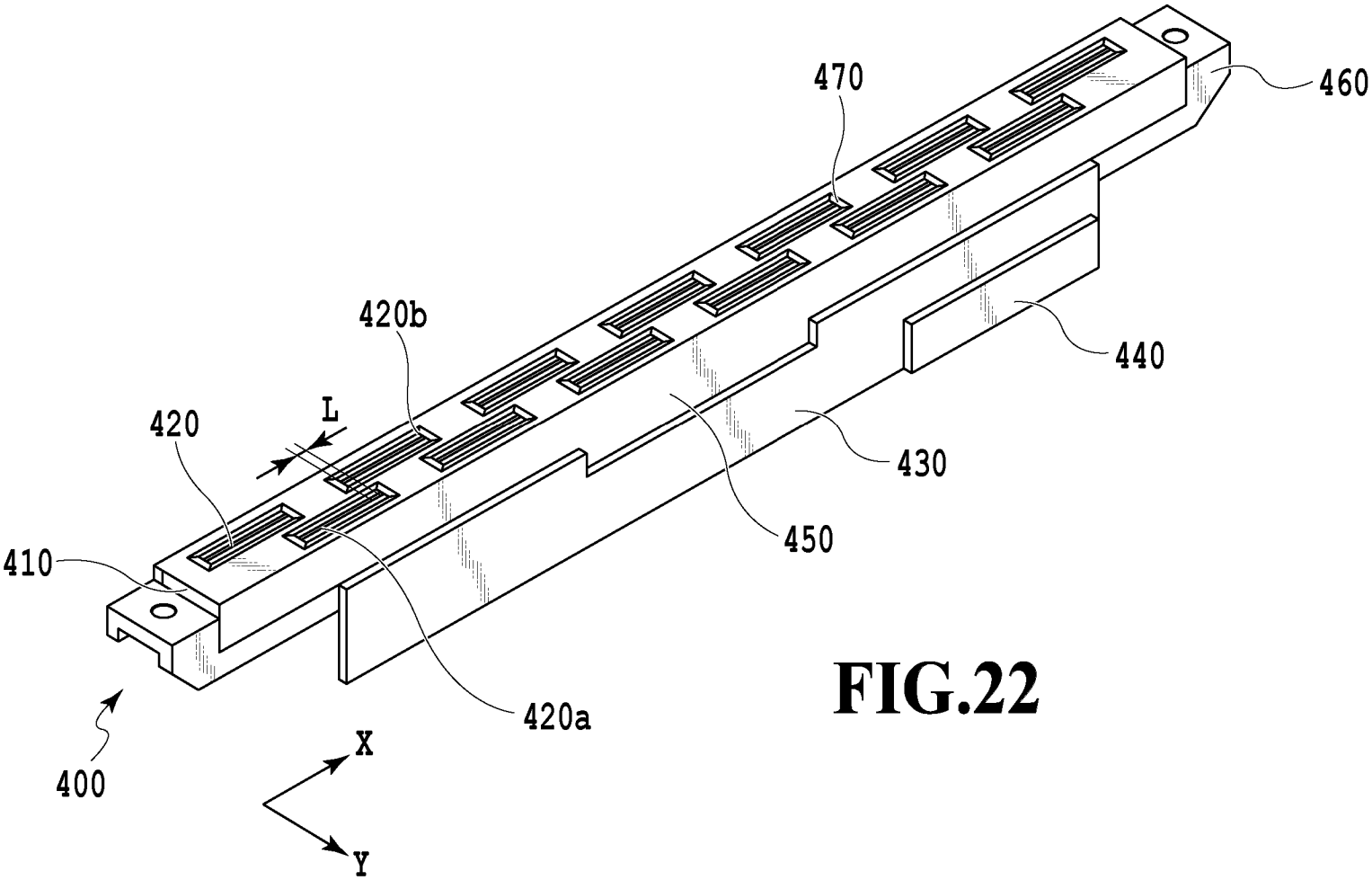
FIG. 22 is a perspective view illustrating a liquid ejection head according to the embodiment.

Hereinafter, a configuration of a liquid ejection head 400 according to the embodiment will be described. Further, in the description below, only a difference from the above-described embodiments will be mainly described and a description of the same components as those of the above-described embodiments will be omitted. FIG. 22 is a perspective view illustrating the liquid ejection head 400 according to the embodiment. Here, a coordinate axis is set as illustrated in the drawings for the description of the embodiment.

Referring to FIG. 22, one elongated liquid ejection head 400 has a configuration in which a plurality of print element boards 420 having a plurality of print elements ejecting a liquid such as ink and densely arranged are arranged on a passage member 410 in the X direction while being alternately deviated from each other in the Y direction. An overlapping area (indicated by "L" in FIG. 22) is provided between two adjacent print element boards (for example, 420*a* and 420*b*). Accordingly, even in a case where the print element boards are arranged with a slight error, a gap caused by the error is not formed on a printing medium which is conveyed in the Y direction so that an image is printed thereon. An electric wiring board 430 is an electronic circuit substrate which is formed of a composite material such as glass epoxy and supplies power necessary for an ejection operation and an ejection drive signal to each print element board 420 and includes a connector 440 which receives a signal or power from the outside. A flexible circuit board 450 electrically connects the passage member 410 to the electric wiring board 430 and connects each print element board 420 to the electric wiring board 430. The passage member 410, the print element board 420, and the electric wiring board 430 which are electrically connected to one another are integrally supported by a support portion 460. An electrical connection portion between the print element board 420 and the flexible circuit board 450 is coated by a sealing member 470 (epoxy resin or the like) having an excellent sealing property and an excellent ion interception property to be protected.

Further, the liquid ejection head 400 includes a heating heater (not illustrated) which increases a temperature of the liquid ejection head 400. The liquid ejection head 400 is provided to solve concern of deterioration in image quality caused by an increase in temperature of the liquid ejection head 400 in the middle of forming a high-duty image by ejecting the ink. In the embodiment, the temperature of the liquid ejection head 400 is increased by a heating heater, and then the temperature of the liquid ejection head 400 remain high in a previous step of forming an image by ejecting the ink. Accordingly, an increase in temperature of the liquid ejection head 400 during an operation of forming an image by ejecting the ink is suppressed to prevent deterioration in image quality (which will be described later in detail).

(Description of Configuration of Passage)

Hereinafter, a configuration of a passage of a liquid flowing through the liquid ejection head 400 according to the embodiment will be described. Similarly to the above-described embodiments, the liquid ejection head 400 includes a liquid ejection unit which ejects a liquid and a liquid supply unit which supplies a liquid to the liquid ejection unit. Then, the liquid ejection unit includes the print element boards 420.

Figures 23A, 23B, 23C, 23D:
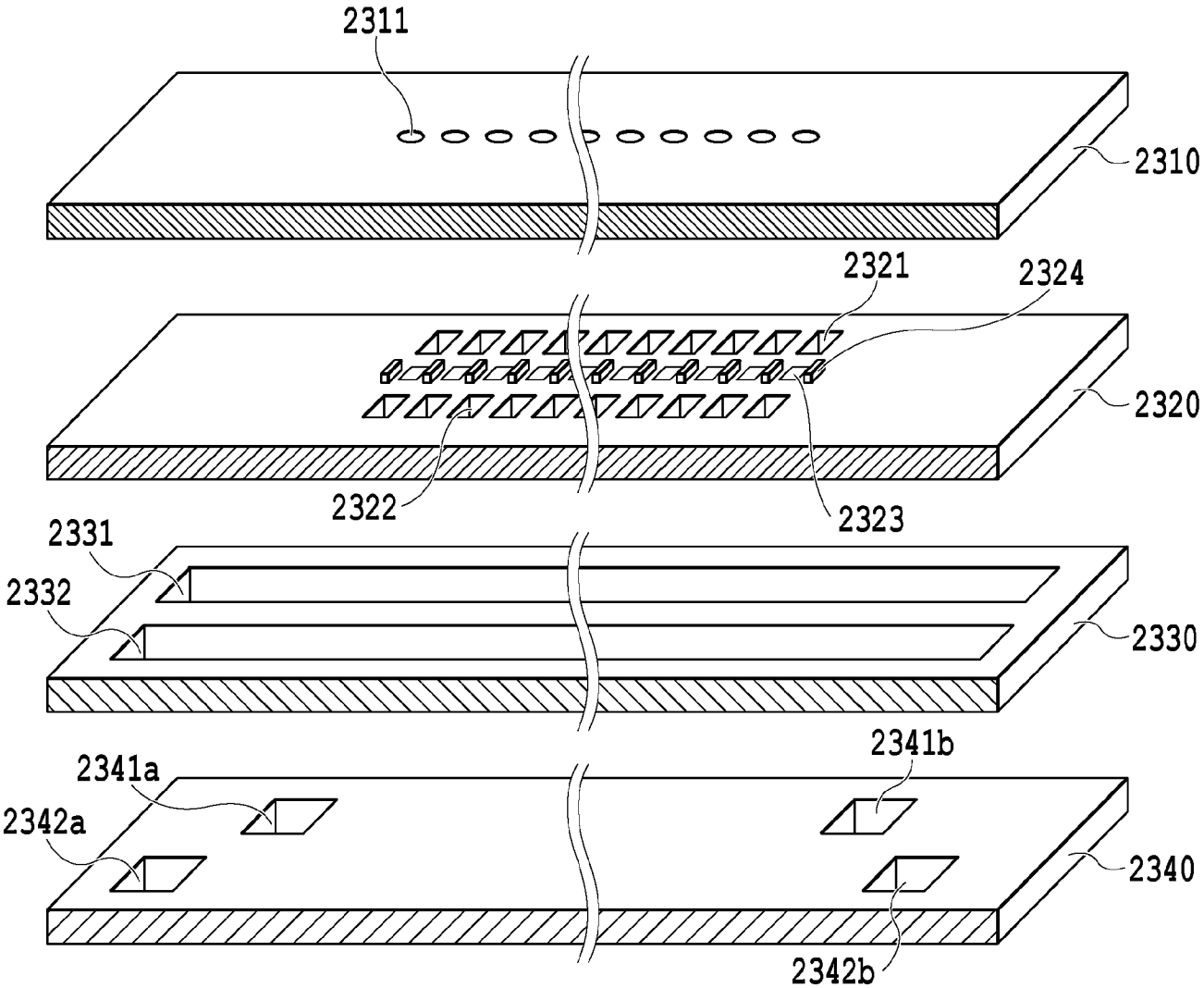
FIGS. 23A to 23D are diagrams illustrating a lamination structure of a print element board according to the embodiment.

FIGS. 23A to 23D are perspective views illustrating members constituting the print element board 420 according to the embodiment and illustrate a lamination structure of the print element board 420. A configuration of the passage inside the print element board will be described with reference to FIGS. 23A to 23D. FIG. 23A illustrates an ejection opening forming member 2310 provided with a plurality of ejection openings 2311. FIG. 23B illustrates an individual supply passage 2321, an individual collection passage 2322, and a first passage member 2320 provided with a driving circuit and the like. FIG. 23C illustrates a second passage member 2330 provided with a common supply passage 2331 and a common collection passage 2332. FIG. 23D illustrates a third passage member 2340 provided with a plurality of communication openings 2341*a*, 2341*b*, 2342*a*, and 2342*b*. In a case where a position provided with the communication opening is adjusted (a distance between the communication opening 2341*a* and the communication opening 2341*b* (or a distance between the communication opening 2342*a* and the communication opening 2342*b*) is adjusted), a length (a pitch) of the passage through which the liquid flows in the common supply passage and the common collection passage can be adjusted. In a case where the structures illustrated in FIGS. 23A to 23D are combined with one another, one chip of the print element board 420 is obtained.

The liquid which is supplied from the liquid connection portion of the support portion 460 to each print element board reaches a pressure chamber through the communication openings 2341*a* and 2341*b*, the common supply passage 2331, and the individual supply passage 2321. Subsequently, the liquid is discharged from the communication openings 2342*a* and 2342*b* through the individual collection passage 2322 and the common collection passage 2332. Further, in FIG. 23D, the communication openings 2341*a* and 2341*b* (and the communication openings 2342*a* and 2342*b*) are located at both ends in the ejection opening row, but a plurality of communication openings may be disposed inside the ejection opening row. That is, a pitch between the communication openings may be a pitch in which the passage members supplying and collecting the liquid can be bonded to each other.

Figure 24A:
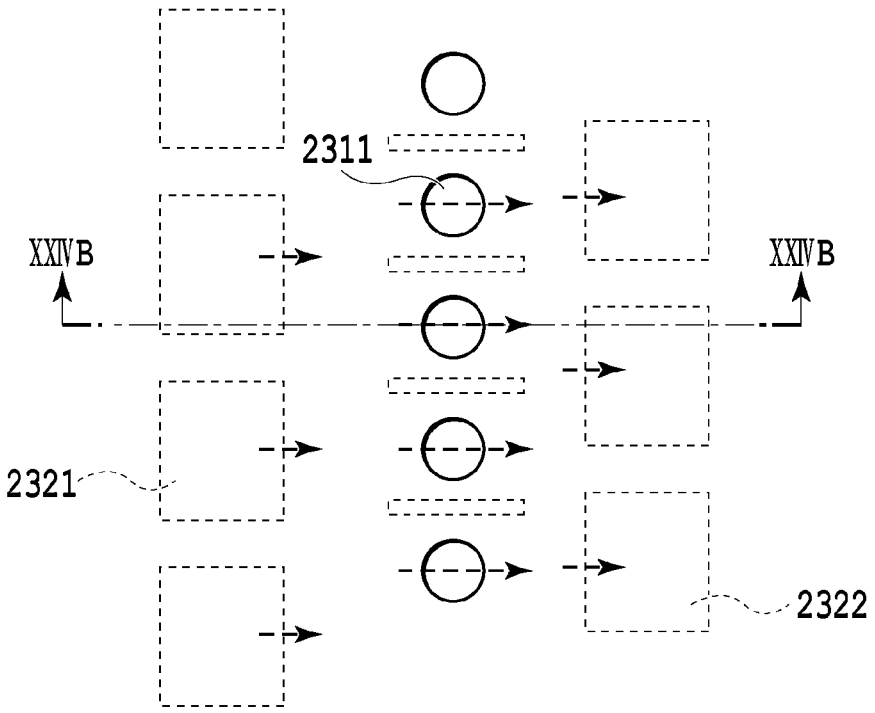
FIGS. 24A and 24B are diagrams illustrating a nozzle portion of the liquid ejection head according to the embodiment.
Figure 24B:
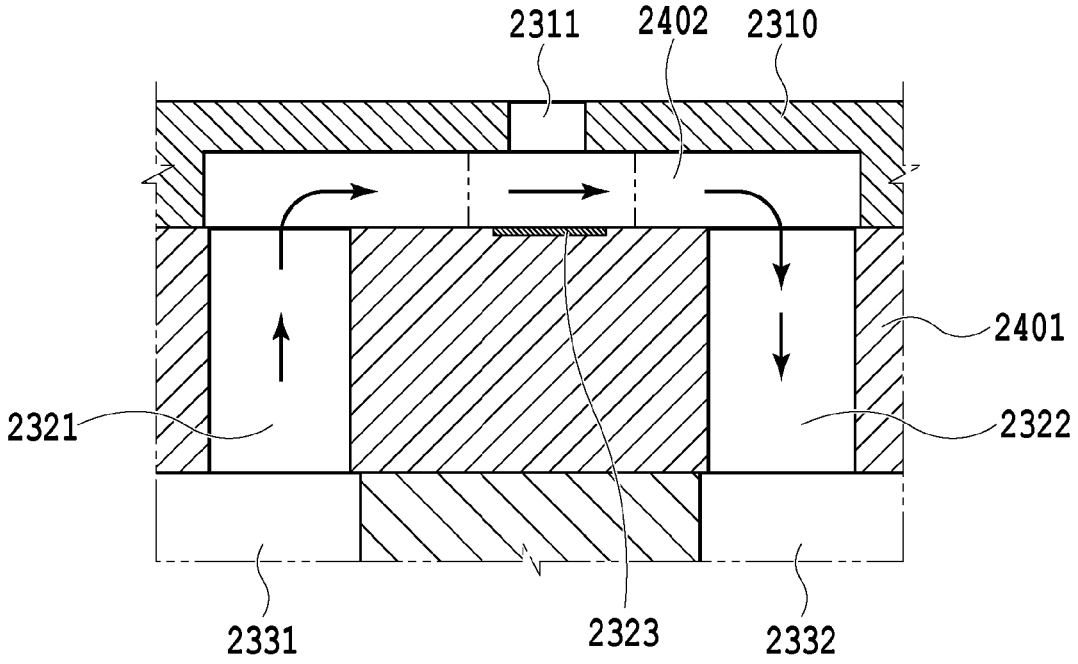

FIG. 24A is a top view illustrating a nozzle portion of the liquid ejection head 400 according to the embodiment and FIG. 24B is a cross-sectional view taken along a line XXIVB-XXIVB of FIG. 24A. The nozzle portion of the liquid ejection head 400 has a configuration in which an ejection opening 2311 and a pressure chamber 2402 filled with a liquid are provided in the ejection opening forming member 2310 on a substrate 2401 provided with a print element 2323 serving as a heating element forming a liquid into bubbles by heat energy. As illustrated in FIG. 23B, the first passage member 2320 is provided with the individual supply passages 2321 and the individual collection passages 2322 in the longitudinal direction. Further, a plurality of partition walls 2324 are provided in the longitudinal direction between the individual supply passages 2321 and the individual collection passages 2322 on the first passage member 2320. The partition wall 2324 serves as a part of a wall of the pressure chamber 2402. In each pressure chamber, the ejection opening 2311 is formed at a position facing the print element 2323. In order to form an image on the printing medium on the basis of image data included in a printing job corresponding to a printing target acquired by the printing apparatus, one or a plurality of the print elements 2323 are selectively driven and the ink is ejected from the ejection opening corresponding to the driven print element 2323. Further, as described above, the liquid ejection head 400 includes a heating heater which increases the temperature of the liquid ejection head 400, but the print element 2323 may be used as the heating heater.

Figure 25:
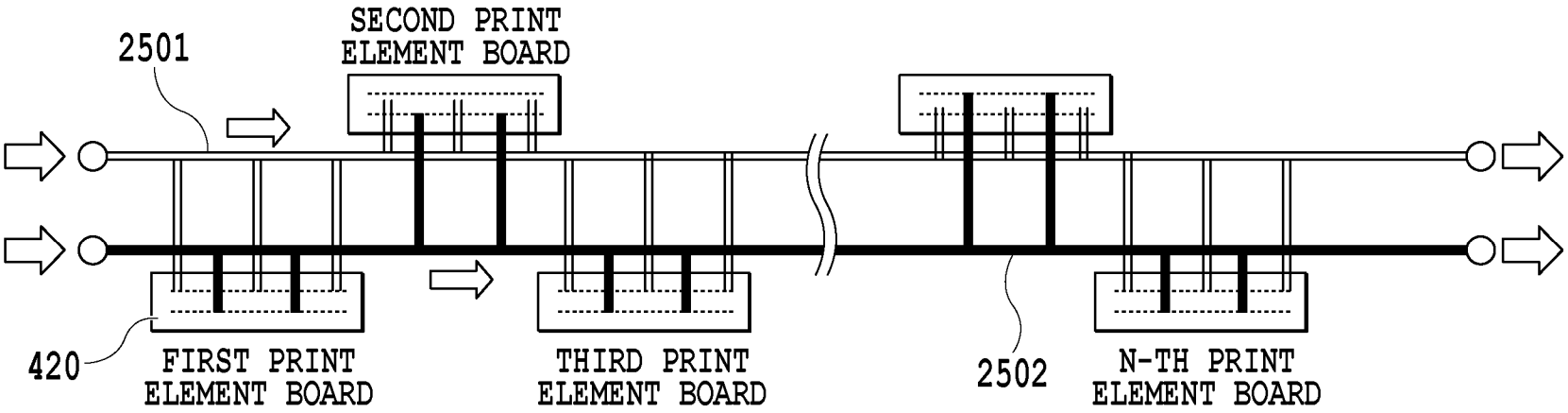
FIG. 25 is a schematic diagram illustrating a passage inside a liquid ejection unit according to the embodiment.

FIG. 25 is a schematic diagram illustrating a passage inside the liquid ejection unit by focusing on a common passage which supplies a liquid to each print element board inside the liquid ejection unit, a common passage which collects a liquid from each print element board, and the print element boards. As illustrated in FIG. 25, in the embodiment, a common supply passage 2501 which supplies a liquid to each print element board and a common collection passage 2502 which collects a liquid from each print element board are provided inside the liquid ejection unit similarly to the first embodiment. In each print element board 420, the liquid flowing through the common supply passage 2501 is drawn through the communication openings 2341*a* and 2341*b* to be circulated inside the print element board and is discharged through the communication openings 2342*a* and 2342*b* (see FIG. 23D). Hereinafter, this configuration will be described in detail.

The liquid flows in one direction at all times in the common supply passage 2501 and the common collection passage 2502, but a differential pressure (a difference in pressure) is generated between the common supply passage 2501 and the common collection passage 2502 by a negative pressure control unit to be described later. By the differential pressure, a flow from the common supply passage 2501 to the common collection passage 2502 is generated. That is, the liquid flows in order of the common supply passage 2501, the communication openings 2341*a* and 2341*b*, the common supply passage 2331, the individual supply passage 2321, the pressure chamber 2402, the individual collection passage 2322, the common collection passage 2332, the communication openings 2342*a* and 2342*b*, and the common collection passage 2502.

A difference in pressure between the common supply passage 2501 and the common collection passage 2502 is set so that a flow rate inside the pressure chamber 2402 becomes about several millimeters per second to several tens of millimeters per second. In the embodiment, the passage height (indicated by $h_1$ in FIG. 24B) of the nozzle portion is set to several micrometers to several tens of micrometers, the orifice thickness (indicated by $h_2$ in FIG. 24B) of the ejection opening 2311 is set to several micrometers, and the orifice thickness of the ejection opening 2311 is set to be smaller than the passage height of the nozzle portion. With such a configuration, when the ink is circulated inside the print element board 420, fresh ink is supplied to the front end of the nozzle. Accordingly, a sufficient ink circulation effect having a certain circulation flow rate (about several millimeters per second) or more can be obtained. Meanwhile, the evaporation of the volatile component (moisture) in the ink from the nozzle is promoted and thus the concentration (the color concentration) of the ink increases.

In addition, in the nozzle which is not applied to the embodiment and has a configuration in which the orifice thickness is several tens of micrometers and the orifice thickness of the ejection opening is larger than the passage height of the nozzle portion, the circulation flow cannot move to the front end of the ejection opening and thus the ink circulation effect becomes weak. Here, since the evaporation of the ink from the nozzle in accordance with an increase in concentration of the ink at the front end of the ejection opening is suppressed, an influence of the circulation of the ink on an increase in concentration decreases.

(Description of Circulation Configuration)

Figure 26:
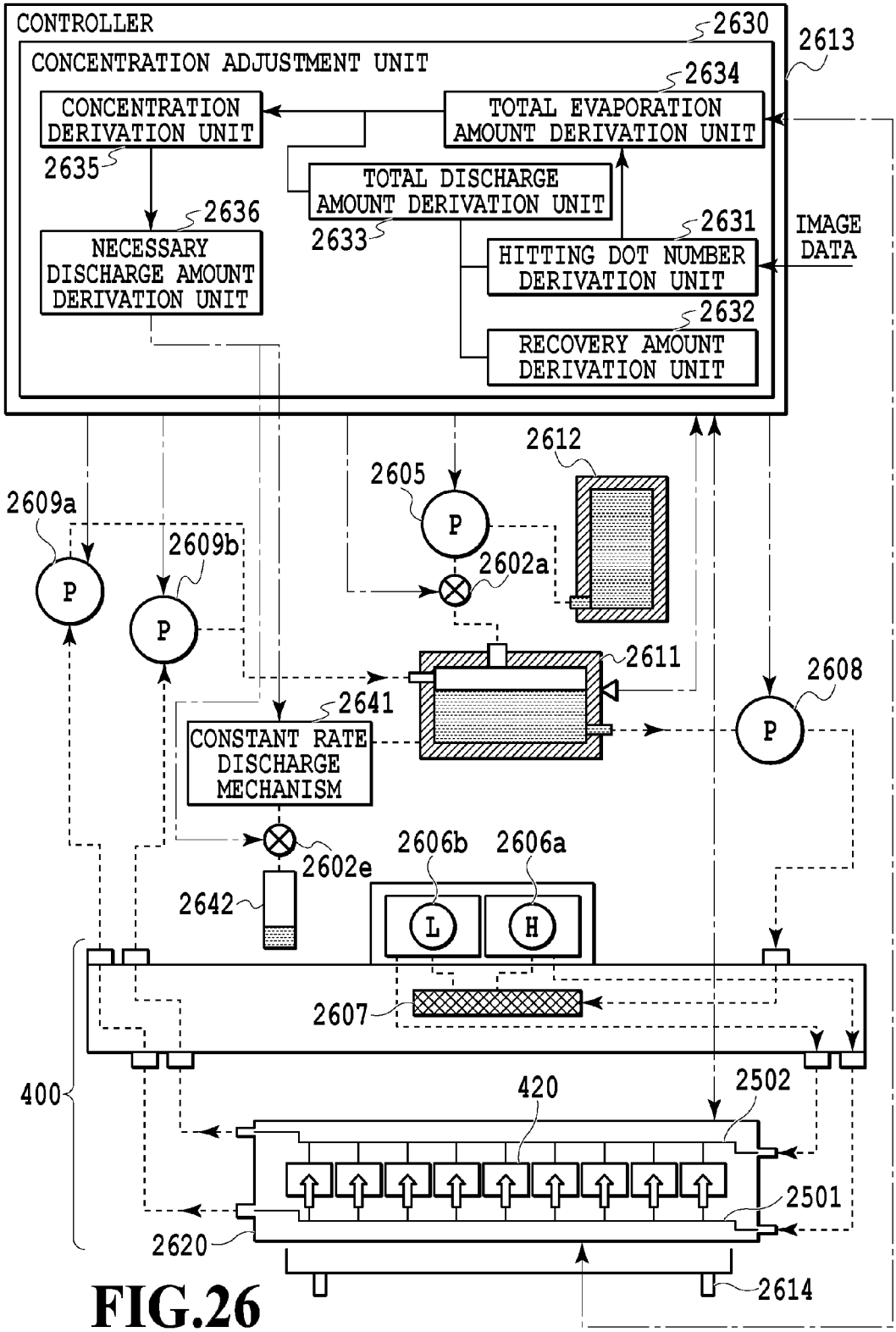
FIG. 26 is a schematic diagram illustrating a circulation configuration according to the embodiment.

FIG. 26 is a schematic diagram illustrating an example of a circulation system applied to the printing apparatus according to the embodiment. As illustrated in FIG. 26, the liquid ejection head 400 is fluid-connected to a first circulation pump (at the high pressure side) 2609*a*, a first circulation pump (at the low pressure side) 2609*b*, a buffer tank 2611, and a second circulation pump 2608. Further, an openable cap 2614 is attached to the liquid ejection head 400 in order to suppress an evaporation of the liquid from the nozzle. In order to wet a space inside the cap while closing the cap 2614, an absorbing member that absorbs the liquid is disposed inside the cap 2614 or humid air is supplied thereto to suppress the evaporation of the liquid of the nozzle. Further, the printing apparatus of the embodiment includes a controller 2613 which generally controls components constituting the circulation system. The controller 2613 includes a CPU, a ROM, and a RAM (not illustrated) and executes a program by loading the program stored in the ROM onto the RAM. Accordingly, the controller 2613 generally controls the printing apparatus such as realizing a concentration adjustment unit 2630. The components of the concentration adjustment unit 2630 and the operations thereof will be described in detail later.

The liquid which is pressurized by the second circulation pump 2608 serving as a constant pressure pump is supplied to the liquid ejection head 400, passes through a filter 2607, and is supplied to a negative pressure control unit 2606*a* or a negative pressure control unit 2606*b*. In each of the negative pressure control unit 2606*a* and the negative pressure control unit 2606*b*, a negative pressure at the downstream side of the negative pressure control unit is set to a predetermined negative pressure. Here, the negative pressure control unit 2606*a* at the high pressure side among two negative pressure control units is connected to the upstream side of the common supply passage 2501 inside the liquid ejection unit 2620 and the negative pressure control unit 2606*b* at the low pressure side is connected to the upstream side of the common collection passage 2502. Accordingly, a differential pressure is generated between the common supply passage 2501 and the common collection passage 2502 and a flow is generated in order of the common supply passage 2501, the print element board 420, and the common collection passage 2502. In a case where the differential pressure between the common supply passage 2501 and the common collection passage 2502 is adjusted by the control of the negative pressure control units 2606*a* and 2606*b*, a circulation flow rate of the nozzle portion can be set to a desired flow rate.

The first circulation pumps 2609*a* and 2609*b* are provided at the downstream side of the liquid ejection head 400. Two first circulation pumps are constant rate pumps and draw the liquid from the common passage inside the liquid ejection head 400 at a constant flow rate so that the liquid is collected to the buffer tank 2611. The negative pressure at the downstream side of the negative pressure control units 2606*a* and 2606*b* and the flow rate of the liquid drawn by the first circulation pump (the constant rate pump) are set so that a negative pressure is generated inside the nozzle and an ejection characteristic is not influenced in a circulation state and an ink ejection state.

The liquid which is collected to the buffer tank 2611 is pressurized again by the second circulation pump 2608 and is supplied to the liquid ejection head 400. In this way, in the circulation system according to the embodiment, the liquid flows in order of the buffer tank 2611, the second circulation pump 2608, the liquid ejection head 400, the first circulation pumps 2609*a* and 2609*b*, and the buffer tank 2611. Further, in the circulation system, the constant pressure pump is used at the upstream side of the liquid ejection head and the constant rate pump is used at the downstream side thereof. However, the embodiment can be also applied to the other circulation systems, such as the circulation system having a configuration in which the constant rate pump is used at the upstream side of the liquid ejection head and the constant pressure pump is used at the downstream side thereof.

A constant rate discharge mechanism 2641 is connected to the buffer tank 2611. The constant rate discharge mechanism 2641 draws a predetermined amount of ink from the buffer tank 2611 in accordance with a control instruction from the concentration adjustment unit 2630 so that the ink is collected to a collection container 2642. The ink which is collected to the collection container 2642 is discarded. In the embodiment, the ink is discharged from the inside of the circulation system by such a configuration. As a constant rate measurement method which is performed by the constant rate discharge mechanism 2641, a method of drawing the ink by a syringe at a constant rate, a method of measuring the amount of the ink by weight, or a method of obtaining a flow rate by a flow rate sensor may be used. Alternatively, a method of discharging the ink from the nozzle by an ink ejection (referred to as a "preliminary ejection") not used to form an image may be employed instead of the constant rate discharge mechanism 2641. When the ink reduction amount from the circulation system becomes a predetermined amount or more, this reduction state is detected by a detector (a sensor) provided in the buffer tank 2611 and of the ink is replenished from the main tank 2612 by an insufficient amount. The detector provided in the buffer tank 2611 is not particularly limited. For example, various known methods using a floating detector, an ultrasonic detector, and an electrostatic capacitance detector may be used. Further, a detector measuring the weight of the buffer tank 2611 may be also used.

A change in color concentration of the ink in such a circulation system is expressed by Equation (1) below.

$$w_{pig}(t) = \left(w_{pig}0 - \frac{Q}{Q1} \cdot w_{pig}0\right) \cdot \exp\left(\frac{-Q1}{w_{sub}} \cdot t\right) + \frac{Q}{Q1} \cdot w_{pig}0 \quad \text{[Equation (1)]}$$

Here, $W_{pig}(t)$ [wt %] indicates the color concentration of the ink inside the buffer tank 2611. $W_{pig}0$ [wt %] indicates the color concentration of the ink inside the main tank 2612. $W_{sub}$ [g] indicates the capacity of the buffer tank 2611. Q1 [g/sec] indicates the sum of the amount of the ink ejected per second and the amount (the recovery use amount) used for the recovery. Q2 [g/sec] indicates the evaporation amount per second (hereinafter, referred to as an "evaporation speed"). Q (=Q1+Q2) [g/sec] indicates the amount of the ink replenished from the main tank 2612 per second. t [sec] indicates the elapse time. The right side of Equation (1) converges on $Q/Q1 \cdot W_{pig}0$ when the value of t increases.

(Description of Adjustment of Concentration)

Figure 27:
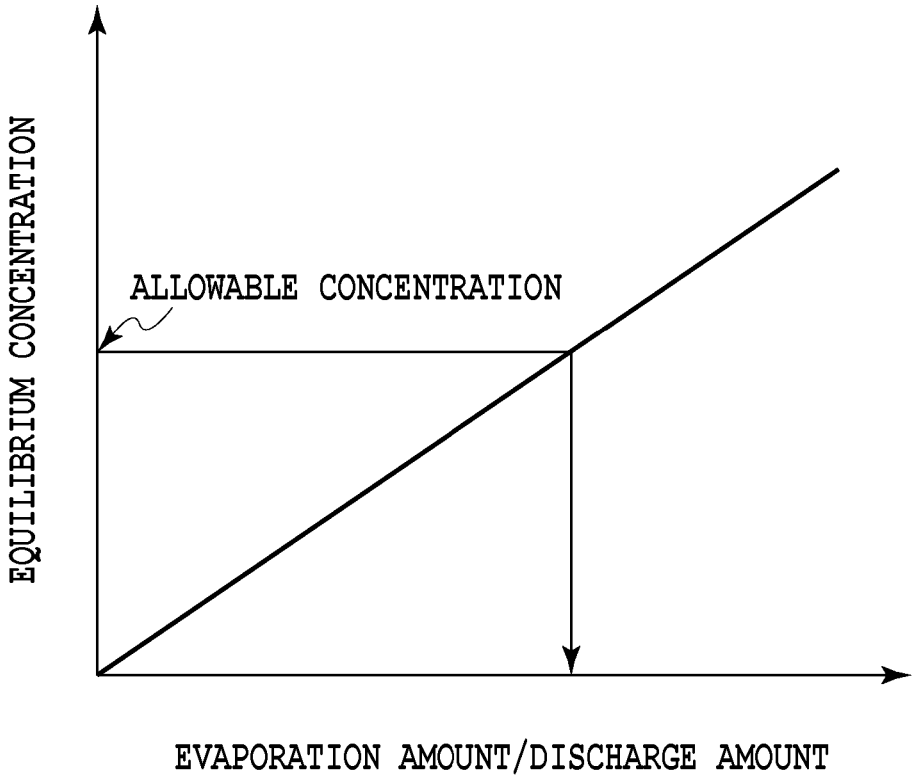
FIG. 27 is a diagram illustrating a relation between an evaporation amount/a discharge amount and an equilibrium concentration according to the embodiment.

FIG. 27 is a graph illustrating a relation between an evaporation amount/a discharge amount and a color concentration (referred to as an equilibrium concentration in FIG. 27) in the ink in an equilibrium state of the circulation system. In a case where an allowable concentration is set, the value of the evaporation amount/the discharge amount is uniquely set. The allowable concentration indicates a concentration capable of keeping the image quality and is set on the basis of evaporation viscosity characteristics of the ink, a shape of the nozzle, and ejection characteristics such as an ejection speed or a refill speed. In the embodiment, a threshold value (hereinafter, referred to as a "predetermined concentration") set for the after-mentioned adjustment of the concentration is set to a value lower than the allowable concentration and a control is performed so that a color concentration (hereinafter, referred to as an "ink concentration") in the ink inside the circulation system does not exceed the allowable concentration. Specifically, a total discharge amount inside the circulation system obtained by the sum of the discharge amount for the ink ejection operation and the consumption amount for the suction and recovery operation and a total evaporation amount in the circulation system are derived and a current ink concentration in the circulation system is predicted on the basis of the derived total discharge amount and the derived total evaporation amount. Then, the ink is discharged from the inside of the circulation system so that the ink concentration inside the circulation system does not exceed the allowable concentration in response to the predicted ink concentration and fresh ink is replenished from the outside of the circulation system to adjust the ink concentration inside the circulation system. A mechanism for adjusting the concentration is the concentration adjustment unit 2630.

As described above, the printing apparatus according to the embodiment includes the controller 2613 and the controller 2613 includes the concentration adjustment unit 2630 (see FIG. 26). As illustrated in FIG. 26, the concentration adjustment unit 2630 includes a hitting dot number derivation unit 2631, a recovery amount derivation unit 2632, a total discharge amount derivation unit 2633, a total evaporation amount derivation unit 2634, a concentration derivation unit 2635, and a necessary discharge amount derivation unit 2636. Hereinafter, the components of the concentration adjustment unit 2630 will be described.

The hitting dot number derivation unit 2631 acquires image data of a printing target and drives the number of hitting dots necessary to form an image according to the image data on the basis of the acquired image data by calculation or the like. Next, the hitting dot number derivation unit 2631 transmits the derived number of hitting dots to the total discharge amount derivation unit 2633 and the total evaporation amount derivation unit 2634.

The recovery amount derivation unit 2632 derives the recovery amount by cumulatively adding the ink amount used for the suction and recovery operation in the liquid ejection head. Next, the recovery amount derivation unit 2632 transmits the derived recovery amount to the total discharge amount derivation unit 2633.

The total evaporation amount derivation unit 2634 calculates a printing duty (=the liquid droplet amount for the ink hitting operation of each nozzle×the number of hitting dots) on the basis of the number of hitting dots. Next, the total evaporation amount derivation unit 2634 calculates the number of the nozzles (hereinafter, a nozzle which does not eject the ink will be referred to as a "non-ejection nozzle" and a nozzle which ejects the ink will be referred to as an "ejection nozzle") which are not used for the image forming operation and do not eject the ink on the basis of the calculated printing duty. Next, the total evaporation amount derivation unit 2634 derives the evaporation amount from the non-ejection nozzle while an image is formed by the ink ejected from the ejection nozzle by calculating or the like on the basis of the calculated number of the non-ejection nozzles. Additionally, in a case where the evaporation amount from the non-ejection nozzle is derived, the temperature and the humidity of the liquid ejection head 400 may be monitored and the evaporation amount may be corrected on the basis of a table illustrating a relation among the temperature, the humidity, and the evaporation amount. Further, the total evaporation amount derivation unit 2634 also derives the evaporation amount of all nozzles immediately before and after the image forming operation using the ejected ink by calculating, referring to the table or the like in addition to the evaporation amount from the non-ejection nozzle while an image is formed by the ejected ink. Here, a constant value may be used as the evaporation amount from all nozzles immediately before and after the image forming operation using the ejected ink. Finally, the total evaporation amount derivation unit 2634 adds the evaporation amount from all nozzles immediately before and after the image forming operation using the ejected ink and the evaporation amount from the non-ejection nozzle while an image is formed by the ink ejected from the ejection nozzle. Accordingly, the total evaporation amount derivation unit 2634 derives the total evaporation amount from the inside of the circulation system. The total evaporation amount derivation unit 2634 transmits the derived total evaporation amount to the concentration derivation unit 2635.

The total discharge amount derivation unit 2633 derives the amount of the ink discharged from the circulation system (the total discharge amount from the circulation system) on the basis of at least one of the number of hitting dots and the recovery amount. Specifically, the total discharge amount derivation unit 2633 calculates the discharge amount for the ink ejection operation by multiplying the number of hitting dots by the known liquid droplet amount for the ink hitting operation of each nozzle. Next, the total discharge amount derivation unit 2633 derives the total discharge amount from the inside of the circulation system by adding the calculated discharge amount for the ink ejection operation and the recovery amount and transmits the derived total discharge amount to the concentration derivation unit 2635. Additionally, in a case where the temperature of the liquid ejection head changes, the total discharge amount derivation unit 2633 can correct the discharge amount for the ink ejection operation by using a relation (an equation or a table), being prepared in advance, between the temperature and the liquid droplet amount for the ink hitting operation of each ejection nozzle.

The concentration derivation unit 2635 derives (predicts) the ink concentration of the circulation system on the basis of the total evaporation amount transmitted from the total evaporation amount derivation unit 2634 and the total discharge amount transmitted from the total discharge amount derivation unit 2633 and transmits the derived ink concentration to the necessary discharge amount derivation unit 2636. In the specification, the concentration which is derived by the concentration derivation unit 2635 will be referred to as a "predicted concentration". Here, as a unit that derives the ink concentration, the concentration derivation unit that predicts the ink concentration of the circulation system on the basis of the total evaporation amount and the total discharge amount has been employed. However, a concentration sensor that actually measures the concentration may be used instead of such a concentration derivation unit. As the concentration sensor, for example, an optical sensor which obtains the concentration on the basis of a relation between the concentration and the transmitted light amount by causing measurement light emitted from a light emitting element to be incident to a passage formed by a light transmissive member such as glass and measuring the amount of transmitted light by a light receiving element may be used. Alternatively, as the concentration sensor, a sensor which measures ink conductivity may be used. If the concentration can be directly measured, an arbitrary sensor may be used.

The necessary discharge amount derivation unit 2636 determines whether the concentration of the circulation system needs to be adjusted on the basis of a predetermined concentration and a predicted concentration transmitted from the concentration derivation unit 2635. Then, in a case where the concentration of the circulation system needs to be adjusted, the necessary discharge amount derivation unit 2636 derives the amount (hereinafter, referred to as a "necessary discharge amount") of the ink discharged from the inside of the circulation system.

(Description of Concentration Adjustment Process)

Figure 28:
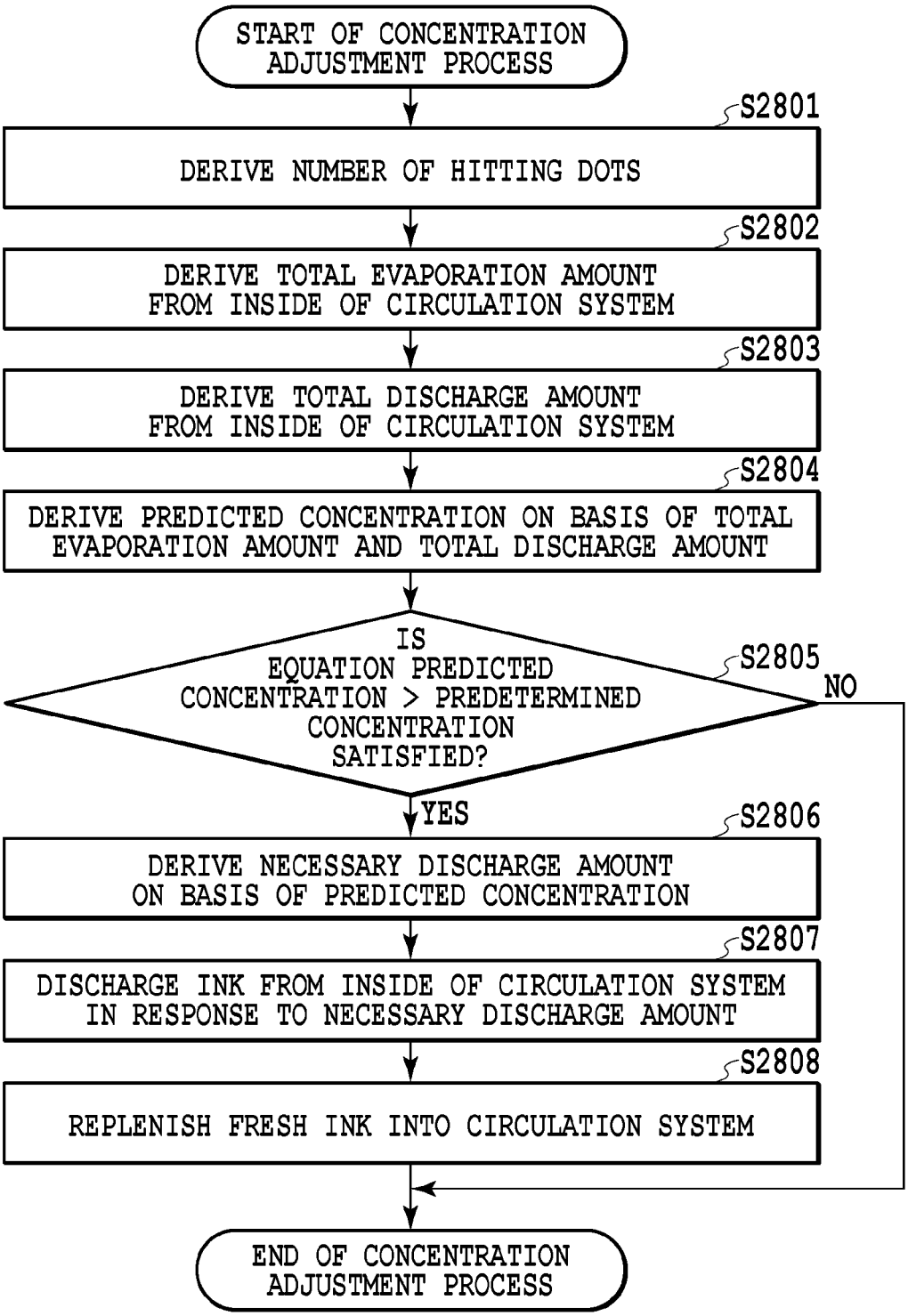
FIG. 28 is a flowchart illustrating a concentration adjustment process according to the embodiment.

Hereinafter, a concentration adjustment process according to the embodiment will be described. FIG. 28 is a flowchart illustrating a sequence of the concentration adjustment process according to the embodiment.

In step S2801, the hitting dot number derivation unit 2631 derives the number of hitting dots on the basis of the image data of the printing target.

In step S2802, the total evaporation amount derivation unit 2634 derives the evaporation amount from the non-ejection nozzle while an image is formed by the ink ejected from the ejection nozzle on the basis of the number of hitting dots and the temperature of the liquid ejection head 400. Further, the total evaporation amount derivation unit 2634 derives the evaporation amount from all nozzles immediately before and after the image forming operation using the ejected ink on the basis of the temperature of the liquid ejection head 400. Then, the total evaporation amount derivation unit 2634 derives the total evaporation amount from the inside of the circulation system by adding the evaporation amounts.

In step S2803, the total discharge amount derivation unit 2633 calculates the discharge amount for the ink ejection operation by multiplying the number of hitting dots and the known liquid droplet amount for the ink hitting operation of each nozzle. Then, the total evaporation amount derivation unit 2634 derives the total discharge amount from the inside of the circulation system by adding the calculated discharge amount for the ink ejection operation and the recovery amount transmitted from the recovery amount derivation unit 2632.

In step S2804, the concentration derivation unit 2635 predicts the ink concentration inside the circulation system on the basis of the total discharge amount and the total evaporation amount (the derivation of the predicted concentration).

In step S2805, the necessary discharge amount derivation unit 2636 determines whether the predicted concentration is larger than a predetermined concentration. In a case where the determination result is true, a routine proceeds to step S2806. Meanwhile, in a case where the determination result is false, a series of processes end.

In step S2806, the necessary discharge amount derivation unit 2636 derives the necessary discharge amount on the basis of the predicted concentration by using Equation (2) below.

$$\text{Necessary Discharge Amount} = \text{Volume of Ink inside Circulation System} \cdot (\text{Predicted Concentration} - \text{Predetermined Concentration}) / (\text{Predicted Concentration} - \text{Ink Concentration inside Main Tank } 2612) \quad \text{Equation (2)}$$

In step S2807, the concentration adjustment unit 2630 discharges the ink from the buffer tank 2611 according to the necessary discharge amount by using the constant rate discharge mechanism 2641.

In step S2808, the concentration adjustment unit 2630 opens a valve 2602*a* and replenishes fresh ink from the main tank 2612 to the buffer tank 2611 by the necessary discharge amount.

The above-described process is the concentration adjustment process according to the embodiment. In addition, timing for performing the concentration adjustment process is not particularly limited. For example, the concentration adjustment process may be automatically performed every predetermined period or predetermined number of sheets. Further, the printing apparatus may include a plurality of timing determination units and perform the concentration adjustment process by selectively using any one of the timing determination units.

Figure 29:
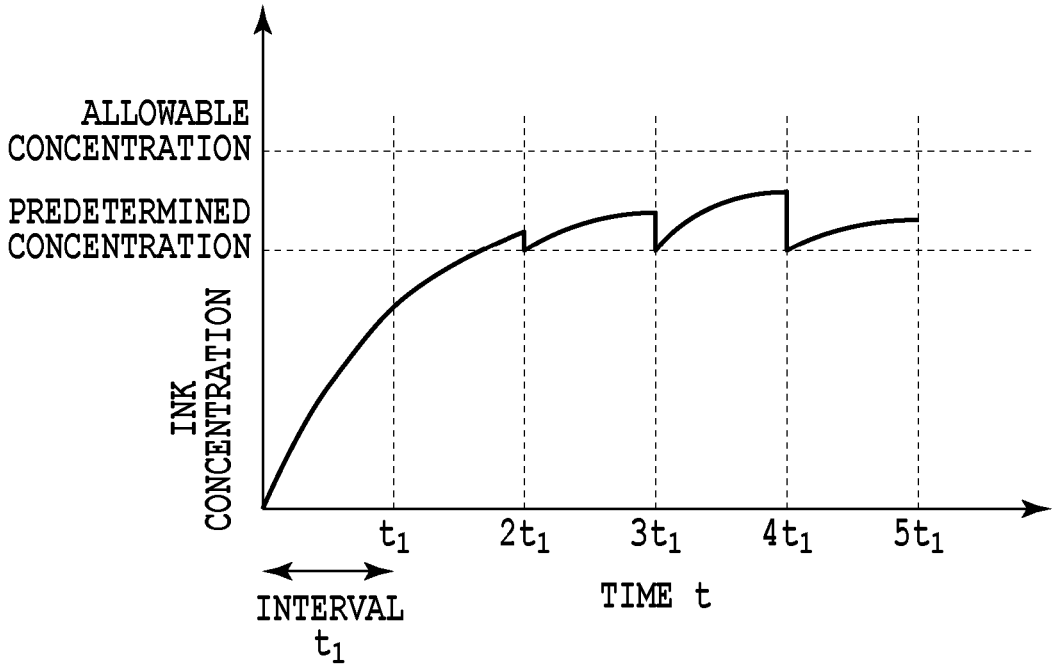
FIG. 29 is a diagram illustrating an example of a change in concentration in a case where the concentration adjustment process according to the embodiment is performed.

FIG. 29 is a schematic diagram illustrating an example of a change in concentration in a case where the above-described concentration adjustment process is performed. Here, an interval of the concentration adjustment process is set to $t_1$. As illustrated in FIG. 29, the ink concentration increases from the initial concentration in accordance with the evaporation from the nozzle. At a first detection timing ($t=t_1$), since the ink concentration does not reach a predetermined concentration, the discharging ink from the circulation system and the replenishing fresh ink to the circulation system (S2807 and S2808 of FIG. 28) are not processed. At a next detection timing ($t=t_2$), since the ink concentration is higher than the predetermined concentration, the ink is discharged from the circulation system and the fresh ink is replenished to the circulation system (S2807 and S2808 of FIG. 28) so that the ink concentration of the circulation system falls to the predetermined concentration. Even at a next detection timing ($t=t_3$), since the ink concentration is higher than a predetermined value, the ink is discharged from the circulation system and the fresh ink is replenished to the circulation system (S2807 and S2808 of FIG. 28). In this way, by discharging the thick ink and replenishing the fresh ink, the ink concentration does not exceed the allowable concentration and thus an increase in ink concentration inside the circulation system can be suppressed. Additionally, an equation (an equation used in S2806 of FIG. 28) is not limited to Equation (2) that calculates the amount (the necessary discharge amount) of the ink discharged by the ink discharge process (S2807 of FIG. 28) and the other equations may be used. For example, an equation may be used which calculates a necessary discharge amount in which the ink concentration becomes lower than a predetermined concentration after the adjustment of the concentration.

(Description of Printing Process)

Figure 30:
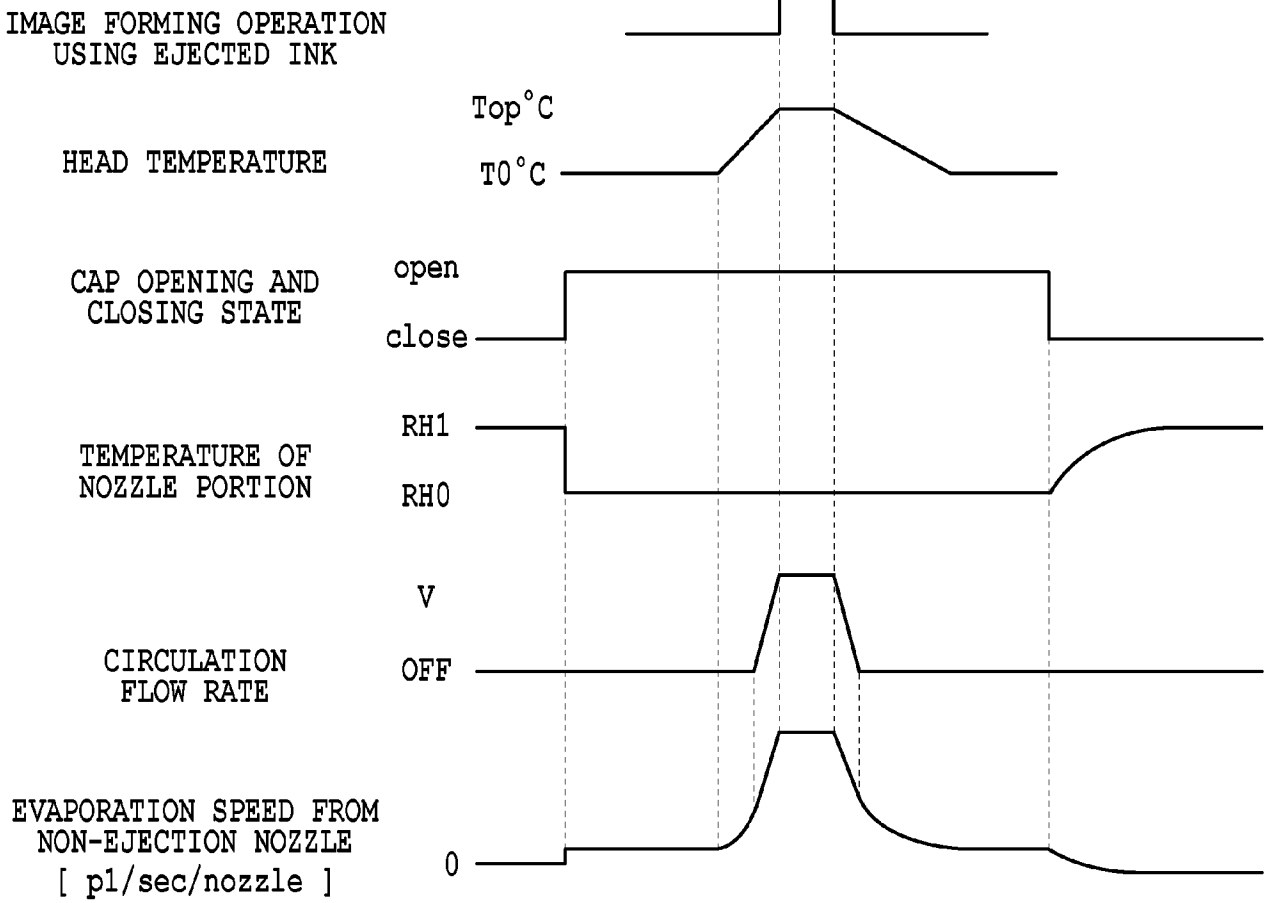
FIG. 30 is a timing chart illustrating a process at the time of printing of the printing apparatus according to the embodiment.

FIG. 30 is a timing chart illustrating a process at the time of printing of the printing apparatus according to the embodiment.

In the embodiment, a state of the printing apparatus before the printing apparatus receives the printing job will be referred to as a "standby state". Further, when the printing apparatus is in the standby state, the operations of the first circulation pump 2609*a* and the first circulation pump 2609*b* are stopped to stop the circulation flow of the ink. At this time, the temperature of the liquid ejection head 400 in the standby state is set to T0 and the humidity of the nozzle portion in the standby state is set to RH1. When the printing apparatus receives the printing job, the cap 2614 is opened. When the cap 2614 is opened, the humidity of the nozzle portion is equal to the humidity (RH0) of the environment provided with the printing apparatus and thus the ink evaporates from the nozzle.

When the circulation flow is generated, the evaporation speed at the nozzle steeply increases. Thus, an operation of increasing the temperature of the liquid ejection head 400 is started before the generation of the circulation flow in order to shorten a circulation flow generation period (the heating heater is turned on). In the embodiment, an output of a diode sensor provided in the print element board 420 is read by a controller 2613 to detect the temperature of the liquid ejection head 400. In addition, a temperature detector is not limited to the diode sensor and the other sensors may be used. The controller 2613 controls the ON/OFF state of the heating heater provided inside the liquid ejection head 400 in response to a detected temperature to adjust the temperature of the liquid ejection head 400.

The controller 2613 operates the first circulation pump 2609*a* and the first circulation pump 2609*b* after turning on the heating heater. Accordingly, the ink flows through the passage inside the liquid ejection head 400 and the above-mentioned circulation flow of the ink is generated by the ink flowing through the passage inside the nozzle (the start of the circulation). In the embodiment, the circulation flow rate reaches a predetermined speed (set as "V") within one second after the circulation starts. Here, a time in which the temperature of the liquid ejection head 400 reaches a predetermined temperature (set as "$T_{op}$") and a time in which the circulation flow rate reaches the predetermined speed V can be checked by a previous examination or the like. Thus, the first circulation pumps 2609*a* and 2609*b* are operated to start the circulation after a certain time elapses from the timing of turning on the heating heater so that a timing in which the temperature of the liquid ejection head 400 reaches the predetermined temperature $T_{op}$ and a timing in which the circulation flow rate reaches the predetermined speed V are substantially equal to each other. At the timing in which the temperature of the liquid ejection head 400 reaches the predetermined temperature $T_{op}$ and the circulation flow rate reaches the predetermined speed V, the image forming operation of ejecting the ink is started. Further, in FIG. 30, the image forming operation of ejecting the ink is started at the same time when the temperature of the liquid ejection head 400 reaches the predetermined temperature $T_{op}$ and the circulation flow rate reaches the predetermined speed V. However, the image forming operation of ejecting the ink may be started at an arbitrary timing if the temperature of the liquid ejection head 400 reaches the predetermined temperature $T_{op}$ and the circulation flow rate reaches the predetermined speed V. Here, from the viewpoint of suppressing the evaporation, it is desirable that a time taken until the image forming operation starts from a state where the temperature of the liquid ejection head 400 reaches the predetermined temperature $T_{op}$ and the circulation flow rate reaches the predetermined speed V be set as short as possible.

An evaporation component from the circulation system during the ink ejecting operation (the image forming operation) mainly corresponds to an evaporation component from the non-ejection nozzle that is not used for the image forming operation and does not eject the ink. The evaporation of the ink from the non-ejection nozzle increases the concentration of the ink inside the circulation system. Since the circulation flow rate of each nozzle cannot be individually controlled, the evaporation speed for each non-ejection nozzle during the ink ejecting operation (the image forming operation) is constant.

After the ink ejecting operation (the image forming operation) ends, the operations of the first circulation pumps 2609*a* and 2609*b* are stopped to stop the circulation. A time necessary until the circulation flow inside the nozzle completely stops is within one second. As illustrated in FIG. 30, when the operations of the first circulation pumps 2609*a* and 2609*b* are stopped, the evaporation speed at the non-ejection nozzle steeply decreases.

Next, the controller 2613 closes the cap 2614 of the liquid ejection head. Accordingly, the humidity of the nozzle portion increases to be recovered to the humidity RH1 before the printing job is received (in the standby state) and the evaporation speed at the non-ejection nozzle converges to zero. Finally, the printing apparatus returns to a standby state.

(Description of Other Concentration Adjustment Methods)

Hereinafter, a simpler concentration adjustment method will be described. In the above-described concentration adjustment process, the concentration is adjusted in such a manner that the ink concentration of the circulation system is predicted on the basis of the total evaporation amount and the total discharge amount in the circulation system, the thick ink is collected from the circulation system on the basis of the predicted concentration, and the fresh ink is replenished on the basis of the predicted concentration (see FIG. 28). Regarding a use condition herein, the recovery amount and the evaporation amount from all nozzles immediately before and after the image forming operation using the ejected ink are set to substantially fixed values. In this case where, a value which changes depending on the use condition includes the discharge amount for the ink ejection operation and the evaporation amount from the non-ejection nozzle during the image forming operation using the ejected ink in accordance with the printing duty. In a case where the printing duty is low, since the number of the non-ejection nozzles is large, the evaporation amount during the image forming operation using the ejected ink increases and thus the ink concentration inside the circulation system easily increases. On the contrary, in a case where the printing duty is high, since the discharge amount from the circulation system increases and thus the evaporation amount during the image forming operation using the ejected ink decreases, an increase in ink concentration inside the circulation system is suppressed.

Figure 31:
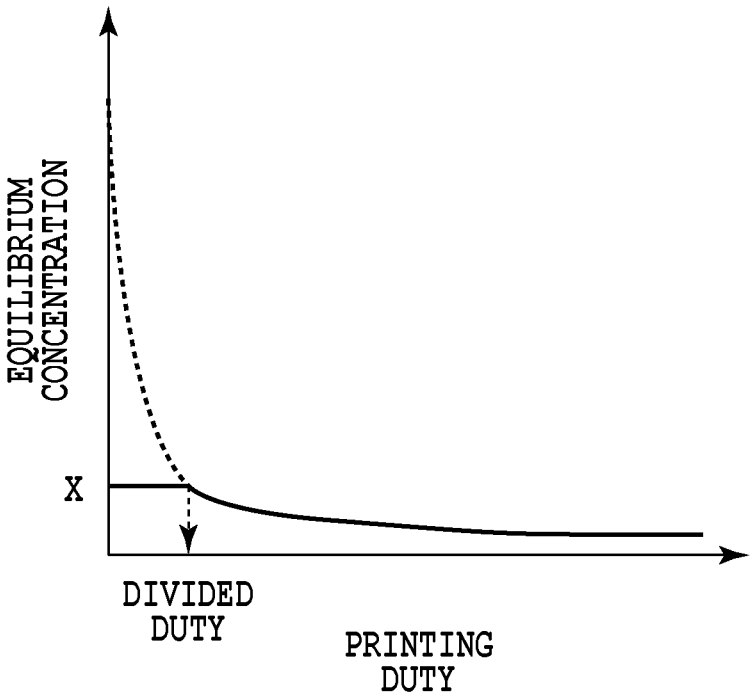
FIG. 31 is a diagram illustrating a relation between a printing duty and an equilibrium concentration according to the embodiment.

FIG. 31 is a diagram illustrating a relation between the printing duty and the ink concentration (the equilibrium concentration) to be converged within the circulation system in a certain use condition. Here, in a case where the equilibrium concentration of X % is set to an allowable concentration, it is assumed that the printing duty of 2% is a reference value (hereinafter, referred to as a "divided duty") of the printing duty capable of keeping the ink concentration inside the circulation system to the allowable concentration or less. At this time, in a case where an image is printed on the basis of the image data of the printing duty which is smaller than the divided duty (the reference value), the ink is ejected by the preliminary ejection or the like other than the image forming operation so as to keep the amount of the used ink equal to the divided duty in accordance with the image forming operation using the ejected ink. Accordingly, the equilibrium concentration can be set to the allowable concentration or less. For example, in a case where the divided duty corresponding to the allowable concentration is 2% and the printing duty of the image data of the printing target is 1%, the ink may be discharged for the preliminary ejection other than the image forming operation by the amount corresponding to a difference of 1%. In this way, the ink concentration of the circulation system can be suppressed to a predetermined value or less only on the basis of the printing duty derived from the image data.

(Description for Case of Small Amount of Ink Inside Main Tank)

Figure 32:
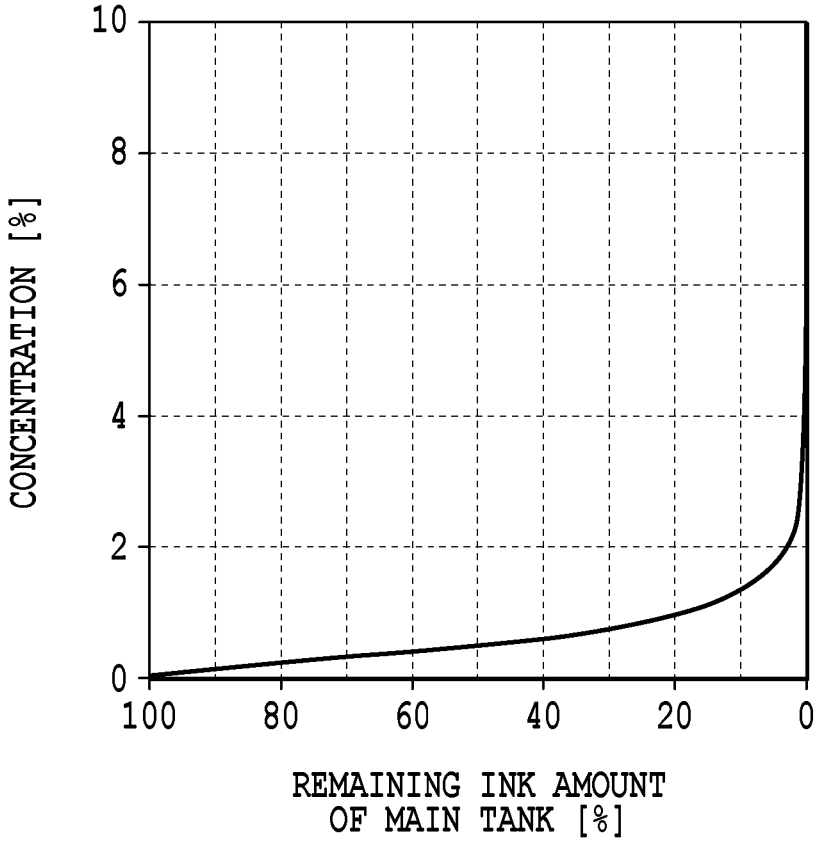
FIG. 32 is a diagram illustrating a relation between a concentration and a remaining ink amount in a main tank.

The ink which is stored in the main tank is thickened due to the evaporation of the volatile component contained in the ink while the printing apparatus is delivered or when the printing apparatus is used. FIG. 32 is a diagram illustrating an influence of the evaporation of the ink in the main tank with respect to the concentration of the ink. Here, a horizontal axis indicates the remaining ink amount and a vertical axis indicates the concentration. Generally, the evaporation speed of the ink in the main tank is small. However, in a case where the printing apparatus is used for a long period of time, the total ink evaporation amount increases and the remaining ink amount decreases. As the remaining ink amount decreases, an increase in ink concentration is remarkably recognized (see FIG. 32).

As described above, in the embodiment, the fresh ink is supplied from the main tank to the circulation system (see FIG. 26). However, in a case where the ink inside the main tank is thickened, the fresh ink is not replenished from the main tank. In a case where the ink inside the main tank is thickened so that the ink concentration increases, the ink having a concentration slightly higher than the assumed concentration is replenished from the main tank. Thus, in order to decrease the ink concentration inside the circulation system to a predetermined concentration, there is a need to increase the discharge amount from the circulation system (and the replenish amount from the main tank to the circulation system). Further, in a case where the ink concentration inside the main tank becomes a predetermined concentration or more in accordance with an increase in ink concentration due to the thickened ink inside the main tank, the concentration of the replenished ink becomes a predetermined concentration or more. Thus, the ink concentration inside the circulation system cannot be decreased to a predetermined concentration. Thus, in a case where the ink inside the main tank is used up, there is a possibility that the ink concentration inside the circulation system may exceed the allowable concentration. In this case, a trouble in image occurs. This problem becomes outstanding in a case where the main tank is large, the remaining ink amount in the main tank is small, and the ink inside the main tank is used up. In order to prevent this problem, the ink inside the main tank may be discarded while not being used completely. However, in this case, a waste ink amount increases.

In order to solve the above-described problems, the embodiment has a configuration in which the printing apparatus includes a plurality of main tanks and the ink is replenished from one of the plurality of main tanks to the circulation system. Then, in a case where the remaining ink amount inside the main tank becomes a predetermined value or less, the ink remaining in the main tank is moved to the circulation system so that the ink is replenished from a different main tank having a sufficient remaining ink amount to the circulation system. Accordingly, the ink concentration inside the circulation system can be suppressed to be smaller than the allowable concentration. The embodiment is particularly suitable for a case where the evaporation amount from the main tank is larger than the evaporation amount from the circulation system or a case where the ink concentration of the main tank increases in accordance with a decrease in remaining ink amount inside the main tank. Additionally, it is desirable that the circulation system have a capacity capable of charging a predetermined amount of the ink remaining in the main tank into the circulation system.

(Description of Efficient Method of Solving Concentration)

As described above with reference to FIG. 30, the evaporation amount steeping increases in the event of the circulation flow. The evaporation amount in the circulation state is large. Then, the ink becomes thickened as the circulation period increases. Thus, it is desirable that the circulation be started immediately before the image forming operation using the ejected ink and the circulation be stopped at the same time when the image forming operation using the ejected ink ends.

FIGS. 33A to 33F are schematic diagrams illustrating a method of solving the concentration of the ink in the nozzle portion and illustrating a difference in concentration solving degree in accordance with the existence of the circulation.

FIG. 33A is a diagram illustrating a state where the ink is thickened at the nozzle portion at the time when the circulation is started. FIG. 33B is a diagram illustrating a state after the state of FIG. 33A, that is, a state where the concentration of the ink is solved by the circulation. FIG. 33C is a diagram illustrating a state after the state of FIG. 33B, that is, a normal state after a predetermined time elapses from the start of the circulation. As illustrated in FIGS. 33A to 33C, the concentration of the ink is solved by the circulation, but a thick component exists at the front end of the ejection opening.

Meanwhile, FIG. 33D is a diagram illustrating a state where the ink is thickened at the nozzle portion after the circulation is stopped. FIG. 33E is a diagram illustrating a state after the state of FIG. 33D, that is, a diagram illustrating a state where the concentration of the ink is solved by the preliminary ejection in the circulation stop state. FIG. 33F is a diagram illustrating a state after the state of FIG. 33E, that is, a state where the concentration of the ink has been solved by the preliminary ejection in the circulation stop state.

Even in a period in which the cap is closed and in a period in which the cap is opened in the non-circulation state, the evaporation of the ink from the ejection opening occurs so that the ink is thickened. Since the ink is basically thickened by a diffusion phenomenon, most of the thick component stays in the nozzle portion and the foaming chamber and thus the thick component does not spread in the entire circulation system. Incidentally, when the circulation is started while the ink is thickened (see FIG. 33A), the thick component staying in the nozzle portion flows toward the downstream side (see FIGS. 33B and 33C). As a result, even though the ink concentration is thinned in the entire circulation system, the thick component spreads in the circulation system and thus dilution efficiency is deteriorated. Here, it is desirable to discharge the thick component from the ejection opening by the preliminary ejection or the like in a case where the ink is thickened in the non-circulation state (see FIG. 33D). Accordingly, the thick component staying in the nozzle portion and the foaming chamber is discharged and thus the thick component does not spread in the entire circulation system. Accordingly, the dilution efficiency is improved and thus the amount of the discarded ink is suppressed. Thus, it is desirable to discharge the thick component, caused by the concentration of the ink during a period in which the cap is closed and a period in which the cap is opened in the non-circulation state, from the ejection opening in the non-circulation state before the start of the circulation by the preliminary ejection or the like.

Figure 34:
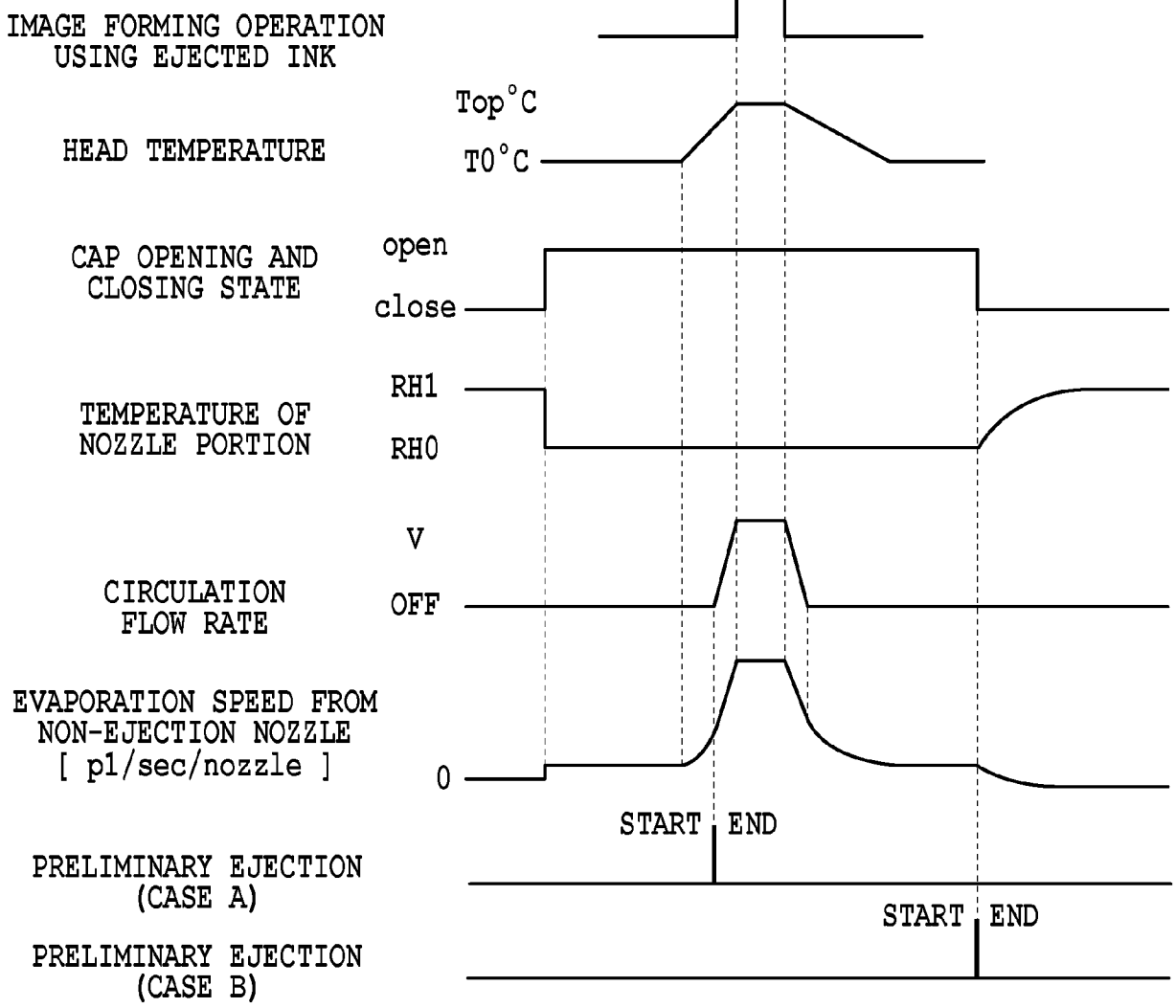
FIG. 34 is a timing chart illustrating a printing process of the printing apparatus according to the embodiment.

FIG. 34 is a timing chart illustrating an example in which the preliminary ejection for the solving of the concentration is added to the sequence illustrated in FIG. 30. As illustrated in FIG. 34, Case A indicates a case where the preliminary ejection is performed immediately before the start of the circulation after the cap is opened. Further, Case B indicates a case where the preliminary ejection is performed after the end of all subsequent steps after the stop of the circulation. From the viewpoint of suppressing the discharge amount, Case A of solving the concentration caused by the evaporation before the start of the circulation is more desirable than Case B. Additionally, the preliminary ejection may be performed at the timing (immediately before the start of the circulation after the cap is opened) illustrated in Case A and the timing (immediately after the end of all subsequent steps after the stop of the circulation) of Case B.

Further, it is desirable to perform the preliminary ejection by using the nozzle which is not frequently used in a case where the ink is discharged by the preliminary ejection. Generally, in the case of the thermal inkjet, a difference in ejection characteristic is caused by the scorch of the surface of the heater between the nozzle ejecting a large number of ink and the nozzle ejecting a small number of ink. As a result, the ejection amount becomes different depending on the nozzle and thus unevenness occurs. Thus, by performing the preliminary ejection by using the nozzle which is not frequently used, a difference in frequency of use among the nozzles can be suppressed while the concentration of the ink in the entire circulation system is solved. Accordingly, the occurrence of unevenness can be easily suppressed.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the present invention, an increase in concentration of the liquid inside the circulation system can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-002882, filed Jan. 8, 2016, which is hereby incorporated by reference wherein in its entirety.

What is claimed is:

1. A printing apparatus that uses a liquid ejection head including an ejection opening ejecting a liquid, a print element generating energy for ejecting a liquid, and a pressure chamber having the print element provided therein, the printing apparatus comprising:

a circulator configured to circulate the liquid so that the liquid passes through the pressure chamber; and a concentration adjustment unit configured to adjust a concentration of a liquid inside a liquid circulation system by discharging the liquid from the inside of the liquid circulation system and replenishing the liquid into the liquid circulation system from the outside of the liquid circulation system in response to the amount of the discharged liquid, wherein the concentration adjustment unit includes a concentration derivation unit configured to derive the concentration of the liquid inside the liquid circulation system, wherein the concentration adjustment unit further includes a total discharge amount derivation unit configured to derive a total discharge amount from the inside of the liquid circulation system and a total evaporation amount derivation unit configured to derive a total evaporation amount from the inside of the liquid circulation system, and wherein the concentration adjustment unit derives the concentration of the liquid inside the liquid circulation system on the basis of the total discharge amount and the total evaporation amount.

2. The printing apparatus according to claim 1, wherein the concentration adjustment unit further includes a necessary discharge amount derivation unit configured to derive a necessary discharge amount of the liquid to be discharged from the inside of the liquid circulation system on the basis of the derived concentration.

3. The printing apparatus according to claim 1, wherein the concentration adjustment unit further includes a hitting dot number derivation unit configured to derive the number of hitting dots necessary to form an image in accordance with image data on the basis of the image data and a recovery amount derivation unit configured to derive a recovery amount by cumulatively adding the amount of the liquid used for a suction and recovery operation of the liquid ejection head, and wherein the total discharge amount derivation unit derives the total discharge amount on the basis of at least one of the number of hitting dots and the recovery amount.

4. The printing apparatus according to claim 3, wherein the total evaporation amount derivation unit derives an evaporation amount from a non-ejection nozzle while an image is formed by the liquid ejected from an ejection nozzle on the basis of the number of hitting dots.

5. The printing apparatus according to claim 4, wherein the total evaporation amount derivation unit derives the evaporation amount from the non-ejection nozzle on the basis of a temperature of the liquid ejection head.

6. The printing apparatus according to claim 4, wherein the total evaporation amount derivation unit derives an evaporation amount from all nozzles immediately before and after the image forming operation.

7. A printing apparatus that uses a liquid ejection head including an ejection opening ejecting a liquid, a print element generating energy for ejecting a liquid, and a pressure chamber having the print element provided therein, the printing apparatus comprising:

a circulator configured to circulate the liquid so that the liquid passes through the pressure chamber; and a concentration adjustment unit configured to adjust a concentration of a liquid inside a liquid circulation system by discharging the liquid from the inside of the liquid circulation system and replenishing the liquid into the liquid circulation system from the outside of the liquid circulation system in response to the amount of the discharged liquid, wherein the concentration adjustment unit calculates a printing duty on the basis of image data and discharges the liquid from the inside of the liquid circulation system by an amount corresponding to a difference between the calculated printing duty and a reference value in a case where the calculated printing duty is smaller than the reference value.

8. A printing apparatus that uses a liquid ejection head including an ejection opening ejecting a liquid, a print element generating energy for ejecting a liquid, and a pressure chamber having the print element provided therein, the printing apparatus comprising:

a circulator configured to circulate the liquid so that the liquid passes through the pressure chamber; and a concentration adjustment unit configured to adjust a concentration of a liquid inside a liquid circulation system by discharging the liquid from the inside of the liquid circulation system and replenishing the liquid into the liquid circulation system from the outside of the liquid circulation system in response to the amount of the discharged liquid, wherein the concentration adjustment unit discharges the liquid from the inside of the liquid circulation system by a preliminary ejection from a nozzle.

9. The printing apparatus according to claim 8, wherein the preliminary ejection is performed in at least one of a timing immediately before a circulation flow is generated inside the liquid circulation system and a timing after the circulation flow inside the liquid circulation system is stopped.

10. The printing apparatus according to claim 8, wherein the preliminary ejection is performed by a nozzle which is not frequently used.

11. The printing apparatus according to claim 8, further comprising:

one or a plurality of main tanks storing the liquid in addition to the liquid circulation system, wherein in a case where the printing apparatus includes the plurality of main tanks, the liquid is replenished from any one of the plurality of main tanks into the liquid circulation system.

12. The printing apparatus according to claim 11, wherein in a case where the printing apparatus includes the plurality of main tanks and the amount of the liquid remaining inside the main tank replenishing the liquid into the liquid circulation system becomes a predetermined value or less, the liquid inside the main tank is moved into the liquid circulation system and the liquid is replenished from the main tank different from the main tank from which the liquid is moved into the liquid circulation system.

13. The printing apparatus according to claim 11, wherein a concentration of the liquid stored in the main tank is lower than a concentration of the liquid inside the liquid circulation system.

14. The printing apparatus according to claim 8, wherein the liquid includes a plurality of colors of ink, the printing apparatus includes liquid circulation systems respectively corresponding to the plurality of colors of ink, and the liquid circulation systems are individually controlled.

15. The printing apparatus according to claim 8, wherein the liquid ejection head is a page wide type liquid ejection head including a plurality of print element boards each including the print element.

16. The printing apparatus according to claim 15, wherein the plurality of print elements are arranged in a linear shape.

17. A printing method that is performed by a printing apparatus using a liquid ejection head including an ejection opening ejecting a liquid, a print element generating energy for ejecting a liquid, and a pressure chamber having the print element provided therein, the printing method comprising:

circulating the liquid so that the liquid passes through the pressure chamber; and adjusting a concentration of a liquid inside a liquid circulation system by discharging the liquid from the inside of the liquid circulation system and replenishing the liquid into the liquid circulation system from the outside of the liquid circulation system in response to the amount of the discharged liquid, wherein the step of adjusting concentration includes:

deriving the concentration of the liquid inside the liquid circulation system, deriving a total discharge amount from the inside of the liquid circulation system, deriving a total evaporation amount from the inside of the liquid circulation system, and deriving the concentration of the liquid inside the liquid circulation system on the basis of the total discharge amount and the total evaporation amount.

18. A printing method that is performed by a printing apparatus using a liquid ejection head including an ejection opening ejecting a liquid, a print element generating energy for ejecting a liquid, and a pressure chamber having the print element provided therein, the printing method comprising:

circulating the liquid so that the liquid passes through the pressure chamber; and adjusting a concentration of a liquid inside a liquid circulation system by discharging the liquid from the inside of the liquid circulation system and replenishing the liquid into the liquid circulation system from the outside of the liquid circulation system in response to the amount of the discharged liquid, wherein the step of adjusting concentration includes:

calculating a printing duty on the basis of image data, and discharging the liquid from the inside of the liquid circulation system by an amount corresponding to a difference between the calculated printing duty and a reference value in a case where the calculated printing duty is smaller than the reference value.

19. A printing method that is performed by a printing apparatus using a liquid ejection head including an ejection opening ejecting a liquid, a print element generating energy for ejecting a liquid, and a pressure chamber having the print element provided therein, the printing method comprising:

circulating the liquid so that the liquid passes through the pressure chamber; and adjusting a concentration of a liquid inside a liquid circulation system by discharging the liquid from the inside of the liquid circulation system and replenishing the liquid into the liquid circulation system from the outside of the liquid circulation system in response to the amount of the discharged liquid, wherein the step of adjusting concentration includes discharging the liquid from the inside of the liquid circulation system by a preliminary ejection from a nozzle.

* * * * *